US011673017B2

(12) United States Patent
Konopacz et al.

(10) Patent No.: US 11,673,017 B2
(45) Date of Patent: Jun. 13, 2023

(54) BED EXERCISE SYSTEMS AND METHODS

(71) Applicant: Sage Products LLC, Cary, IL (US)

(72) Inventors: Kaitlin Konopacz, Lake Zurich, IL (US); Heather Sirianni, Crystal Lake, IL (US); Kristin Sexton, Lake in the Hills, IL (US); Lawrence G. Ponsi, Wheeling, IL (US)

(73) Assignee: Sage Products, LLC, Cary, IL (US)

( * ) Notice: Subject to any disclaimer, the term of this patent is extended or adjusted under 35 U.S.C. 154(b) by 0 days.

(21) Appl. No.: 17/334,306

(22) Filed: May 28, 2021

(65) Prior Publication Data

US 2021/0370127 A1 Dec. 2, 2021

Related U.S. Application Data

(60) Provisional application No. 63/129,691, filed on Dec. 23, 2020, provisional application No. 63/033,053, filed on Jun. 1, 2020.

(51) Int. Cl.
*A63B 21/16* (2006.01)
*A63B 21/00* (2006.01)
(Continued)

(52) U.S. Cl.
CPC ..... *A63B 21/1672* (2015.10); *A63B 21/0442* (2013.01); *A63B 21/0557* (2013.01);
(Continued)

(58) Field of Classification Search
CPC ..... A63B 21/1672; A63B 21/4011–4015
See application file for complete search history.

(56) References Cited

U.S. PATENT DOCUMENTS 2,340,666 A * 2/1944 Johanson ..... A47C 20/022 5/651
3,523,310 A * 8/1970 Shead ..... A47C 20/022 5/651
(Continued)

FOREIGN PATENT DOCUMENTS

KR 960 000 683 1/1996
WO 2019/191066 A1 10/2019

OTHER PUBLICATIONS

International Search Report and Written Opinion issued in International Patent Application No. PCT/US2021/034960 dated Nov. 5, 2021 (19 pages).
(Continued)

*Primary Examiner* — Nyca T Nguyen
(74) *Attorney, Agent, or Firm* — McDonnell Boehnen Hulbert & Berghoff LLP

(57) ABSTRACT

In an example, a bed exercise system includes a foot pad and first and second elastic connectors. The foot pad includes a rigid support member. The first elastic connector has a first end coupled to a first lateral side of the foot pad and a second end for coupling to a support structure. The second elastic connector has a first end coupled to a second lateral side of the foot pad and a second end coupling to the support structure. When the second ends of the first and second elastic connectors are coupled to the support structure: (i) the foot pad is movable between a first position and a second position relative to the support structure, and (ii) a tension on the first elastic connector and a tension on the second elastic connector increases as the foot pad moves from the first position to the second position.

20 Claims, 39 Drawing Sheets

(51) Int. Cl.
*A63B 21/04* (2006.01)
*A63B 21/055* (2006.01)
*A63B 71/00* (2006.01)

(52) U.S. Cl.
CPC ..... *A63B 21/4034* (2015.10); *A63B 71/0036* (2013.01); *A63B 2208/0238* (2013.01)

(56) References Cited

U.S. PATENT DOCUMENTS 3,524,643 A 8/1970 Hazelitt
4,463,947 A * 8/1984 Kloenne ..... A63B 23/0494 482/139
4,665,899 A 5/1987 Farris et al.
4,765,005 A * 8/1988 Hippel ..... A47C 20/022 4/445
5,125,649 A * 6/1992 Fuller ..... A63B 23/1209 482/106
5,153,959 A * 10/1992 Fitzsimmons ..... A61G 7/0536 482/904
5,236,333 A 8/1993 Barba, Jr.
5,279,530 A 1/1994 Hess
5,480,369 A * 1/1996 Dudley ..... A63B 21/4035 482/130
5,499,958 A 3/1996 Hess
5,673,447 A * 10/1997 White ..... A47C 20/022 5/651
5,674,163 A * 10/1997 Sennett ..... A63B 23/0216 482/125
5,674,168 A * 10/1997 Wilkinson ..... A63B 21/4047 482/145
5,690,594 A * 11/1997 Mankovitz ..... A63B 21/1609 482/121
5,743,838 A 4/1998 Willis
6,224,521 B1 * 5/2001 Foucault ..... A63B 23/0417 602/23
6,425,844 B1 * 7/2002 Azar ..... A61H 1/0259 482/79
6,544,152 B2 * 4/2003 Rosati ..... A63B 23/03575 482/130
6,726,606 B2 4/2004 Jacobsen
6,749,548 B2 6/2004 Hoffman
6,840,894 B2 1/2005 Lerner
6,878,102 B1 4/2005 Commisso
7,004,893 B1 2/2006 Waters
7,104,935 B2 * 9/2006 Matsuoka ..... A63B 21/0552 482/121
7,192,410 B1 3/2007 Rodgers
7,597,656 B2 10/2009 Trees
7,883,453 B1 2/2011 Cooper
8,142,336 B1 3/2012 Yates
8,403,817 B2 3/2013 Ferguson et al.
8,479,326 B1 7/2013 Roberts et al.
8,721,509 B1 5/2014 Berdut-Teruel
9,125,785 B2 9/2015 Trees
9,282,829 B2 * 3/2016 Caruso ..... A63B 21/0557
9,538,852 B2 * 1/2017 Levy ..... F16M 13/04
9,687,401 B2 6/2017 Alford et al.
9,775,764 B1 * 10/2017 Rill ..... A61H 1/0266
9,868,013 B1 1/2018 Leverenz et al.
10,166,432 B2 1/2019 Kabasso
10,596,406 B2 3/2020 Avila
10,842,696 B1 * 11/2020 Wolpe ..... A63B 21/0552
10,874,567 B2 12/2020 Zerhusen et al.
11,318,341 B2 * 5/2022 Marti ..... A63B 21/00185
2002/0193210 A1 * 12/2002 Turner ..... A63B 21/4047 482/80
2008/0119338 A1 * 5/2008 Prsala ..... A63B 23/1209 482/142
2009/0192022 A1 * 7/2009 Kulka ..... A63B 21/153 482/46
2013/0074270 A1 * 3/2013 Caruso ..... A63B 21/4021 5/658
2015/0290061 A1 * 10/2015 Stafford ..... A63B 21/4047 5/600
2017/0035638 A1 2/2017 Koenig
2017/0232289 A1 * 8/2017 Pouchet ..... A63B 23/03533 482/93
2018/0290010 A1 * 10/2018 Huang ..... A63B 21/0552
2019/0314668 A1 10/2019 Bourke et al.
2020/0197743 A1 * 6/2020 Biele ..... A63B 21/4025
2021/0016133 A1 * 1/2021 Wu ..... A63B 22/20
2021/0106479 A1 4/2021 Zerhusen et al.
2021/0170225 A1 6/2021 Jacobs

OTHER PUBLICATIONS

International Search Report and Written Opinion issued in International Patent Application No. PCT/US2022/037718, dated Dec. 9, 2022 (30 pages).

* cited by examiner

BED EXERCISE SYSTEMS AND METHODS

CROSS-REFERENCE TO RELATED APPLICATIONS

This application claims the benefit of U.S. Provisional Application No. 63/129,691, filed on Dec. 23, 2020, and U.S. Provisional Application No. 63/033,053, filed Jun. 1, 2020, the contents of which are hereby incorporated by reference in their entirety.

FIELD

The present disclosure generally relates to exercise systems and methods and, in particular, exercise systems and methods for use in a bed.

BACKGROUND

In some instances, medical professionals may prescribe a patient bed rest. A period of bed rest can lead to deterioration of muscle strength (i.e., muscle atrophy). This, in turn, can lead to a patient having difficulties supporting their full body weight when later attempting to stand and/or move.

SUMMARY

In an example, a bed exercise system includes a foot pad, a first elastic connector, and a second elastic connector. The foot pad includes a rigid support member. The first elastic connector has a first end coupled to a first lateral side of the foot pad and a second end configured to couple to a patient support structure. The second elastic connector has a first end coupled to a second lateral side of the foot pad and a second end configured to couple to the patient support structure. When the second end of the first elastic connector and the second end of the second elastic connector are coupled to the patient support structure: (i) the foot pad is movable between a first position and a second position relative to the patient support structure, and (ii) a tension on the first elastic connector and a tension on the second elastic connector increases as the foot pad moves from the first position to the second position.

In another example, a method of performing an exercise in a bed includes coupling an anchor to a patient support structure. The method also includes coupling a first elastic connector to the anchor and coupling a second elastic connector to the anchor. The first elastic connector extends from the anchor to a foot pad, and the second elastic connector extends from the anchor to the foot pad. Additionally, the method includes positioning at least one foot of an operator on the footpad and at least one leg of the operator between the first elastic connector and the second elastic connector. The method further includes moving, using the at least one foot and the at least one leg, the foot pad to a first position. The method also includes moving, using the at least one foot and the at least one leg, the foot pad distally from the first position to a second position to increase a tension on the first elastic connector and a tension on the second elastic connector.

In an example, a bed exercise system includes a foot pad, a first elastic connector, and a second elastic connector. The foot pad includes a rigid support member, and a cushion member proximal of the rigid support member. The first elastic connector has a first end coupled to a first lateral side of the foot pad and a second end configured to couple to a bed. A second elastic connector has a first end coupled to a second lateral side of the foot pad and a second end configured to couple to the bed. When the second end of the first elastic connector and the second end of the second elastic connector are coupled to the bed: (i) the foot pad is movable between a first position and a second position relative to the bed, and (ii) a tension on the first elastic connector and a tension on the second elastic connector increases as the foot pad moves from the first position to the second position.

In another example, a system includes a mattress anchor, a foot pad, a first elastic connector, and a second elastic connector. The foot pad includes a flexible tube. The mattress anchor is configured to couple to a first end of a mattress. The first and second elastic connector each have a first end coupled to a respective side of the foot pad and a second end coupled to the mattress anchor. When the mattress anchor is coupled to the bed: (i) the foot pad is movable between a first position and a second position relative to the bed, and (ii) a tension on the first elastic connector and a tension on the second elastic connector increases as the foot pad moves from the first position to the second position.

The features, functions, and advantages that have been discussed can be achieved independently in various embodiments or may be combined in yet other embodiments further details of which can be seen with reference to the following description and drawings.

BRIEF DESCRIPTION OF THE FIGURES

The novel features believed characteristic of the illustrative embodiments are set forth in the appended claims. The illustrative embodiments, however, as well as a preferred mode of use, further objectives and descriptions thereof, will best be understood by reference to the following detailed description of an illustrative embodiment of the present disclosure when read in conjunction with the accompanying drawings, wherein:

DETAILED DESCRIPTION

Disclosed embodiments will now be described more fully hereinafter with reference to the accompanying drawings, in which some, but not all of the disclosed embodiments are shown. Indeed, several different embodiments may be described and should not be construed as limited to the embodiments set forth herein. Rather, these embodiments are described so that this disclosure will be thorough and complete and will fully convey the scope of the disclosure to those skilled in the art.

Figure 1A:
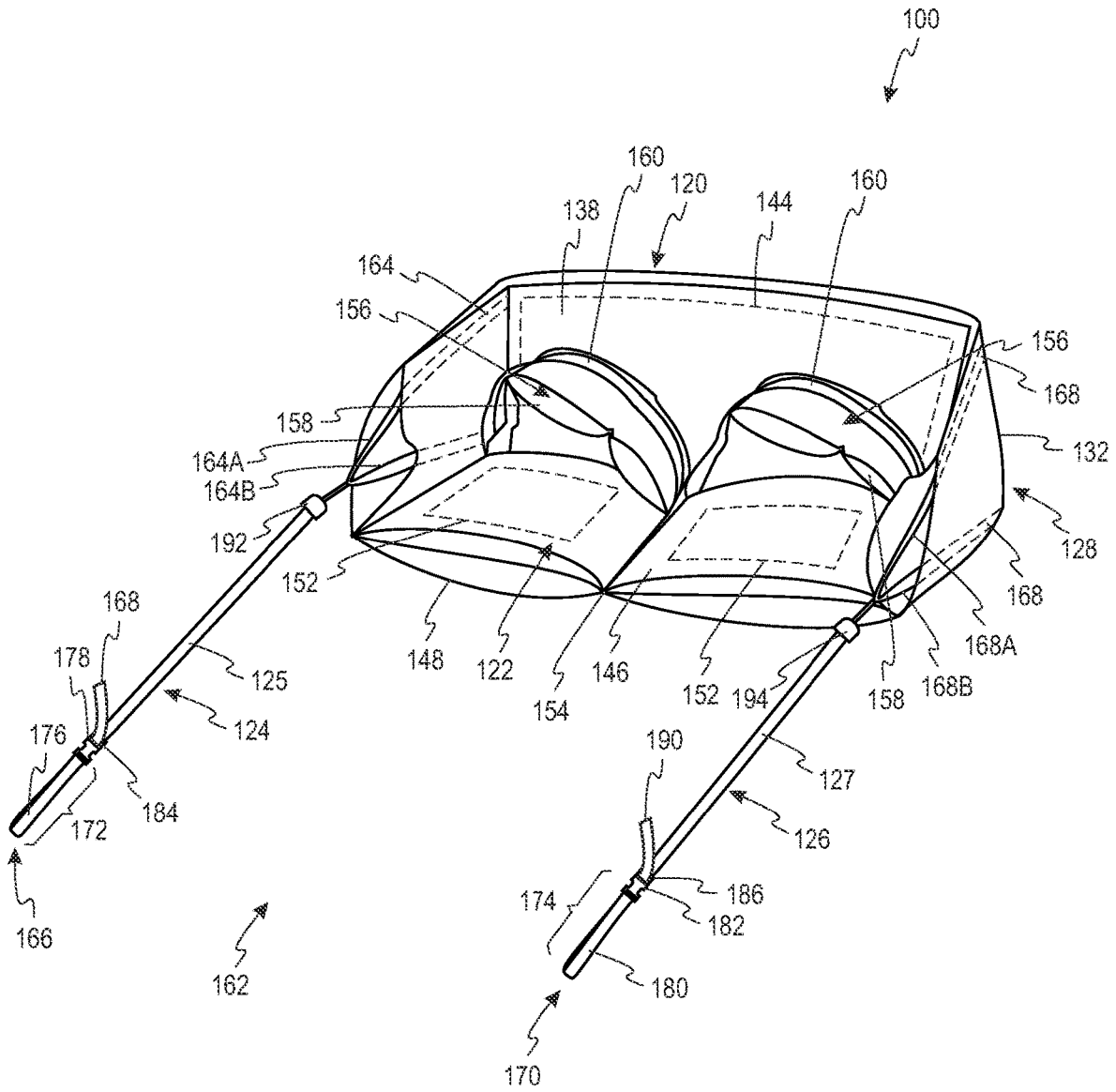
FIG. 1A illustrates a perspective view of a bed exercise system, according to an example.
Figure 1B:
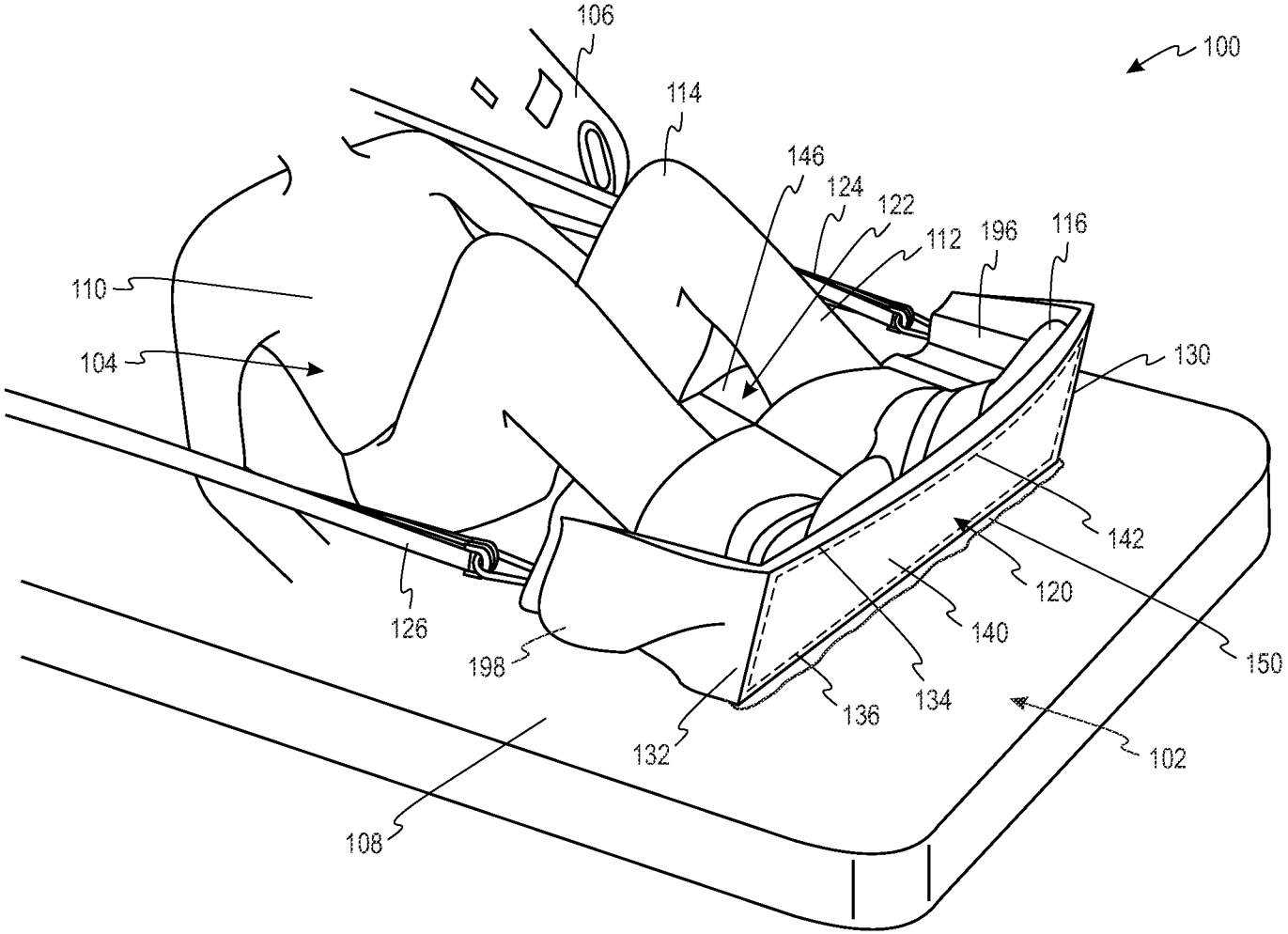
FIG. 1B illustrates another perspective view of the bed exercise system shown in FIG. 1, according to an example.

Referring now to FIGS. 1A-1B, a bed exercise system 100 is illustrated according to an example embodiment. More specifically, FIG. 1A depicts a perspective view of the bed exercise system 100, and FIG. 1B depicts a perspective view of the bed exercise system 100 coupled to a bed 102 and an operator 104, according to an example.

As shown in FIG. 1B, the bed 102 includes a bed frame 106 and a mattress 108. Additionally, as shown in FIG. 1B, the operator 104 has a torso 110, two legs 112, two knees 114, and two feet 116. As used herein, the term "proximal" means nearer to the torso 110 of the operator 104 and the term "distal" means farther from the torso 110 of the operator 104 when the operator 104 is operating the bed exercise system 100. Additionally, as used herein, the term "lower" means nearer to a ground on which the bed 102 is supported and the term "upper" means farther from the ground on which the bed 102 is supported when the operator 104 is operating the bed exercise system 100.

As shown in FIGS. 1A-1B, the bed exercise system 100 includes a foot pad 120, a leg support member 122, and a plurality of elastic connectors 124, 126. In general, the foot pad 120 is configured to support one foot or both feet 116 of the operator 104 at a distal end 128 of the bed exercise system 100. The foot pad 120 includes a first lateral side 130, a second lateral side 132 opposite the first lateral side 130, an upper side 134, and a lower side 136. Additionally, the foot pad 120 includes a proximal surface 138 facing the operator 104, and a distal surface 140 opposite of the proximal surface 138. In FIGS. 1A-1B, the proximal surface 138 and the distal surface 140 extend between the first lateral side 130, the second lateral side 132, the upper side 134, and the lower side 136 to define an internal cavity in the foot pad 120.

Additionally, as shown in FIGS. 1A-1B, the foot pad 120 includes a rigid support member 142 and a cushion member 144. In FIGS. 1A-1B, the rigid support member 142 and the cushion member 144 are in the internal cavity of the foot pad 120. More specifically, the cushion member 144 is located proximal of the rigid support member 142 in the internal cavity of the foot pad 120. In this arrangement, the rigid support member 142 can provide the foot pad 120 with sufficient rigidity for supporting one or both of the feet 116 of the operator 104, and the cushion member 144 can assist in improving (or maximizing) comfort of the operator 104 by providing a relatively soft structure at the proximal surface 138 for engaging the soles of the feet 116 of the operator 104. Additionally, for instance, the cushion member 144 can assist in reducing a concentration of pressure on the feet 116 during operation of the bed exercise system 100.

As examples, the rigid support member 142 can be made from a metal and/or a plastic material. In some examples, the material from which the rigid support member 142 is made can be selected based on one or more factors such as, for instance, a weight of the material, a rigidity of the material, a cost of the material, and/or a thickness of the material. For instance, a material of the rigid support member 142 can be selected to achieve a rigidity that is greater than a threshold rigidity, a weight that is less than a threshold weight, a cost that is less than a threshold cost, and/or a thickness that is less than a threshold thickness. By selecting a relatively lightweight and/or low cost material, the foot pad 120 may be a disposable portion of the bed exercise system 100. Additionally, by selecting a relatively thin material, the foot pad 120 can be beneficially stored in a relatively compact, space-efficient manner when not in use.

Also, as examples, the cushion member 144 can be made from a foam material, feathers, a fiber material, and/or air. For instance, in one implementation, the cushion member 144 can be made from a polyurethane foam material. In some examples, the material from which the cushion member 144 is made can be selected based on one or more factors such as, for instance, a weight of the material, a compressibility of the material, a cost of the material, and/or a thickness of the material. These factors may also contribute to the disposability of the foot pad 120 and/or the space-efficiency of the foot pad 120 for storing of the bed exercise system 100 when not in use.

In an example, the foot pad 120 can have a height (e.g., a dimension between the upper side 134 and the lower side 136) between approximately 4 inches and approximately 15 inches, and a width (e.g., a dimension between the first lateral side 130 and the second lateral side 132) that is between approximately 9 inches and approximately 36 inches. In FIGS. 1A-1B, the foot pad 120 has a cross-sectional shape that is generally rectangular. However, in other examples, the foot pad 120 can have a different cross-sectional shape.

As shown in FIGS. 1A-1B, the leg support member 122 extends proximally from the lower side 136 of the foot pad 120. Additionally, in FIGS. 1A-1B, the leg support member 122 further extends between the first lateral side 130 and the second lateral side 132 of the foot pad 120. In general, the leg support member 122 is suitable for supporting the ankle(s) and the leg(s) 112 of the operator 104 during operation of the bed exercise system 100.

Within examples, the leg support member 122 can include an upper exterior surface 146 for engaging with the ankle(s) and the leg(s) 112 of the operator, and a lower exterior surface 148 for engaging with the mattress 108 of the bed 102. The lower exterior surface 148 can be made from a relatively low-friction material. As described herein, this can help the leg support member 122 and the foot pad 120 move between a first, retracted position and a second, extended position during operation of the bed exercise system 100.

Additionally, as shown in FIG. 1B, the leg support member 122 can include a flap portion 150 that extends distally and below the lower side 136 of the foot pad 120. The flap portion 150 can also be made from a relatively low-friction material. Thus, by extending below the foot pad 120, the flap portion 150 of the leg support member 122 can also assist in moving the leg support member 122 and the foot pad 120 between the first, retracted position and the second, extended position.

The upper exterior surface 146 and the lower exterior surface 148 can define a cavity. Additionally, the leg support member 122 can include a leg cushion 152 in the cavity. As such, the leg support member 122 can assist in improving operator comfort by providing cushioning between the ankle(s) and leg(s) 112 of the operator 104 and the mattress 108 of the bed 102.

In FIGS. 1A-1B, the leg support member 122 can include a seam 154 that divides the cavity into a first chamber and a second chamber, and the leg cushion 152 can be in the first chamber and the second chamber. This can help to maintain a relatively even distribution of the leg cushion 152 in the leg support member 122 and, thus, assist in enhancing a balance and stability of the leg support member 122 during operation of the bed exercise system 100.

As examples, the leg cushion 152 can be made from a foam material, feathers, a fiber material, and/or air. For instance, in one implementation, the leg cushion 152 can be made from a polyurethane foam material. In some examples, the material from which the leg cushion 152 is made can be selected based on one or more factors such as, for instance, a weight of the material, a compressibility of the material, a cost of the material, and/or a thickness of the material. These factors may also contribute to the disposability of the leg support member 122 and/or the space-efficiency of the leg support member 122 for storing of the bed exercise system 100 when not in use.

In some examples, the foot pad 120 can be foldable relative to the leg support member 122 at an interface between the foot pad 120 and the leg support member 122. For instance, in FIGS. 1A-1B, the foot pad 120 is foldable relative to the leg support member 122 at the lower side 136 of the foot pad 120. By folding the foot pad 120 and the leg support member 122, the bed exercise system 100 can be collapsed into a more compact, space-efficient size. This can help to improve (or maximize) efficient storage of one or more of the bed exercise systems 100 at a particular location. For example, there may be limited storage space at a healthcare facility (e.g., a hospital, a rehabilitation center, and/or a nursing home) and, thus, the foldability can help to use that limited storage space in an efficient manner.

As shown in FIGS. 1A-1B, the bed exercise system 100 can also include a plurality of ankle straps 156 coupled to the leg support member 122. Each ankle strap 156 is configured to (i) retain a respective foot 116 of the operator 104 in a position at which the sole of the foot 116 engages the foot pad 120 and/or (ii) retain a respective heel and lower leg 112 of the operator 104 in engagement with the leg support member 122. As such, the ankle straps 156 can help to support the legs 112 and feet 116 of the operator 104 and, thus, provide the operator 104 with greater control during operation of the bed exercise system 100.

Within examples, each ankle strap 156 can include an ankle cushion 158 and an adjustment belt 160. The ankle cushion 158 can help to improve (or maximize) the comfort of the operator 104 by, for instance, more evenly distributing pressure over the ankles and/or feet 116 of the operator 104. The adjustment belts 160 are configured to tighten and loosen the ankle straps 156. This can facilitate adjusting the size of a respective aperture between each ankle strap 156 and the leg support member 122 through which the ankles and/or feet 116 of the operator 104 are positioned in use. As such, the ankle straps 156 can be adjusted (e.g., via the adjustment belts 160) to accommodate a plurality of operators 104 having differently sized and/or shaped ankles and/or feet 116.

In FIGS. 1A-1B, the bed exercise system 100 includes two ankle straps 156. However, in another example, the bed exercise system 100 can include a single ankle strap 156, which can be located at a more central location between the first lateral side 130 and the second lateral side 132 to facilitate exercise for a single leg at one time. Thus, in general, the bed exercise system 100 can also include one or more ankle straps 156 coupled to the leg support member 122.

In FIGS. 1A-1B, the elastic connectors 124, 126 extend from the foot pad 120 to a proximal end 162 of the bed exercise system 100. As shown in FIGS. 1A-1B, the elastic connectors 124, 126 include a first elastic connector 124 and a second elastic connector 126. The first elastic connector 124 has a first end 164 coupled to the first lateral side 130 of the foot pad 120 and a second end 166 configured to couple to the bed 102. The second elastic connector 126 has a first end 168 coupled to the second lateral side 132 of the foot pad 120 and a second end 170 configured to couple to the bed 102.

As shown in FIG. 1A, the first end 164 of the first elastic connector 124 can include a first segment 164A coupled to a top portion (e.g., at location nearer the upper side 134 than the lower side 136) of the foot pad 120 and a second segment 164B coupled to a bottom portion (e.g., at location nearer the lower side 136 than the upper side 134) of the foot pad 120. Similarly, the first end 168 of the second elastic connector 126 can include a first segment 168A coupled to the top portion of the foot pad 120 and a second segment 168B coupled to the bottom portion of the foot pad 120. In this arrangement, the first elastic connector 124 and the second elastic connector 126 can more evenly distribute forces exerted, by the first elastic connector 124 and the second elastic connector 126, on the foot pad 120. This, in turn, can help to improve balance and usability of the bed exercise system 100.

As shown in FIG. 1A, the second end 166 of the first elastic connector 124 can include a first anchor 172 configured to couple to the bed 102, and the second end 170 of the second elastic connector 126 can include a second anchor 174 configured to couple to the bed 102. For example, in FIG. 1A, the first anchor 172 includes a first loop 176 and a first releasable fastener 178, and the second anchor 174 includes a second loop 180 and a second releasable fastener 182. The first releasable fastener 178 is suitable to allow the first anchor 172 to be coupled to and decoupled from a main portion 125 of the first elastic connector 124, and the second releasable fastener 182 is suitable to allow the second anchor 174 to be coupled to and decoupled from a main portion 127 of the second elastic connector 126. For instance, the first releasable fastener 178 and the second releasable fastener 182 can each be a respective buckle. A process for coupling the first elastic connector 124 and the second elastic connector 126 is further described herein with respect to FIGS. 3-4.

When the second end 166 of the first elastic connector 124 and the second end 170 of the second elastic connector 126 are coupled to the bed 102, the foot pad 120 is movable between the first, retracted position and the second, extended position relative to the bed 102. The first, retracted position is proximal of the second, extended position. Additionally, when the foot pad 120 is in the first, retracted position, the first elastic connector 124 and the second elastic connector 126 are in a relatively relaxed state (i.e., a relatively low tension state) such that the foot pad 120 applies a first or low level of resistance against the feet 116 and the legs 112 of the operator 104.

To move the foot pad 120 from the first, retracted position to the second, extended position, the operator 104 can extend his or her legs 112 and feet 116 to apply a force on the foot pad 120. As the foot pad 120 moves from the first, retracted position to the second, extended position, the tension on the first elastic connector 124 and the second elastic connector increases. In this way, the foot pad 120 applies progressively increasing levels of resistance against the feet 116 and the legs of the operator 104 as the foot pad 120 moves from the first, retracted position to the second, extended position.

After the foot pad 120 is in the second, extended position, the operator 104 can retract his or her legs 112 and feet 116 to move the foot pad 120 back from the second, extended position to the first, retracted position. As the foot pad 120 moves from the second, extended position to the first, retracted position, the tension on the first elastic connector 124 and the second elastic connector 126 decreases (and, thus, the resistance applied by the foot pad 120 against the feet 116 and the legs 112 of the operator 104 decreases).

By operating the bed exercise system 100 to move the foot pad 120 between the first, retracted position and the second, retracted position, various muscles of the operator 104 contract against the resistance applied by the foot pad 120 on the feet 116 and the legs 112 of the operator 104. For example, the operator 104 uses his or her quadriceps, glueteus maximus, adductor magnus, and soleus muscles during each repetition ("rep") (i.e., during each cycle of moving the foot pad 120 to and from second, extended position). Additionally, the operator 104 may use various secondary muscles during each rep such as, for instance, the hamstrings and gastrocnemius to help stabilize the foot pad 120.

Accordingly, by exercising these various muscles throughout the lower body of the operator 104, the bed exercise system 100 can help to reduce (or prevent) muscle atrophy and/or deterioration while the operator 104 is confined to the bed 102 (e.g., on bed rest). This in turn may help the operator 104 to reduce (or minimize) rehabilitation and/or recovery time after an injury and/or a medical procedure. Additionally, the bed exercise system 100 can help to reduce the risk of (or prevent) injuries to the operator 104 while standing and/or walking after a period of confinement to the bed 102.

Within examples, the first elastic connector 124 and the second elastic connector 126 have an elastic modulus that is suitable to allow the first elastic connector 124 and the second elastic connector 126 to (i) be stretched from the relaxed or low tension state in the first, retracted position to a higher tensioned state in the second, extended position, and then (ii) return to the first, retracted position without performance-impacting (or any) inelastic deformation of the first elastic connector 124 and/or the second elastic connector 126. As one example, the first elastic connector 124 and the second elastic connector 126 can include one or more braided nylon bands.

In some examples, the first elastic connector 124 can include a first adjustment mechanism 184 that is configured to adjust a length of the first elastic connector 124, and the second elastic connector 126 can include a second adjustment mechanism 186 that is configured to adjust a length of the second elastic connector 126. For instance, in FIG. 1A, the buckles that provide the first releasable fastener 178 and the second releasable fastener 182 can additionally or alternatively include a frame and one or more bars that are suitable for adjusting the lengths of the first elastic connector 124 and the second elastic connector 126 (e.g., the buckles can be snap-buckles).

In FIG. 1A, a first free end 188 of the main portion 125 of the first elastic connector 124 is threaded through the first adjustment mechanism 184 (e.g., a first frame and one or more bars), and a second free end 190 of the main portion 127 of the second releasable fastener 182 is threaded through the second adjustment mechanism 186 (e.g., a second frame and one or more bars). In this arrangement, the first free end 188 of the first elastic connector 124 and the second free end 190 of the second elastic connector 126 can be moved to extend away and retract towards the first adjustment mechanism 184 and the second adjustment mechanism 186 to increase and decrease, respectively, the lengths of the first elastic connector 124 and the second elastic connector 126.

The first adjustment mechanism 184 and the second adjustment mechanism 186 can thus provide for adjusting the lengths of the first elastic connector 124 and the second elastic connector 126 to accommodate a plurality of operators 104 having differently sized legs 112. Additionally, for example, the first adjustment mechanism 184 and the second adjustment mechanism 186 can provide for adjusting the lengths of the first elastic connector 124 and the second elastic connector 126 to increase and/or decrease the tension on the first elastic connector 124 and the second elastic connector 126. This may beneficially provide for adjusting the level of resistance of the bed exercise system 100 to accommodate various operators 104 having different muscle strengths and/or levels of fitness.

As noted above, in some examples, the bed exercise system 100 can include disposable portion and a reusable portion. In an implementation of such examples, the disposable portion can include the foot pad 120 and the leg support member 122, and the reusable portion can include at least a portion of the first elastic connector 124 and the second elastic connector 126. For instance, in FIG. 1A, the first elastic connector 124 can include a third releasable fastener 192, and the second elastic connector 126 can include a fourth releasable fastener 194 that are configured to decouple the main portion 125 of the first elastic connector 124 and the main portion 127 of the second elastic connector 126 from the foot pad 120. As an example, the third releasable fastener 192 and the fourth releasable fastener 194 can include a carabiner and/or a buckle. In this way, the first elastic connector 124 and the second elastic connector 126 can be releasably coupled to the foot pad 120. By decoupling the first elastic connector 124 and the second elastic connector 126, the foot pad 120 and the leg support member 122 can be disposed of while retaining the first elastic connector 124 and the second elastic connector 126 for use with another foot pad 120 and another leg support member 122.

As shown in FIGS. 1A-1B, the bed exercise system 100 can also include a first sleeve 196 and a second sleeve 198. The first sleeve 196 is coupled to the first lateral side 130 of the foot pad 120 and encloses a distal portion of the first elastic connector 124 (e.g., the first end 164 of the first elastic connector 124). The second sleeve 198 is coupled to the second lateral side 132 of the foot pad 120 and encloses a distal portion of the second elastic connector 126 (e.g., the first end 168 of the second elastic connector 126). By covering the distal portions of the first elastic connector 124 and the second elastic connector 126, the first sleeve 196 and the second sleeve 198 can reduce a risk (or prevent) entanglement between the operator 104 and the first elastic connector 124 and the second elastic connector 126.

Additionally, as shown in FIGS. 1A-1B, the first sleeve 196 and the second sleeve 198 each extend between the foot pad 120 and a leg support member 122. This can help to control a range of movement of the foot pad 120 relative to the leg support member 122 during operation of the bed exercise system 100. For instance, the first sleeve 196 and the second sleeve 198 can limit an extent of rotation of the foot pad 120 in a distal direction relative to the leg support member 122 to help stabilize and support the feet 116 of the operator 104 while moving the foot pad 120 between the first, retracted position and the second, extended position.

In some examples, the foot pad 120, the leg support member 122, the first sleeve 196, the second sleeve 198, the first elastic connector 124, and the second elastic connector 126 can be configured such that the operator 104 can perform a calf extension exercise. For instance, the foot pad 120 can move the foot pad 120 from an initial position to a rotated position by flexing his or her ankles to rotate the foot pad 120 distally relative to the leg support member 122 (i.e., to rotate the foot pad 120 about the interface between the foot pad 120 and the leg support member 122). In the rotated position, the first elastic connector 124 and the second elastic connector 126 can apply a resistance to the feet 116 of the operator 104. Accordingly, within examples, the bed exercise system 100 can be used to perform a leg press exercise and/or a calf extension exercise.

As described, the first elastic connector 124 and the second elastic connector 126 can include the first adjustment mechanism 184 and the second adjustment mechanism 186, respectively, to adjust the lengths (and thus tension) of the first elastic connector 124 and the second elastic connector 126. Within examples, the first elastic connector 124 and the second elastic connector 126 can additionally or alternatively include other mechanisms to adjust the tension of the first elastic connector 124 and the second elastic connector 126.

Figure 2:
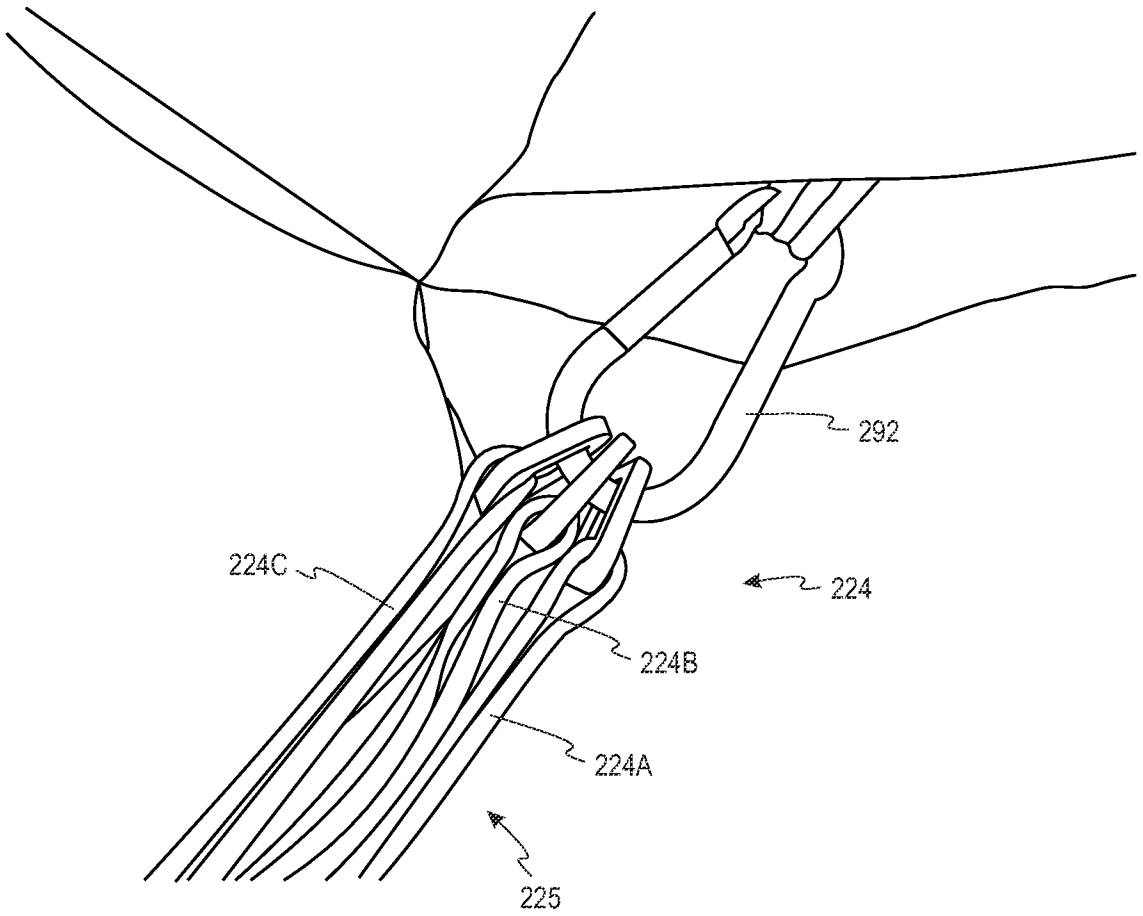
FIG. 2 illustrates a perspective view of a portion of an elastic connector, according to an example.

FIG. 2 depicts a main portion 225 of an elastic connector 224 according to another example embodiment. The elastic connector 224 can be the first elastic connector 124 and/or the second elastic connector 126 in FIGS. 1A-1B. In FIG. 2, the main portion 225 of the elastic connector 224 includes a plurality of bands 224A, 224B, 224C coupled to a releasable fastener 292. In this example, each of the bands 224A, 224B, 224C has a respective tension, and the tension of the elastic connector 224 is a combination of the respective tensions of the bands 224A, 224B, 224C. To adjust the tension of the elastic connector 224, one or more of the bands 224A, 224B, 224C can be decoupled from the releasable fastener 292. Thus, in FIG. 2, because the elastic connector 224 includes three bands 224A, 224B, 224C, the tension of the elastic connector 224 can be selectively adjusted between three different levels based on whether one, two, or all three of the bands 224A, 224B, 224C are coupled to the releasable fastener 292.

In some examples, the bands 224A, 224B, 224C can each have the same elastic modulus. In other examples, one of the bands 224A, 224B, 224C can have a different elastic modulus than another of the bands 224A, 224B, 224C. Additionally, although FIG. 2 depicts the elastic connector 224 having three bands 224A, 224B, 224C, the elastic connector 224 can have a different quantity of bands 224A, 224B, 224C (e.g., one band, two bands, four bands, five bands, etc.) in other examples.

Figure 3:
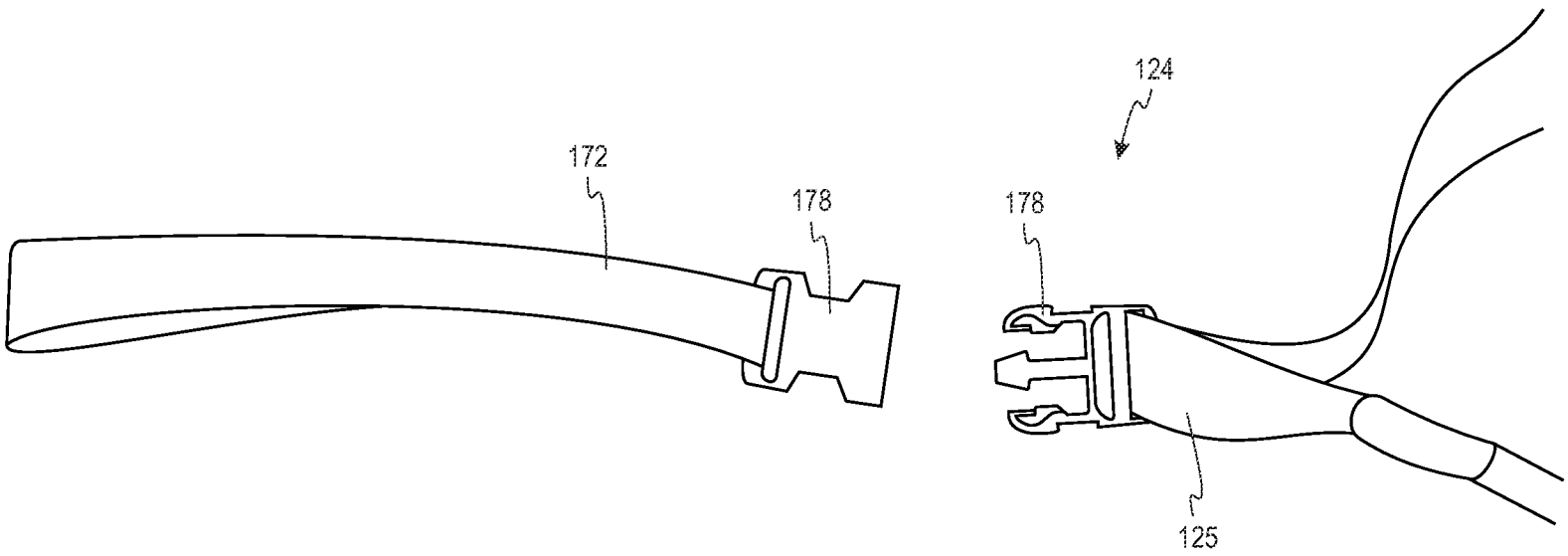
FIG. 3 illustrates a perspective view of a portion of an elastic connector, according to an example.

In operation, the bed exercise system 100 can be coupled to the bed 102. For instance, the first releasable fastener 178 can be actuated to decouple the first anchor 172 from the main portion 125 of the first elastic connector 124, and the second releasable fastener 182 can be actuated to decouple the second anchor 174 from the main portion 127 of the second elastic connector 126. As an example, FIG. 3 depicts the first anchor 172 decoupled from the main portion 125 according to an example embodiment.

Figure 4:
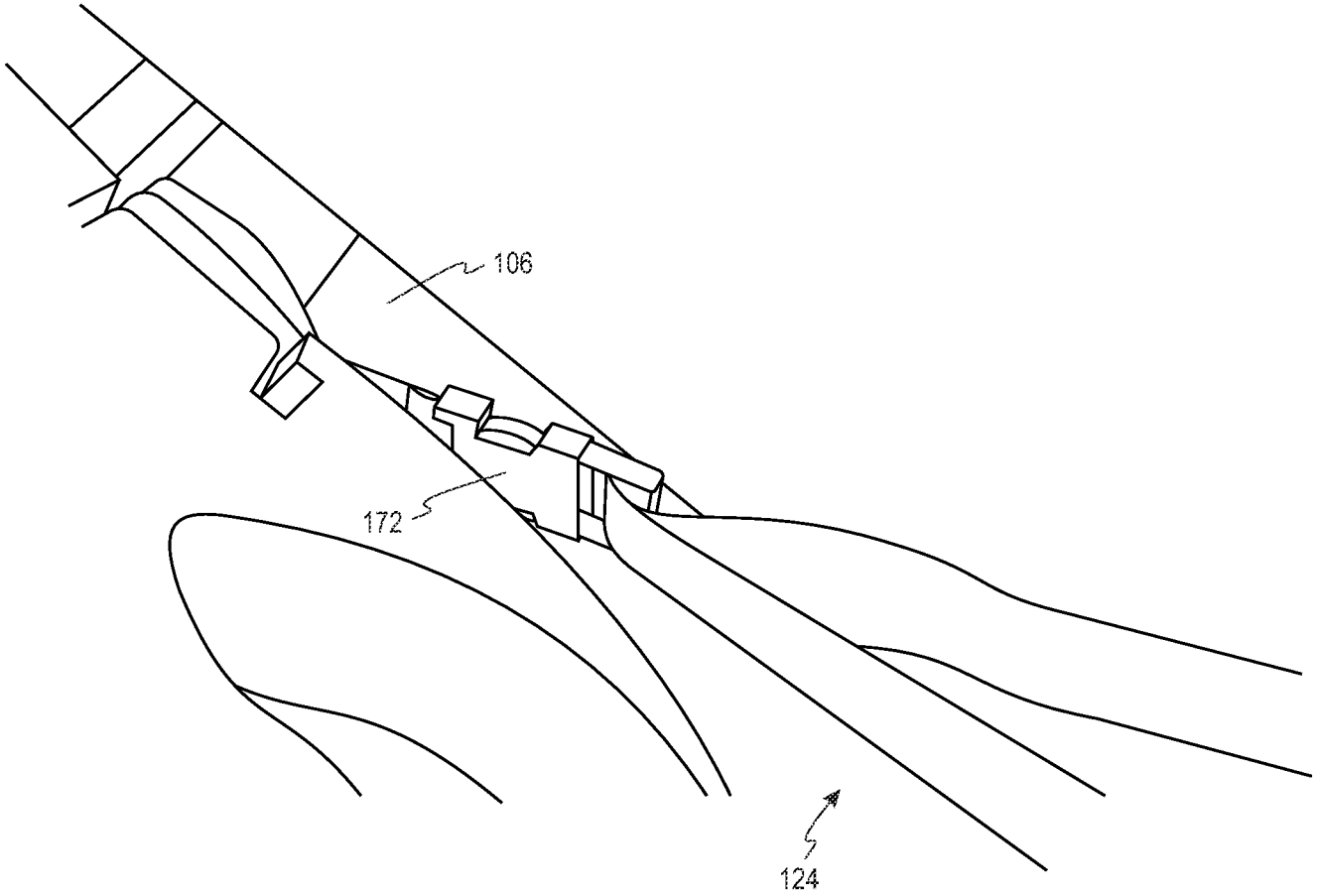
FIG. 4 illustrates a perspective view of the elastic connector shown in FIG. 3 coupled to a bed frame, according to an example.

After decoupling the first anchor 172 from the main portion 125 of the first elastic connector 124 and the second anchor 174 from the main portion 127 of the second elastic connector 126, the first anchor 172 and the second anchor 174 can then be wrapped around respective portions of the bed frame 106 and loose ends of the first anchor 172 and the second anchor 174 can be pulled through the first loop 176 of the first anchor 172 and the second loop 180 of the second anchor 174. The loose end of the first anchor 172 can then be recoupled, via the first releasable fastener 178, to the main portion 125 of the first elastic connector 124, and the loose end of the second anchor 174 can be recoupled, via the second releasable fastener 182, to the main portion 127 of the second elastic connector 126. As an example, FIG. 4 depicts the first elastic connector 124 coupled to the bed frame 106, according to an example embodiment.

Figure 5:
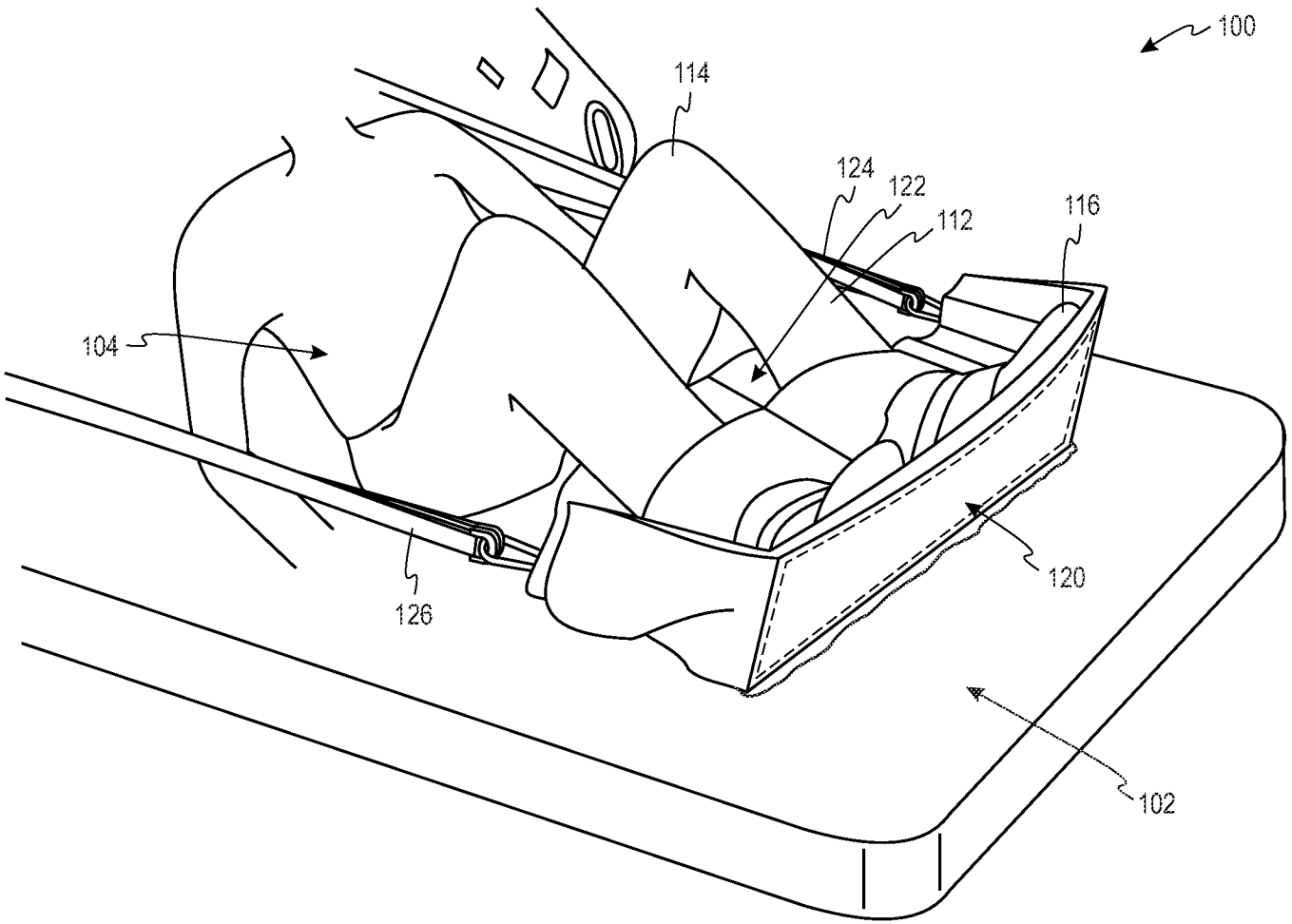
FIG. 5 illustrates a perspective view of the bed exercise system shown of FIG. 1 in a first position, according to an example.

After coupling the bed exercise system 100 to the bed 102, the bed exercise system 100 can be coupled to the operator 104. For example, the operator 104 can insert his or her feet 116 through the ankle straps 156 and then use the adjustment belts 160 to secure the feet 116 to the foot pad 120 and the leg support member 122. FIG. 5 depicts the bed exercise system 100 coupled to the bed 102 and the operator 104.

In particular, FIG. 5 depicts the bed exercise system 100 with the foot pad 120 in the first, retracted position. In one implementation, when the foot pad 120 is in the first, retracted position, the legs 112 of the operator 104 are bent at the knees 114 with an angle between approximately 60 degrees and approximately 90 degrees. In some instances, the operator 104 can adjust the length and/or quantity of bands 224A-224C of the first elastic connector 124 and/or the second elastic connector 126 to achieve a desired tension and/or length of the first elastic connector 124 and/or the second elastic connector 126 (e.g., via the first adjustment mechanism 184, the second adjustment mechanism 186, and/or releasable fastener 292) as described above.

Figure 6:
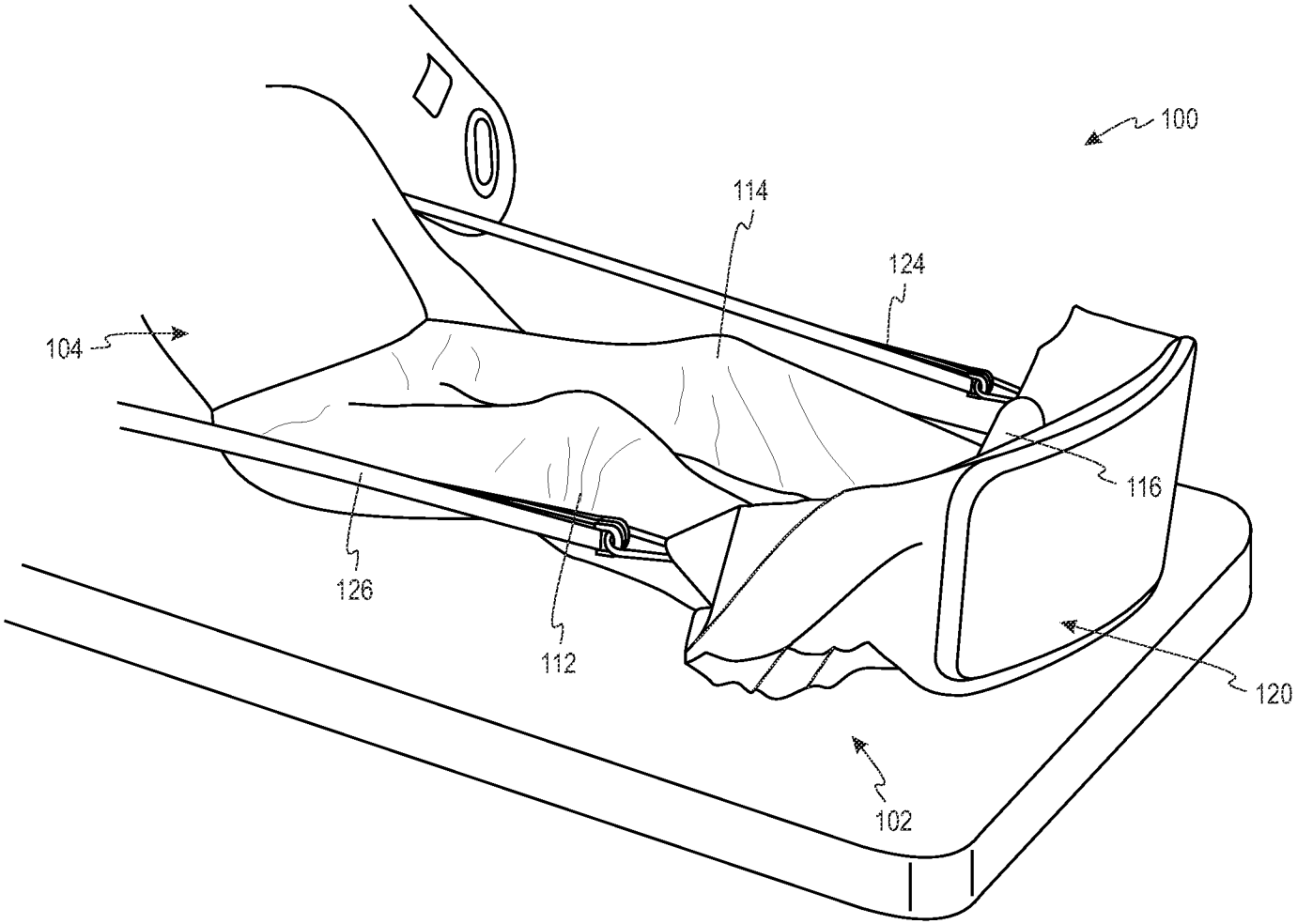
FIG. 6 illustrates a perspective view of the bed exercise system shown of FIG. 1 in a second position, according to an example.

Within examples, the operator 104 can then move the foot pad 120 from the first, retracted position shown in FIG. 5 to the second, extended position shown in FIG. 6. In one example, the second, extended position is approximately 12 inches to approximately 18 inches distal of the first, retracted position. The operator 104 may then move the foot pad 120 back from the second, extended position to the first, retracted position to complete a rep of a leg press exercise. The operator 104 can repeat this process to perform a workout, which helps to reduce (or prevent) muscle deterioration and/or muscle atrophy.

Additionally or alternatively, as described above, the operator 104 can rotate the foot pad 120 relative to the leg support member 122 to perform one or more reps of a calf extension exercise. For example, as described above, the operator 104 can rotate the foot pad, relative to the leg support member, from the initial portion to the rotated position to increase the tension on the first elastic connector 124 and the second elastic connector 126.

In some examples, after the operator 104 completes a workout (e.g., a plurality of reps) using the bed exercise system 100, the reusable portion of the bed exercise system 100 can be decoupled from the disposable portion of the bed exercise system 100. For instance, in an example implementation, the third releasable fastener 192 can be actuated to decouple the main portion 125 of the first elastic connector 124 from the foot pad 120 (and the first end 164 of the first elastic connector 124). Similarly, the fourth releasable fastener 194 can be actuated to decouple the main portion 127 of the second elastic connector 126 from the foot pad 120 (and the first end 168 of the second elastic connector 126). As such, in this example, the disposable portion of the bed exercise system 100 can include the foot pad 120, the leg support member 122, the first end 164 of the first elastic connector 124, and/or the first end 168 of the second elastic connector 126. Whereas, the reusable portion of the bed exercise system 100 can include the main portion 125 and the first anchor 172 of the first elastic connector 124, and the main portion 127 and the second anchor 174 of the second elastic connector 126.

After the reusable portion of the bed exercise system 100 is decoupled from the disposable portion of the bed exercise system 100, the disposable portion can be discarded and the reusable portion can be coupled to another disposable portion (e.g., a new, unused disposable portion) including, for example, another foot pad 120 and another leg support member 122. For instance, the reusable portion can be coupled to another disposable portion by coupling (e.g., via the third releasable fastener 192 and the fourth releasable fastener 194) the main portion 125 of the first elastic connector 124 and the main portion 127 of the second elastic connector 126 to another first end 164 and another second end 166, respectively, assembled with the other foot pad 120 and the other leg support member 122 of the other disposable portion. Though the bed exercise system 100, and the components thereof, are intended for single use and then disposal, the bed exercise system 100 and any of the components thereof may be refurbished for reuse. Also, reusable portions can be made ready for use with another operator 104 as a partially or wholly refurbished system and/or a resold bed exercise system 100. This can help to reduce (or minimize) waste and/or improve storage efficiency of a plurality of bed exercise systems 100. Refurbishment of the device may include steps such as inspecting the device, removing foreign particles, stains, or odors by washing one or more surfaces of the device, repairing tears or damage to the device, repairing or supplementing the stitching, such as at the seams, replacing any elements or components, replacing missing items from a kit, etc. Refurbishing may include decontaminating the system and/or any of the components such as by sterilization means, such as the use of gamma radiation, electron-beam radiation, X-ray radiation, Ethylene oxide (EtO), steam, such as through the use of an autoclave, or any combination thereof. And, refurbishing may include repackaging the system and elements thereof.

As described above, the elastic connectors 124, 126 are configured to couple to the bed 102. In some examples, as described above, the elastic connectors 124, 126 can be coupled to the bed frame 106 by the first anchor 172 and the second anchor 174. In other examples, the elastic connectors 124, 126 can additionally or alternatively be configured to couple to the mattress 108. For instance, the main portion 125 of the first elastic connector 124 and the main portion 127 of the second elastic connector 126 can be configured to couple to a mattress anchor that can couple the bed exercise system 100 to the mattress 108. As beds 102 may have a wide variety of different forms and shape due to different manufacturers and/or models, the mattress anchor can help to make the bed exercise system 100 more universally compatible with equipment in healthcare systems.

Figure 7A:
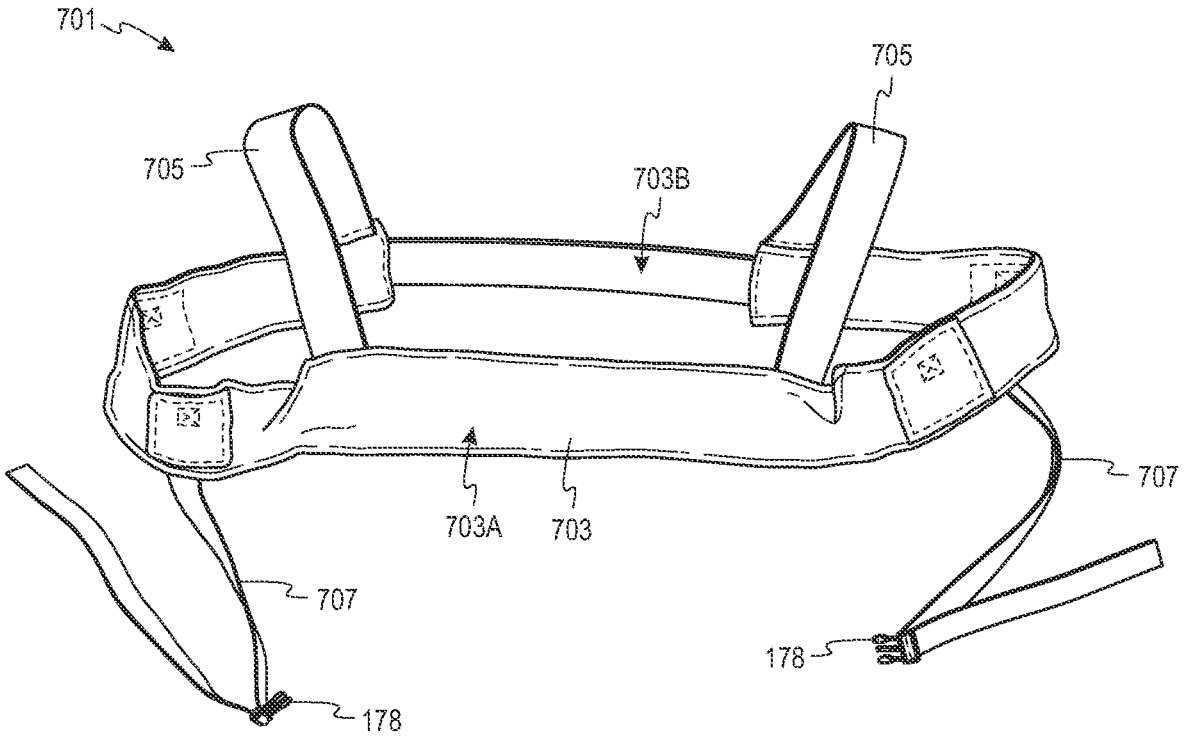
FIG. 7A illustrates a perspective view of a mattress anchor, according to an example.
Figure 7B:
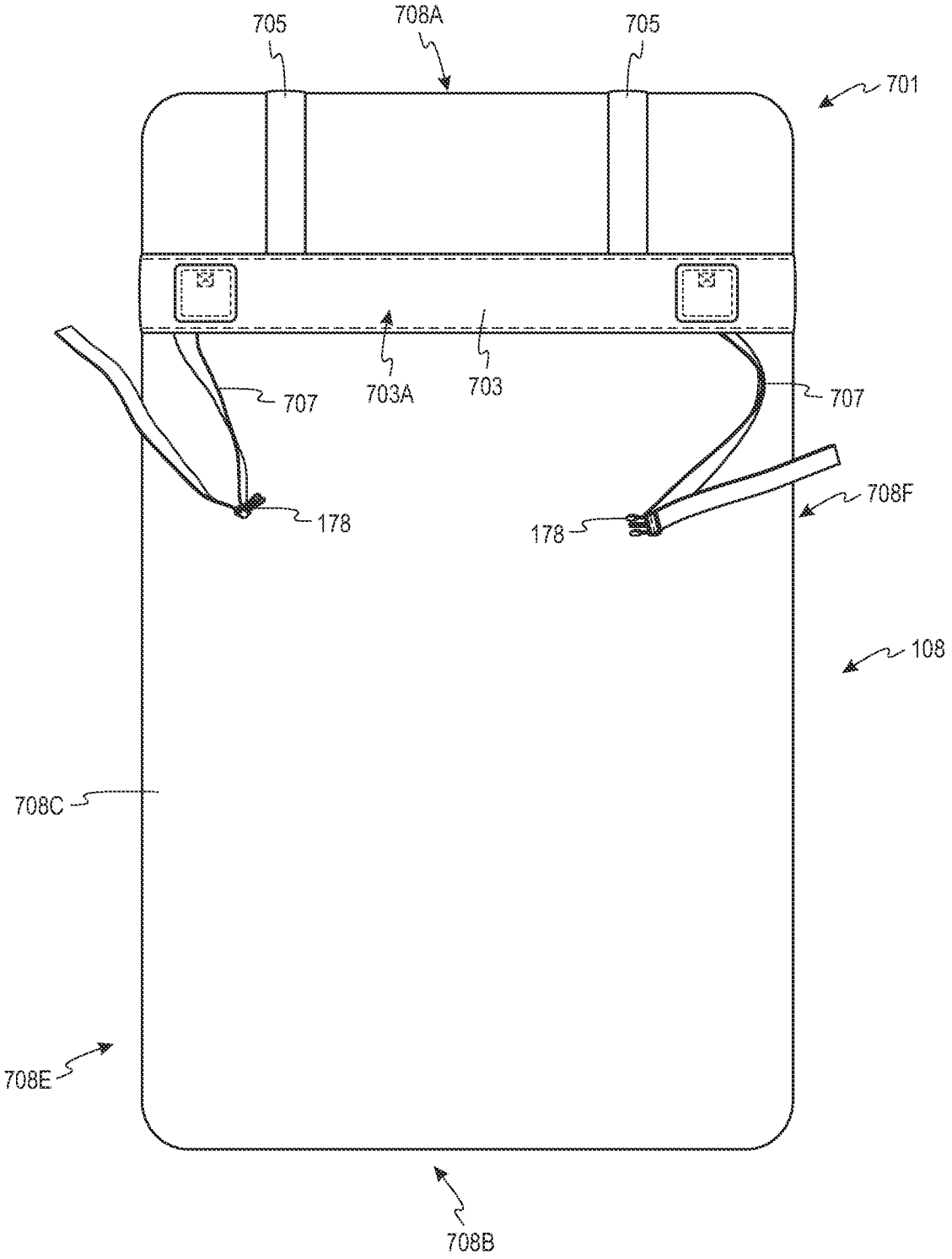
FIG. 7B illustrates an upper surface the mattress anchor of FIG. 7A coupled to a mattress, according to an example.
Figure 7C:
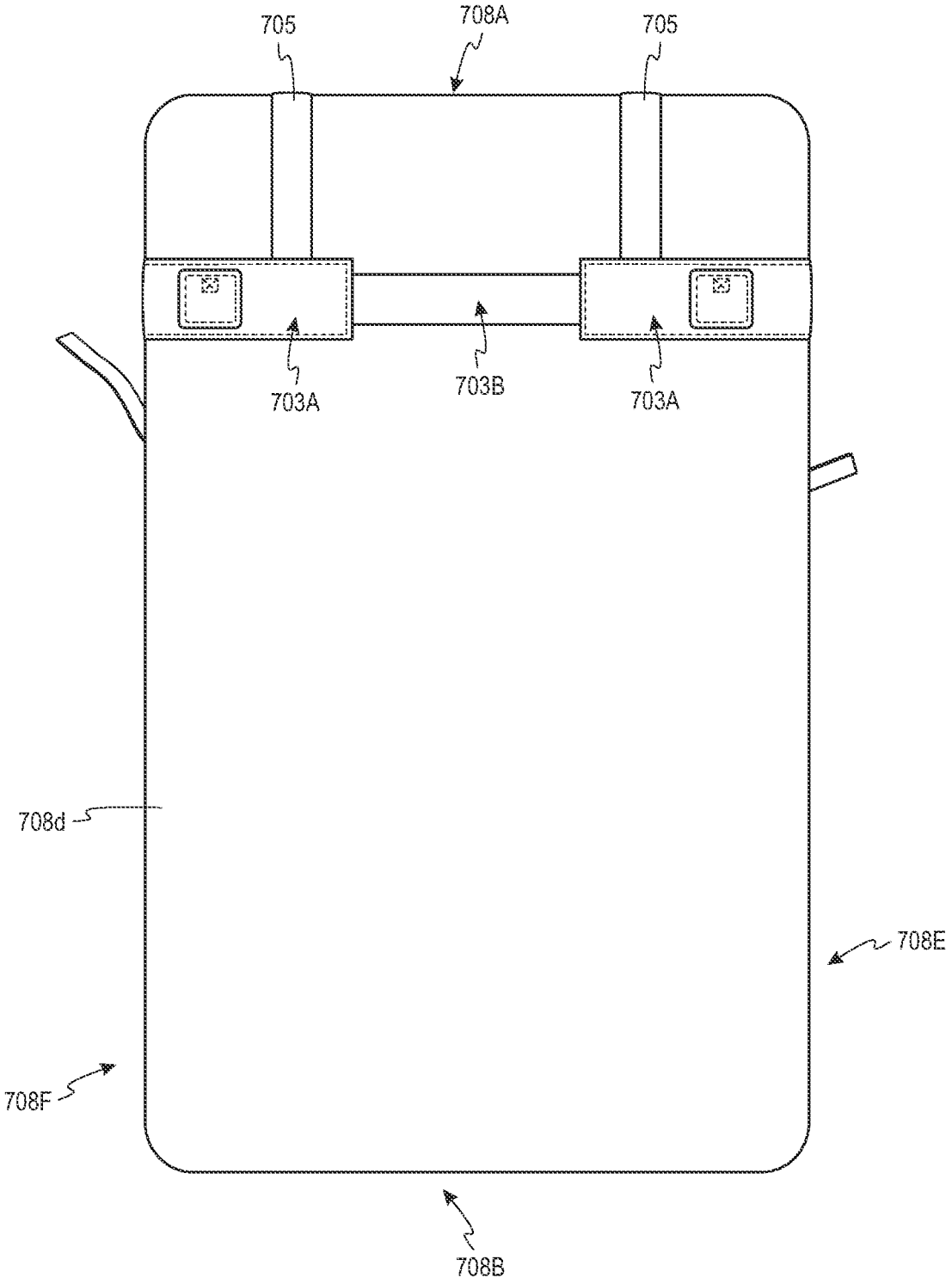
FIG. 7C illustrates a lower surface the mattress anchor of FIG. 7A coupled to the mattress, according to an example.

Referring now to FIGS. 7A-7C, a mattress anchor 701 is shown according to an example. In particular, FIG. 7A shows a perspective view of the mattress anchor 701 and FIGS. 7B-7C show the mattress anchor 701 coupled to the mattress 108.

In FIGS. 7B-7C, the mattress 108 includes a head end 708A, a foot end 708B, an upper surface 708C, a lower surface 708D opposite the upper surface 708C, a first lateral surface 708E, and a second lateral surface 708F. In this example, the head end 708A is configured to be located nearer to an operator's head and the foot end 708B is configured to be located nearer the operator's feet (e.g., the feet 116) when the operator is supported on the upper surface 708C of the mattress 108 and the mattress 108 is supported on a bed frame (e.g., the bed frame 106). In this arrangement, the mattress 108 has a length extending between the head end 708A and the foot end 708B, a width extending between the first lateral surface 708E and the second lateral surface 708F, a thickness extending between the upper surface 708C and the lower surface 708D, and a circumference extending around the upper surface 708C, the lower surface 708D, the first lateral surface 708E, and the second lateral surface 708F.

As shown in FIGS. 7A-7C, the mattress anchor 701 includes a mattress band 703, a plurality of end straps 705, and a plurality of connectors 707. The connectors 707 can be configured to couple to the main portions 125, 127 of the elastic connectors 124, 126 in a manner similar to that described above with respect to the anchors 172, 174. For instance, the connectors 707 can include a portion of the buckle 178 for coupling with the elastic connectors 124, 126, as shown in FIGS. 1A and 3. In other examples, the connectors 707 can be additionally or alternatively coupled to the elastic connectors 124, 126 by, for instance, one or more hooks, carabiner clips, gate clips, slots, and/or buttons.

In FIGS. 7A-7B, the mattress band 703 can be in the form of a loop that is configured to extend around the circumference (e.g., the width and the thickness) of the mattress 108. In some examples, the mattress band 703 can include an elastic material such that the mattress band 703 can have a circumferential size that can be adjusted to extend around mattresses having a plurality of different circumference sizes. As different mattresses may have different circumferential sizes, the elasticity of the mattress band 703 can help to more universally couple the bed exercise system 100 with a wide variety of mattresses types. However, the mattress band 703 can be entirely inelastic in other examples.

The end straps 705 can each extend from a first point on the mattress band 703 to a second point on the mattress band 703 such that the end straps 705 can engage the head end 708A of the mattress 108 when the mattress anchor 701 is coupled to the mattress 108. In particular, the end straps 705 can be configured such that the end straps 705 extend from a first portion of the mattress band 703 engaging the upper surface 708C of the mattress 108 to a second portion of the mattress band 703 engaging the lower surface 708D. In this arrangement, the end straps 705 can be configured to provide a stop against distal movement of the mattress anchor 701 and, thus, the proximal end (e.g., the proximal end 162) of the bed exercise system 100.

In FIGS. 7A-7C, the mattress band 703 includes an inelastic section 703A and an elastic section 703B. The elastic section 703B is configured to have an adjustable size, whereas the inelastic section 703A is configured to have a fixed, static size. In the example shown in FIGS. 7A-7C, the end straps 705 each extend between a first point on the inelastic section 703A and a second point on the inelastic section 703A. This can beneficially help to reduce stretching of the mattress anchor 701 in the distal direction while the operator is operating the foot pad 120 (which, in turn, applies a distally directed force on the mattress anchor 701 via the elastic connectors 124, 126).

In FIGS. 7A-7C, the mattress band 703 includes a single elastic section 703B that extends between opposing ends of the inelastic section 703A. However, in another example, the mattress band 703 can include a first elastic section 703B that is configured to be located on the lower surface 708D of the mattress 108 and a second elastic section 703B that is configured to be located on the upper surface 708C of the mattress 108.

Additionally, the mattress anchor 701 includes two end straps 705 in FIGS. 7A-7C. This can help to mitigate the mattress anchor 701 stretching by providing support against distal movement on both lateral sides of the head end 708A (e.g., near the first lateral surface 708E and the second lateral surface 708F of the mattress 108). However, in other examples, the mattress anchor 701 can include a lesser or a greater quantity of end straps 705.

In use, the mattress anchor 701 can be coupled to the mattress 108 by first positioning the mattress band 703 adjacent to the head end 708A of the mattress 108. Next, the mattress band 773A can be moved proximally over the head end 708A of the mattress 108 such that (i) the mattress band 703 extends around the circumference of the mattress 108 and (ii) the end straps 705 extends from the upper surface 708C of the mattress 108 to the lower surface 708D of the mattress 108. In some examples, moving the mattress band 703 over the head end 708A of the mattress 108 can include stretching, via the elastic section 703B, the mattress band 703 to increase the circumference of the mattress band 703 to be approximately the same size as the circumference of the mattress 108. As a result, the mattress band 703 can apply a compressive force to the mattress 108 can assist in resisting movement of the mattress band 703 relative to the mattress 108 when the mattress band 703 is coupled to the mattress 108. Also, in examples, the mattress band 703 can continue to move distally relative to the mattress 108 until the end straps 705 engage the head end 708A of the mattress 108 to limit further distal movement.

In one implementation of the method, the connectors 707 can be coupled to the first elastic connector 124 and the second elastic connector 126 after coupling the mattress anchor 701 to the mattress 108. In another implementation of the method, the connectors 707 can be coupled to the first elastic connector 124 and the second elastic connector 126 prior to coupling the mattress anchor 701 to the mattress 108.

Figure 8A:
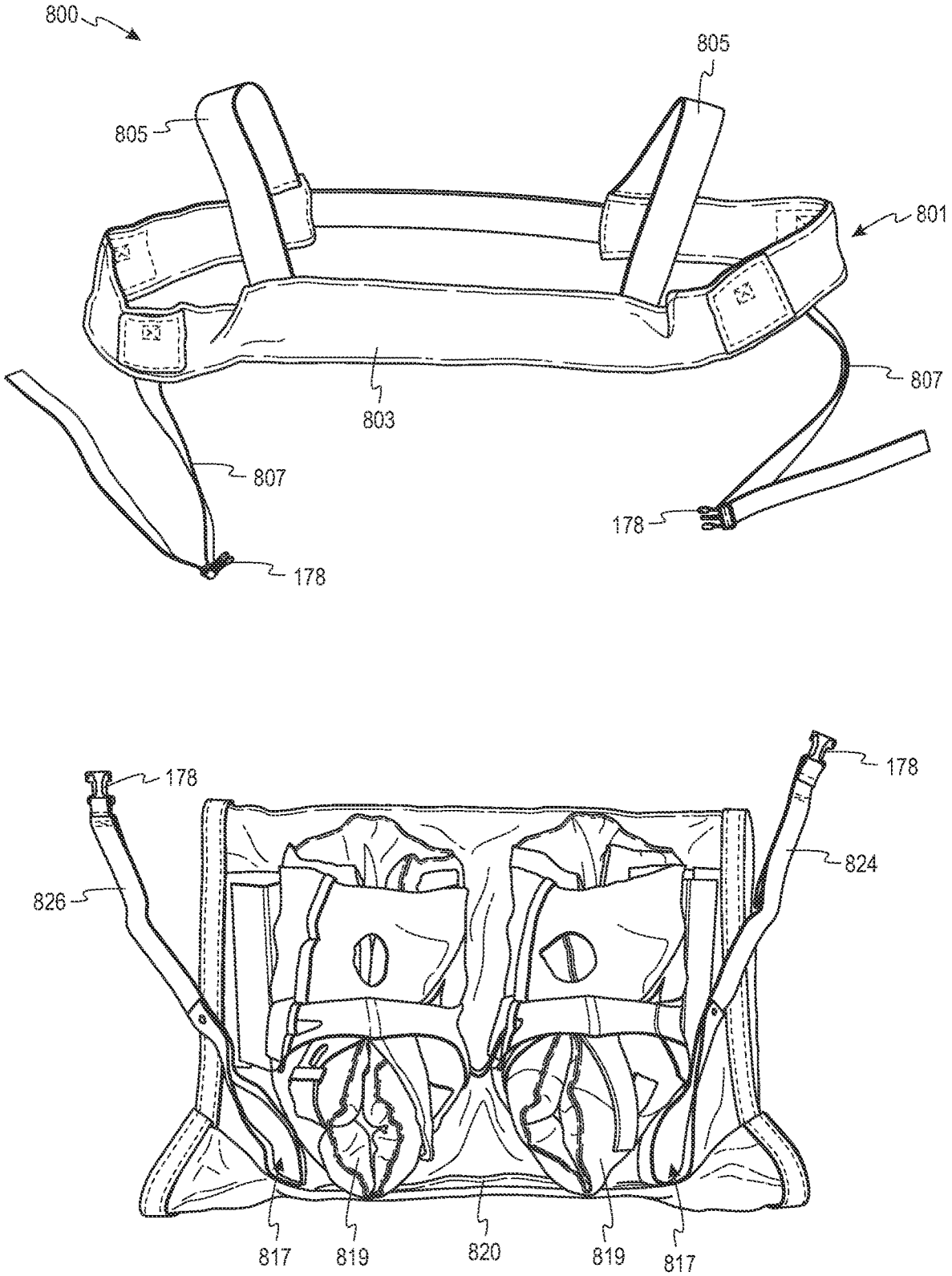
FIG. 8A illustrates a bed exercise system in a partially disassembled state, according to an example.

Referring now to FIGS. 8A-11B, a bed exercise system 800 is shown according to another example. FIG. 8A shows the bed exercise system 800 in a partially disassembled state. FIG. 8B shows the bed exercise system 800 in assembled state in which the bed exercise system 800 is coupled to a mattress 108 of a bed 102 at a proximal end of the bed exercise system 800 and coupled to the feet of an operator at a distal end of the bed exercise system 800.

Figure 8B:
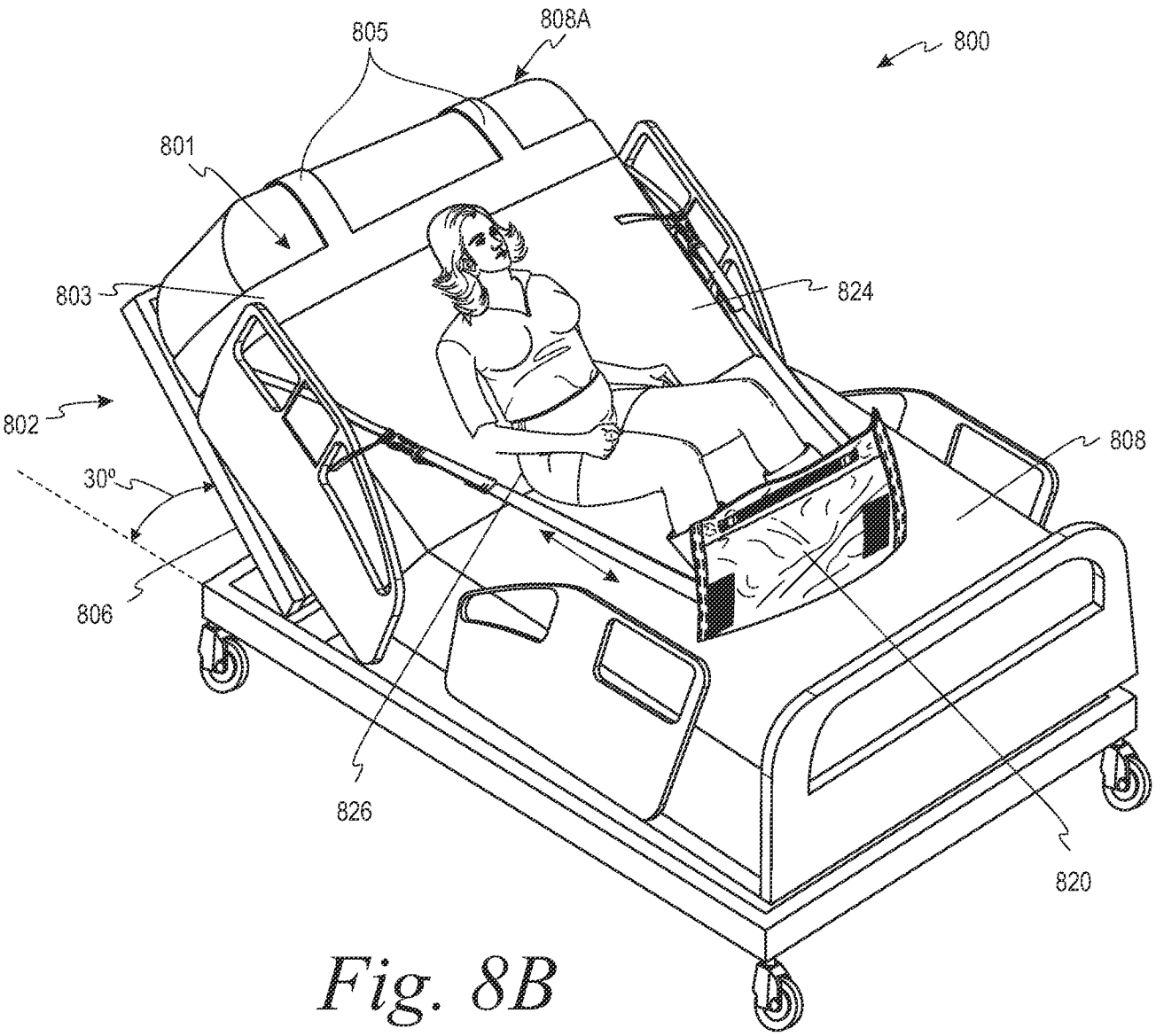
FIG. 8B illustrates the bed exercise system of FIG. 8A coupled to a bed and an operator, according to an example.

As shown in FIGS. 8A-8B, the bed exercise system 800 includes a mattress anchor 801, a foot pad 820, a first elastic connector 824, and a second elastic connector 826. The mattress anchor 801 can be substantially similar or identical to the mattress anchor 701 described above with respect to FIGS. 7A-7C. As such, the mattress anchor 801 can include a mattress band 803, one or more end straps 805, and a plurality of connectors 807 as described above. In FIG. 8B, the mattress anchor 801 is coupled to a head end 808A of a mattress 808 as described above with respect to FIGS. 7A-7C.

The first elastic connector 824 and the second elastic connector 826 couple the mattress anchor 801 to the foot pad 820. In some examples, the first elastic connector 824 and the second elastic connector 826 can be configured as shown in FIGS. 1A-6; however, FIG. 9 shows another example configuration for the first elastic connector 824 and the second elastic connector 826.

Figure 9:
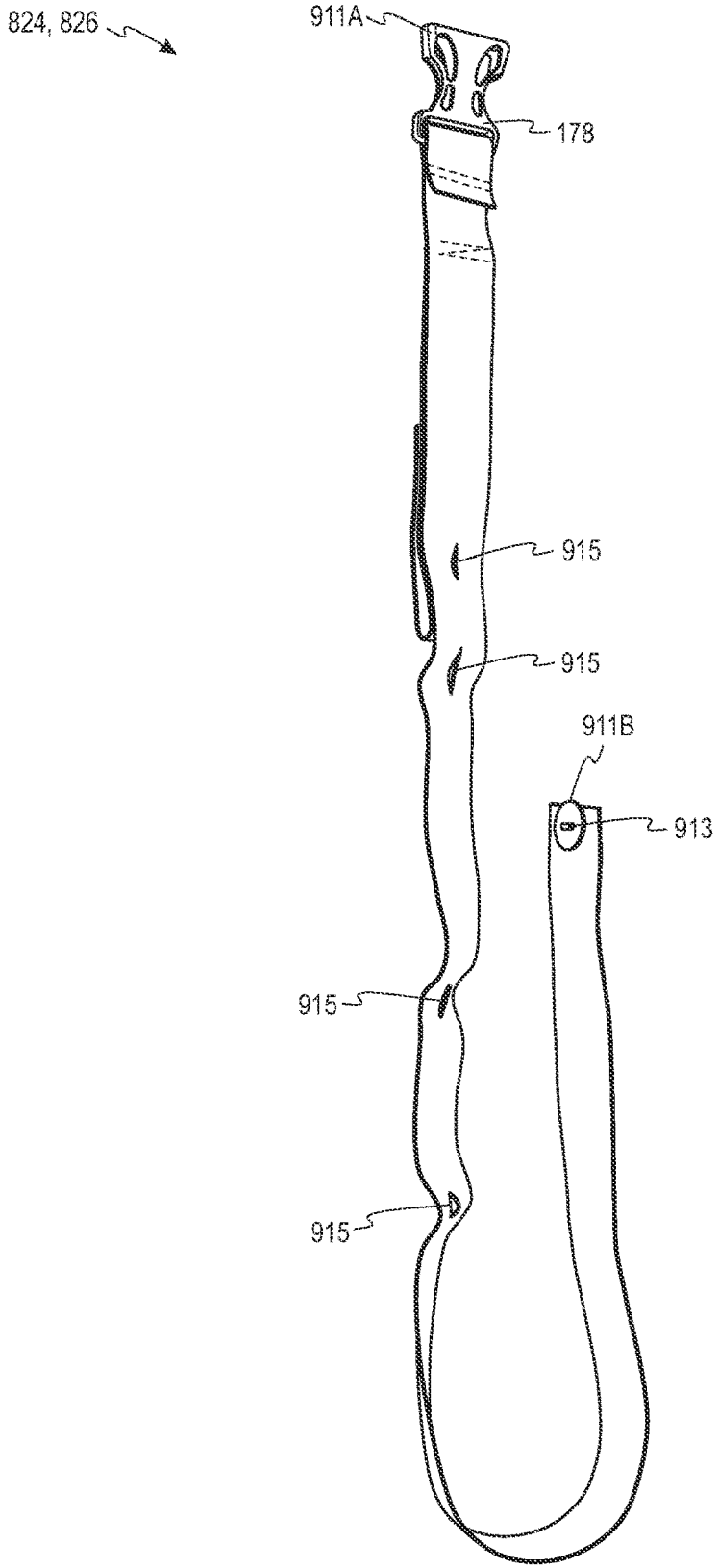
FIG. 9 illustrates an elastic connector of the bed exercise system of FIGS. 8A-8B, according to an example.

As shown in FIG. 9, the first and second elastic connectors 824, 826 can be elongated strips formed of a resilient material extending between a first end 911A and a second end 911B. The first end 911A of the first and second elastic connectors 824, 826 is configured for detachably coupling to the connectors 807 of the mattress anchor 801. For example, the first end 911A can include a portion of a buckle (e.g., the buckle 178) for coupling with a corresponding portion of the buckle on the connectors 807 of the mattress anchor 801. However, as discussed above, other structures can be used for detachably coupling the first and second elastic connectors 824, 826 to the connectors 807 of the mattress anchor 801.

The second end 911B of the first and second elastic connectors 824, 826 are configured to couple to the foot pad 820. For example, the second end 911B can include a button 913 that is configured to couple to an aperture 915, which is sized to receive the button 913, on the first and second elastic connectors 824, 826. In operation, the second end 911B of the first and second elastic connectors 824, 826 is passed through a retention loop 817 (shown in FIGS. 8A and 10A-10B) of the foot pad 230. With the first and second elastic connectors 824, 826 extending through the retention loop 817 on the foot pad 820, the button 913 is coupled to one of the apertures 915 to detachably couple the elastic connectors 824, 826 to the foot pad 230 as shown in FIG. 8A.

In FIG. 9, the first and second elastic connectors 824, 826 can each include a plurality of the apertures 915 such that a length of the first and second elastic connectors 824 can be adjusted by coupling the button 913 to one aperture 915 selected from among the plurality of apertures 915. As noted above, adjusting the length of the first and second elastic connectors 824, 826 can help to accommodate a plurality of operators having differently sized legs and/or to adjust the tension on the first elastic connector 824 and the second elastic connector 826. This may beneficially provide for adjusting the level of resistance of the bed exercise system 800 to accommodate various operators having different muscle strengths and/or levels of fitness.

In other examples, the first and second elastic connectors 824, 826 can have a fixed, non-adjustable length. For instance, the first and second elastic connectors 824, 826 can have a single aperture 915 as opposed to the plurality of apertures 915, as shown in FIG. 9. Additionally, although the first and second elastic connectors 824, 826 are coupled to the foot pad 820 by the button 913, the aperture 915, and the retention loop 817, the first and second elastic connectors 824, 826 can be coupled to the foot pad 230 and/or made adjustable by one or more additional or alternative coupling mechanisms (e.g., one or more snap fasteners, hook-and-loop fasteners, clips, and/or clasps).

As shown in FIGS. 8A, 8B, 10D, 12A, and 12B, the foot pad 820 is configured to couple with a pair of boots 819 worn on the feet of the operator. As an example, the boots 819 can be heel protector boots. Heel protector boots are configured to support the heels of the operator above the mattress 808 to help mitigate injuries to the feet such as, for example, foot drop and/or pressure ulcers. For instance, the heel protector boots can be configured to maintain the feet in a neutral position to protect a peroneal nerve. Example features of the heel protector boots are further described below with respect to FIG. 11.

In the illustrated example, the foot pad 820 can omit a rigid support member (e.g., the rigid support member 142) as the boots 819 can have sufficient bulk to support the feet of the operator against the foot pad 820. However, as described below with respect to FIGS. 13A-16, a foot pad for use with the boots 819 can include the rigid support member in other examples (e.g., in an example in which the bed exercise system 100, 800 is configured to be used with the boots 811 and without the boots 811).

Also, in the example shown in FIGS. 8A-8B, the foot pad 820 can omit the cushion member 144 described above. For instance, the boots 811 can include sufficient cushioning to enhance patient comfort. Also, in an implementation in which the foot pad 820 omits the rigid support member, the foot pad 820 can be sufficiently comfortable without the padding provided by the cushion member 144. Omitting the rigid support member 142 and the cushion member 144 can beneficially help to reduce a size of the bed exercise system 800 when in storage prior to or after use.

Figure 10A:
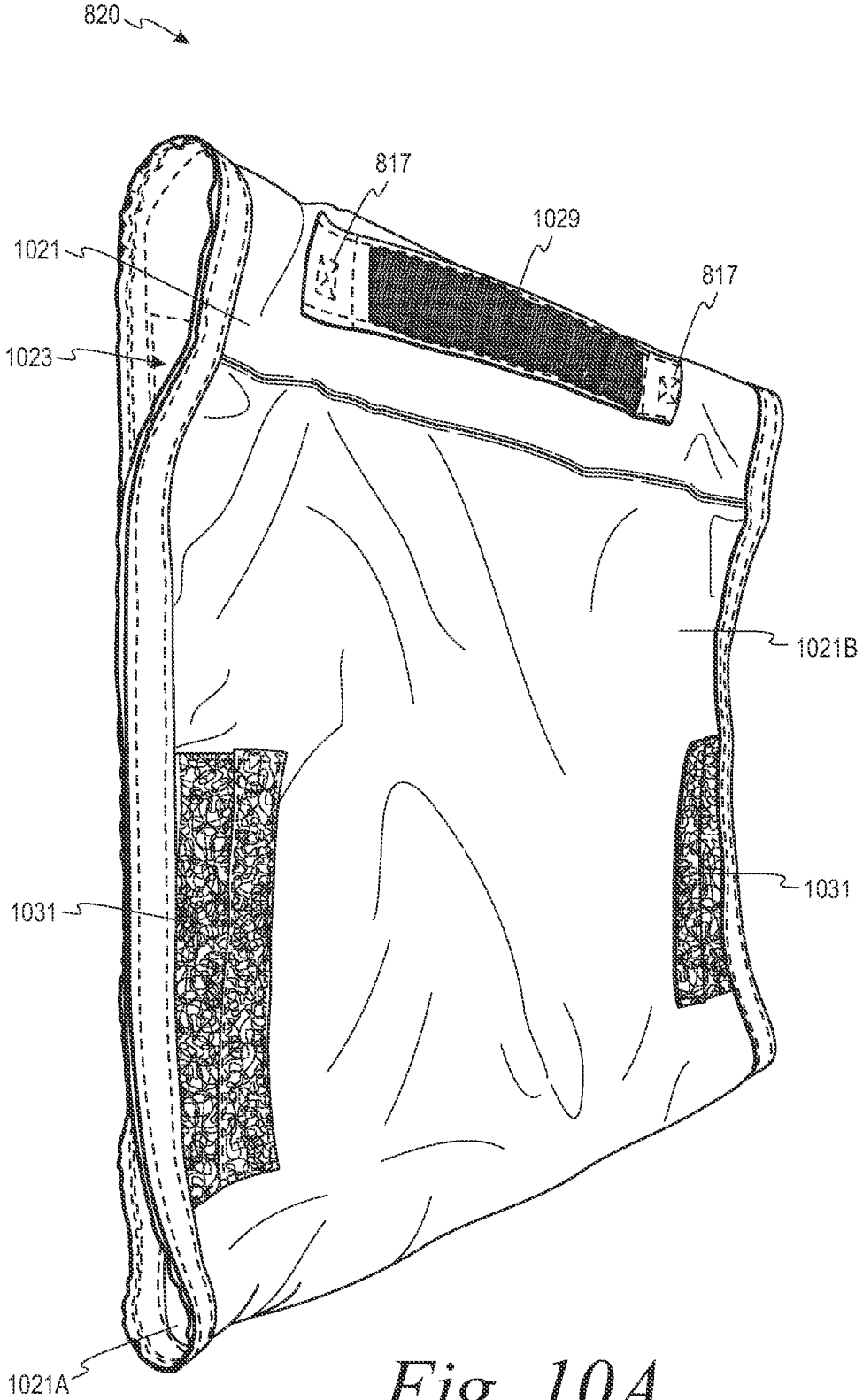
FIG. 10A illustrates a perspective view of a foot pad of the bed exercise system of FIGS. 8A-8B, according to an example.
Figure 10B:
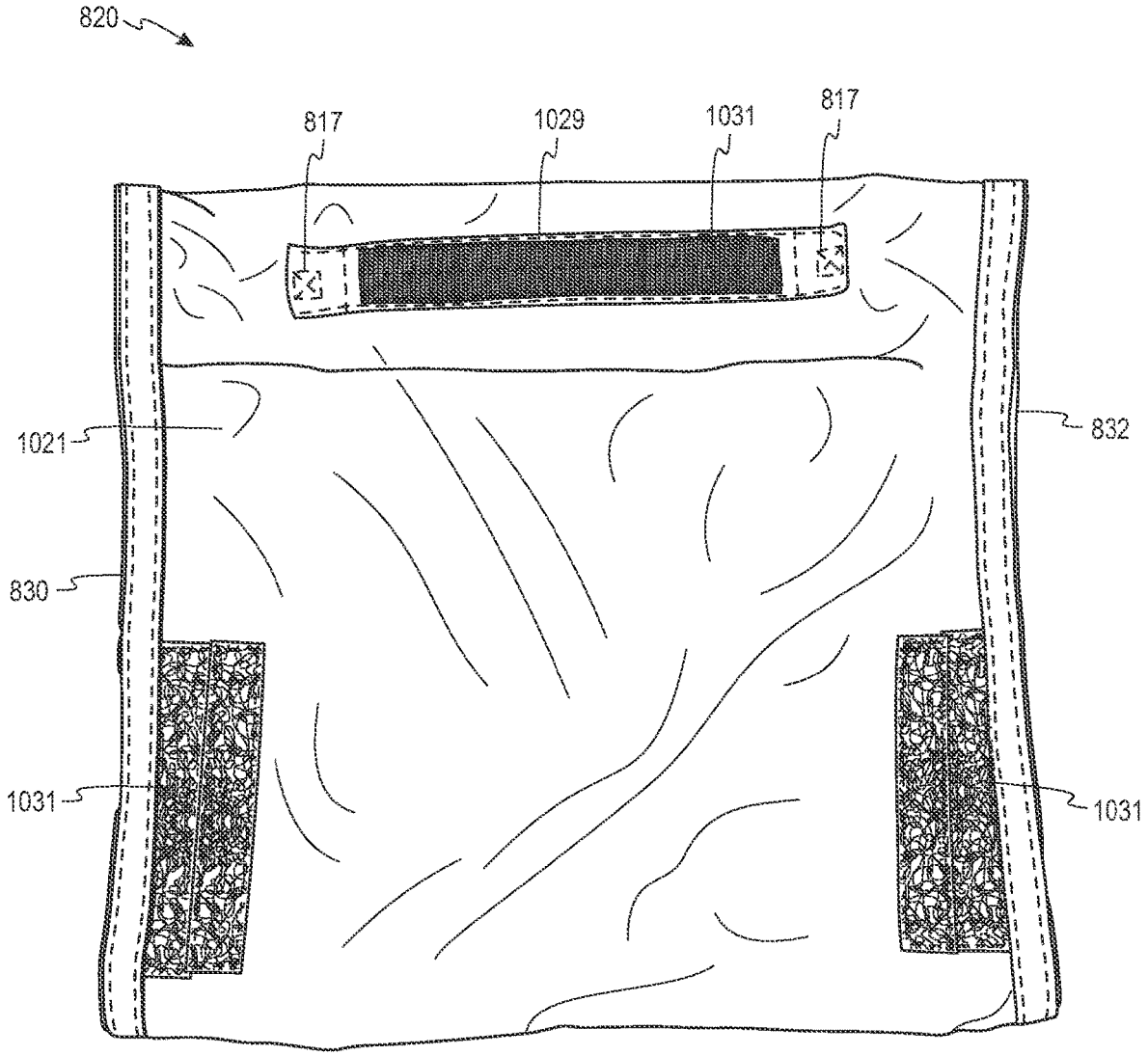
FIG. 10B illustrates a top view of a foot pad of the bed exercise system of FIGS. 8A-8B, according to an example.
Figure 10C:
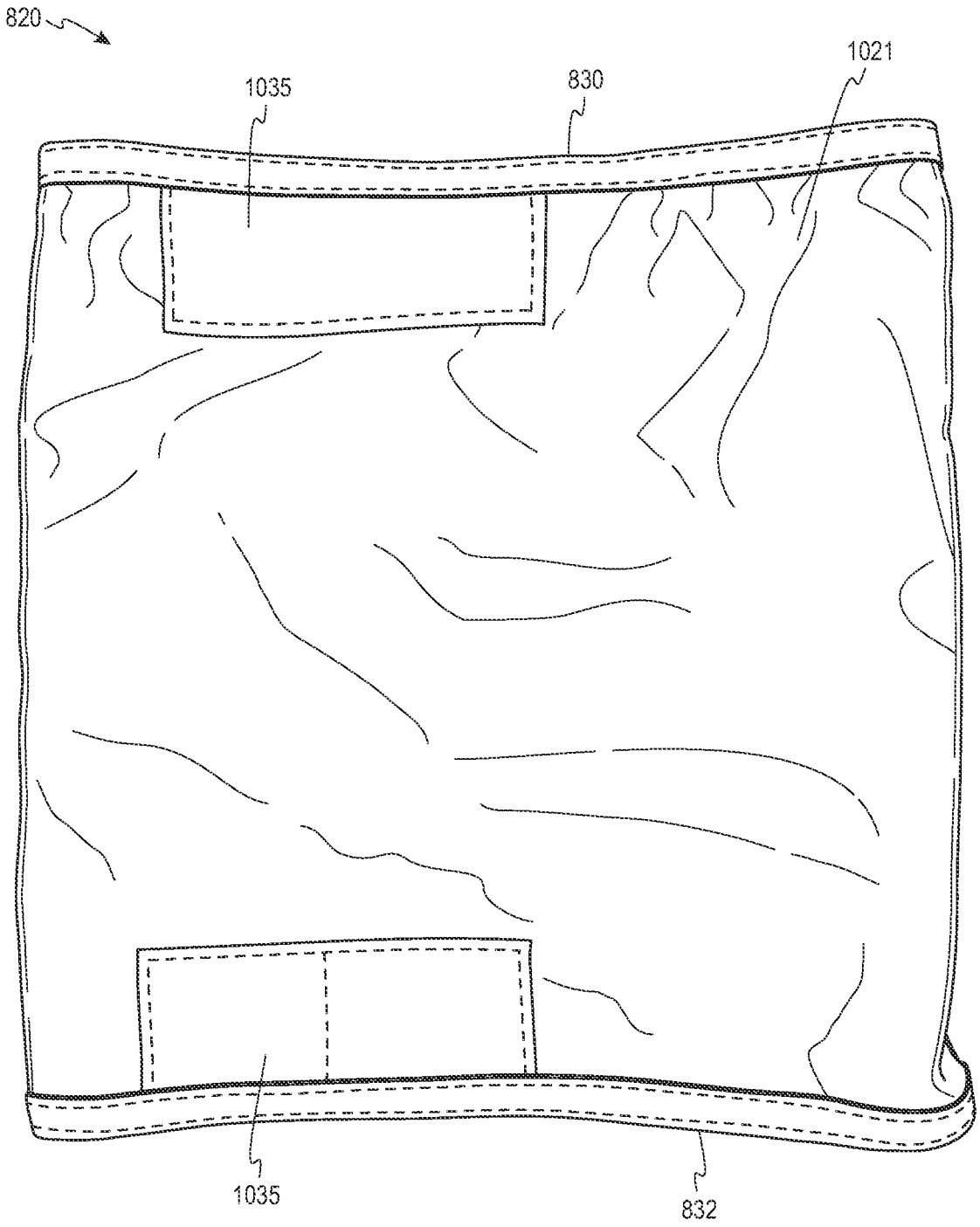
FIG. 10C illustrates a bottom view of a foot pad of the bed exercise system of FIGS. 8A-8B, according to an example.

FIGS. 10A-10D show the foot pad 820 of FIG. 8A according to an example. In particular, FIG. 10A shows a perspective view of the foot pad 820, FIG. 10B shows a plan view of a top of the foot pad 820, and FIG. 10C shows a plan view of a bottom of the foot pad 820, according to an example. In general, the bottom of the foot pad 820 is configured to engage an upper surface of the mattress 808 and the top of the foot pad 820 is configured couple with the boots 819, as described below, and the first and second elastic connectors 824, 826, as described above.

As shown in FIGS. 10A-10D, the foot pad 820 is in the form of a tube 1021. In the form of the tube 1021, the foot pad 820 have an interior surface 1021A that defines a bore 1023 through the foot pad 820, and an exterior surface 1021B opposite the interior surface 1021A. The tube 1021 is formed of a flexible material. As an example, the flexible material of the tube 1021 can include a material having a coefficient of friction between approximately 0.20 and 0.25. For instance, the flexible material can be denier nylon of approximately 70D or lower, a polyester, and/or a tight-weave cotton. More generally, the tube 1021 can be formed of a material having a flexibility that allows the tube 1021 to collapse on itself such that the interior surface 1021A is folded over on itself. As described in further detail below, this can provide for a first portion of the interior surface 1021A sliding over and in engagement with a second portion of the interior surface 1021A when the operator moves the foot pad 820 in the proximal direction and the distal direction relative to the mattress anchor 801 coupled to the mattress 808.

As shown in FIG. 10B, the top of the foot pad 820 can include a strip 1029 of material extending in a direction parallel to a width of the foot pad 820 (e.g., parallel to a direction between a first lateral side 830 and a second lateral side 832 of the foot pad 820). As shown in FIG. 10B, the retention loops 817 for coupling to the first and second elastic connectors 824, 826 can be located at opposing ends of the strip 1029. In this arrangement, a force applied to the foot pad 820 by the first and second elastic connectors 1024, 1026 (e.g., during a rep) is also applied to the strip 1029. The strip 1029 can thus help to distribute the force over a greater surface area of the foot pad 1020 (than if the strip 1029 was omitted).

In FIG. 10B, the strip 1029 is positioned on the foot pad 1020 such that the first and second elastic connectors 824, 826 couple to the foot pad 820 closer to balls of the operator's feet than the heel or the toes of the operator's feet when the boots 819 are coupled to the foot pad 820. This can help to support the operator's feet in a position that assists in pointing the operator's toes upward, which may beneficially improve the operator's form during operation of the bed exercise system 800.

As shown in FIGS. 10A-10B, the foot pad 820 can also include a plurality of boot-connector sections 1031 positioned on the exterior surface 1021B and top of the tube 1021. As shown in FIG. 11, the boots 819 can include a footpad-connector section 1133 on a bottom of the boots 819 that is configured to releasably couple to the boot-connector sections 1031 of the foot pad 820. In FIGS. 10A-12B, the boot-connector sections 1031 can include hook-and-loop fastener sections that can detachably couple to corresponding hook-and-loop fasteners sections of the footpad-connector sections 1133 on the bottom of the boots 819 to detachably secure the boots 819 to the foot pad 820.

In FIGS. 10A-10B, the boot-connector sections 1031 can include a first section located adjacent to the first lateral side 830, a second section located adjacent to the second lateral side 832, and/or a third section located at the strip 1029. This can help to couple each boot 819 to the foot pad 820 at a plurality of points of contact and, thus, more securely couple the boots 819 to the foot pad 820. However, the boot-connector sections 1031 can include a lesser or a greater quantity of sections in other examples.

As shown in FIG. 10C, the bottom of the foot pad 820 can include one or more high friction portions 1035 configured to inhibit the foot pad 820 from sliding on the upper surface of the mattress 808. The one or more high friction portions 1035 are formed of a material that resists sliding along the surface of the mattress 808. As an example, the one or more high friction portions 1035 can be a material having a coefficient of friction that is greater than 1.0. For instance, the material of the high friction portions 1035 can be a urethane-coated nylon and/or polyester coated with an adhesive. Additionally, within examples, the high friction portions 1035 of the exterior surface 1021B of the tube 1021 can have a first coefficient of friction, the interior surface 1021A of the tube 1021 can have a second coefficient of friction, and the first coefficient of friction can be greater than the second coefficient of friction Although the exterior surface 1021B of the tube 1021 includes high friction portions 1035 in FIG. 10C, an entirety of the exterior surface 1021B can be made from a high friction material in another example. Additionally, although the tube 1021 includes two high friction portions 1035 in FIG. 10C, the tube 1021 can include a lesser quantity or a greater quantity of high friction portions 1035 in other examples.

In FIG. 10C, the high friction portions 1035 are located adjacent to the first lateral side 830 and the second lateral side 832. This can help to stabilize the foot pad 820 during operation of the bed exercise system 800. However, the high friction portions 1035 can be provided in additional or alternative locations on the exterior surface 1021B of the tube 1021 in other examples.

As noted above, the foot pad 820 is in the form of the tube 1021. With the one or more high friction portions 1035 resisting sliding of the foot pad 820 relative to the mattress 808, the interior surface 1021A slides over itself as the foot pad 820 is moved relative to the mattress 808. To facilitate the foot pad 820 moving relative to the mattress 808 while the high friction portions 1035 resist movement, the interior surface 1021A can be formed from a material having a relatively low coefficient of friction. As examples, the interior surface 1021A can include at least one material selected from a group of materials including Nylon, polyester, or tight weave cotton.

Figure 12A:
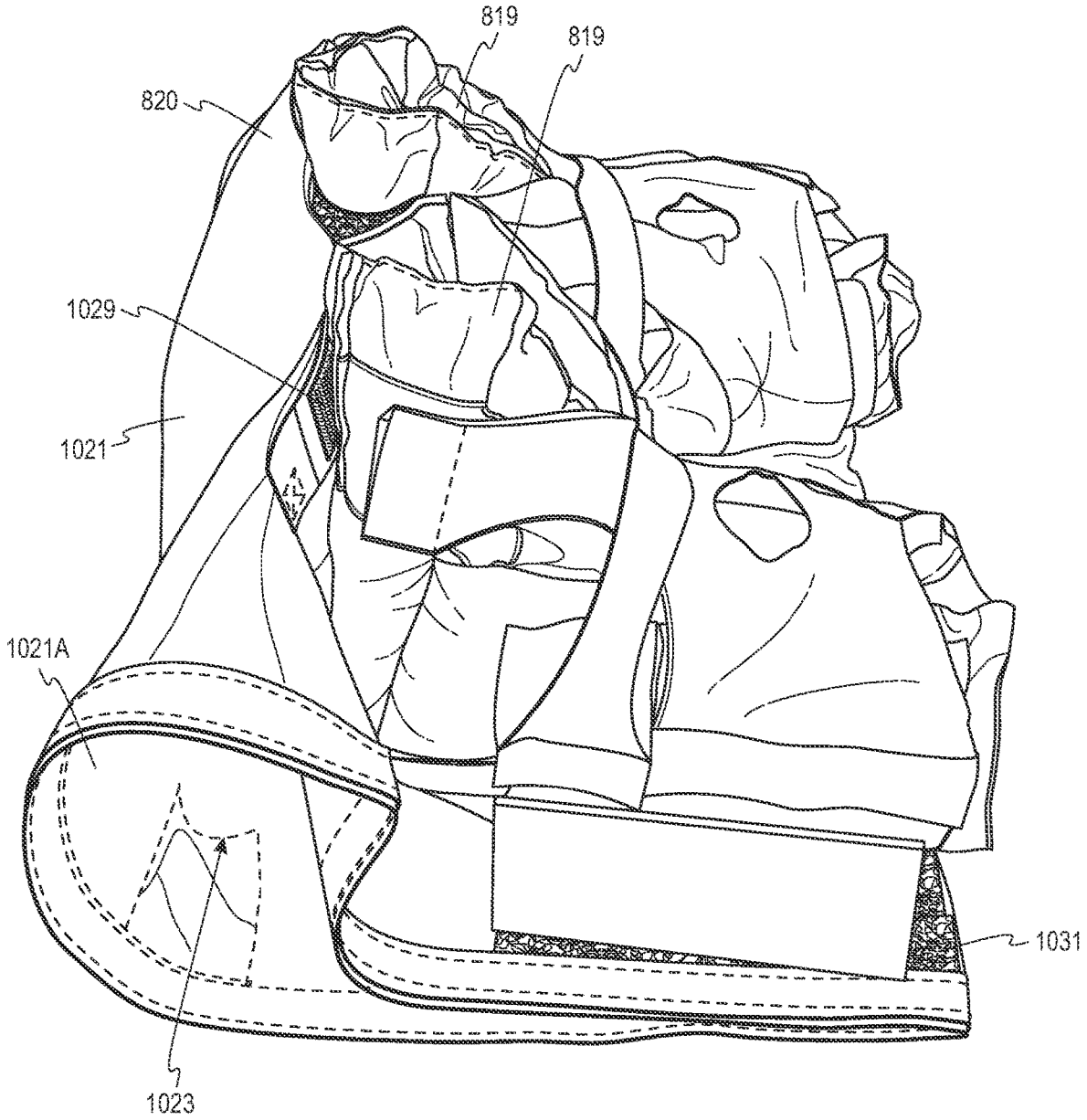
FIG. 12A illustrates the heel protectors and foot pad of FIGS. 10A-11 in a first position, according to an example.
Figure 12B:
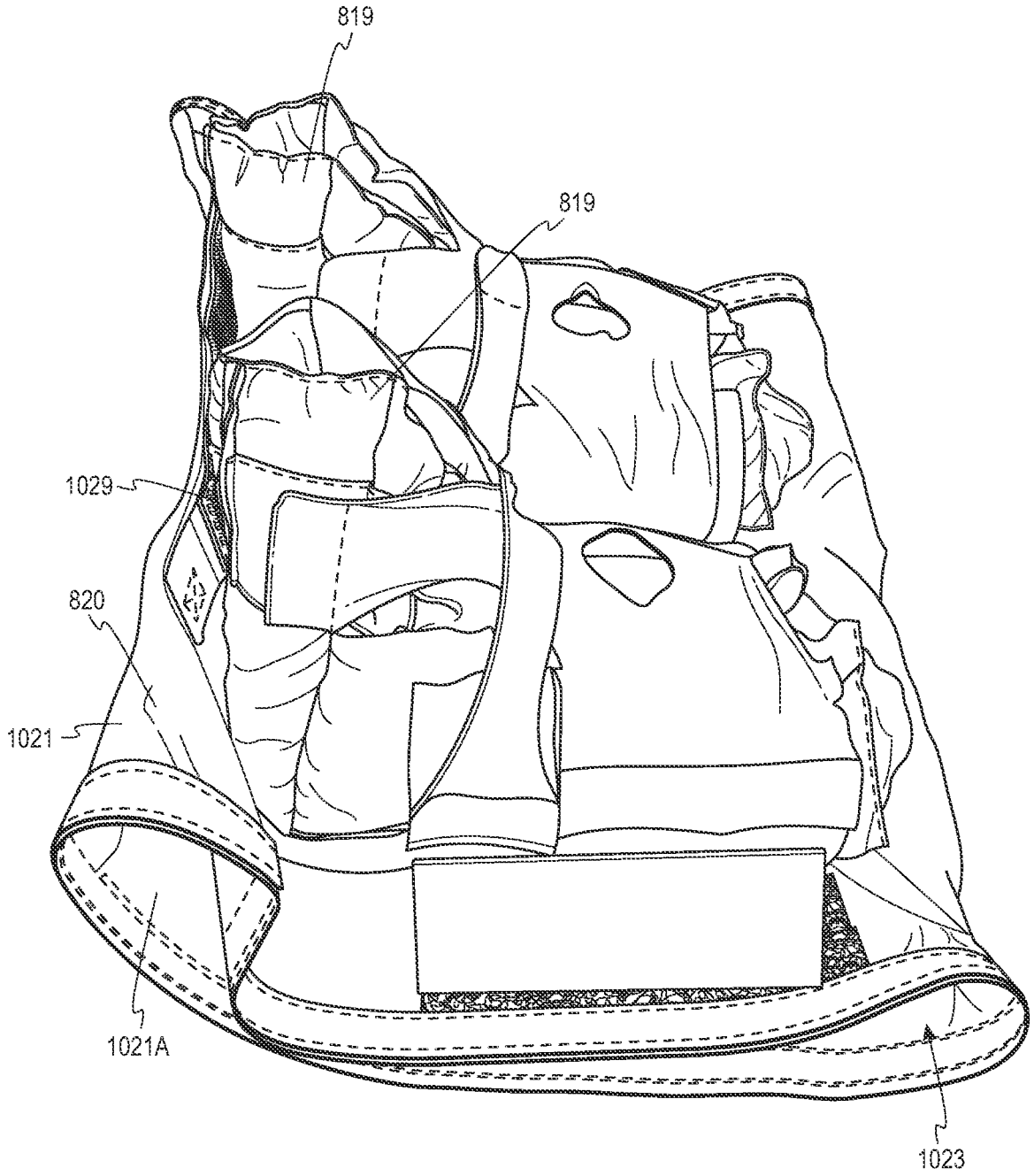
FIG. 12B illustrates the heel protectors and foot pad of FIGS. 10A-11 in a second position, according to an example.

In operation, the foot pad 820 is placed on the mattress 808 with the high friction portions 1035 on the bottom of the foot pad 820 so as to contact the upper surface of the mattress 808. The foot pad 820 is oriented such that the strip 1029 extends in a direction substantially perpendicular to the length of the bed 802. The boot-connector sections 1031 of the foot pad 820 are detachably coupled to the footpad-connector sections 1133 of the boots 819 such that the strip 1029 is positioned approximately level with the balls of the operator's feet, as shown in FIGS. 12A-12B. Positioning the strip 1029 along the balls of the operator's feet aid in maintaining correct foot positioning with the toes pointed upwards.

Figure 10D:
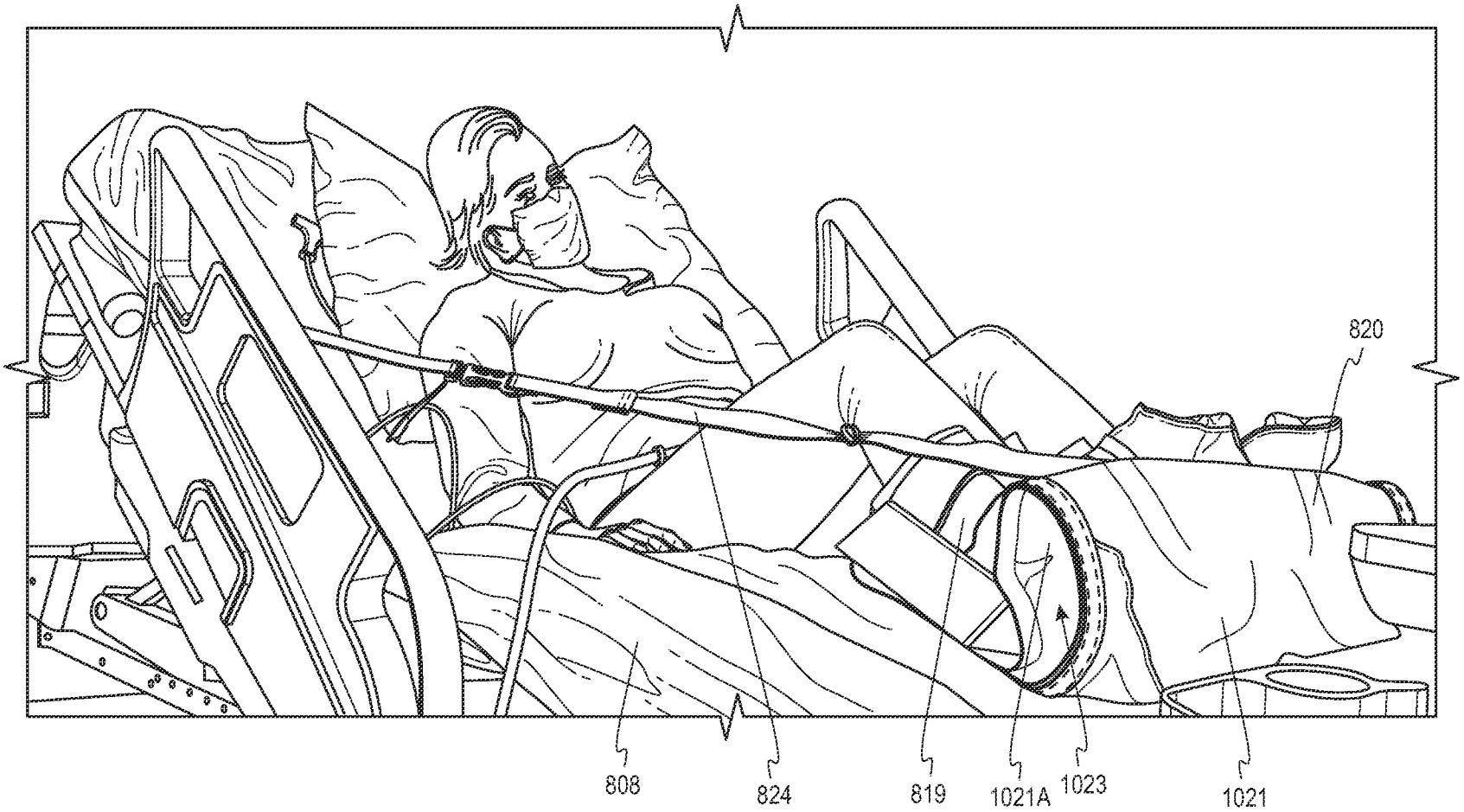
FIG. 10D illustrates a perspective view of a foot pad in use in a bed exercise system of 8A-8B, according to an example.
Figure 11:
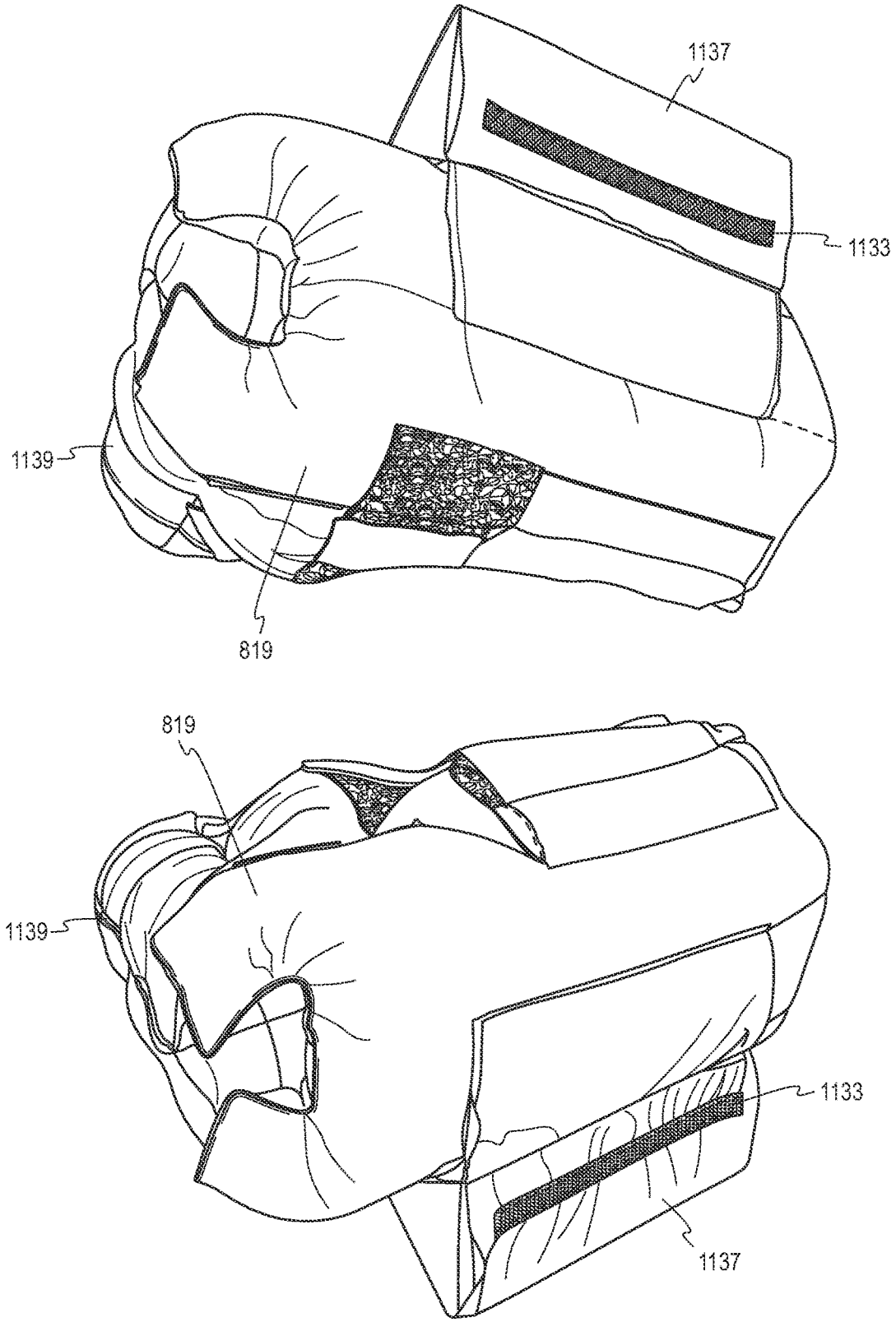
FIG. 11 illustrates a bottom perspective view of a pair of heel protectors of the bed exercise system of FIGS. 8A-8B, according to an example.

FIG. 10D shows the foot pad 820 in operation. As shown, the foot pad 820 is connected to the boots 819 proximate the balls of the operator's feet. The foot pad 820 is in a retracted position with the tube 1021 having loose or slack material located distal from the operator's feet.

The boots 819 are further shown in FIGS. 11-12B. As shown in FIGS. 11-12B, the boots 819 can be padded structures that cover the operator's feet and ankles. The boots 819 can include wedges 1137 increasing the size of the bottom surface thereof. As noted above, the boots 819 are substantially similar to heel protectors worn by individual to reduce the risk of pressure injuries forming on the heels during extended bed rest. However, the boots 819 can also include the footpad-connector sections 1133 on the bottom surface (such as, for example, on the wedges 1137) thereof configured to detachably couple the boots 819 to the foot pad 820.

To operate the bed exercise system 800, the operator begins with the foot pad 820 in a first, retracted position, as shown in FIGS. 10D and 12A. In the first, retracted position, the top side of the tube 1021 is slid towards to head end of the bed 802 such that there is slack material on the distal end of the tube 1021. As the operator extends their legs, the interior surface 1021A of the tube 1021 slides along itself, such that the top side of the tube 1021 rolls towards the foot end of the bed 802 while the bottom side is held in place by the high friction portions 1035. This movement causes the first and second elastic connectors 824, 826 to be resiliently extended as described above, increasing the tension in the first and second elastic connectors 824, 826 so as to provide a resisting force to the user.

When the legs are in the second, extended position, as shown in FIG. 12B, the tube 1021 includes the slack material on the proximal end of the tube 1021. This slack material enables the user to bend their legs, moving the foot pad 820 back to the first, retracted position. This process can be repeated to perform a plurality of reps, as described above.

As shown in FIG. 8B, the bed exercise system 800 is usable in an adjustable bed 802. In one example, the above described exercise is performed with the bed 802 positioned with the top half of the bed 802 angled upward by an angle of 15 degrees to 45 degrees relative to a bottom half of the bed 802. In another example, the angle is approximately 30 degrees.

Figure 13A:
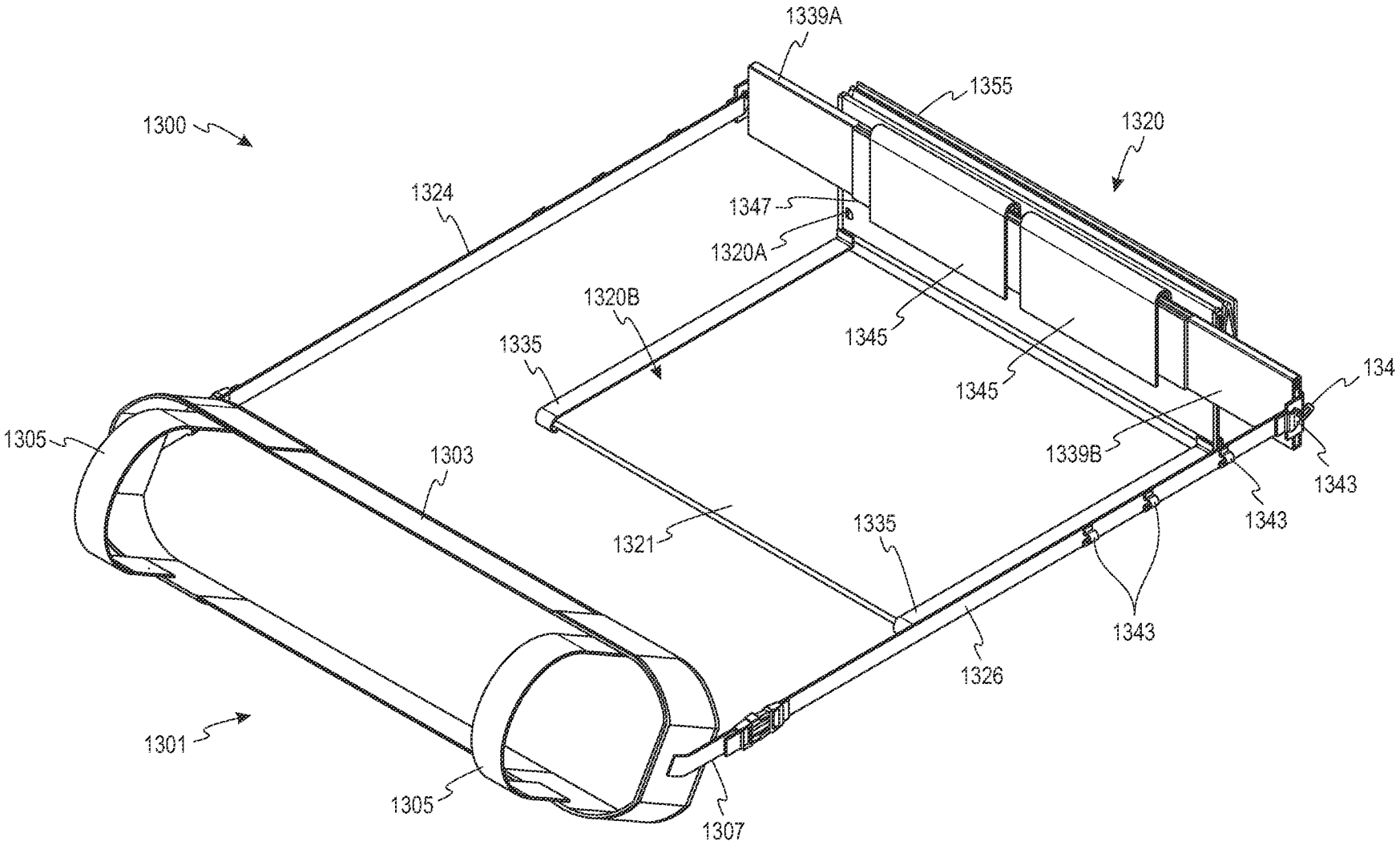
FIG. 13A illustrates a first perspective view of a bed exercise system, according to another example.

Referring now to FIGS. 13A-16, a bed exercise system 1300 is shown according to another example. FIG. 13A depicts a first perspective view of the bed exercise system 1300 and FIG. 13B depicts a second perspective view of the bed exercise system 1300.

Figure 13B:
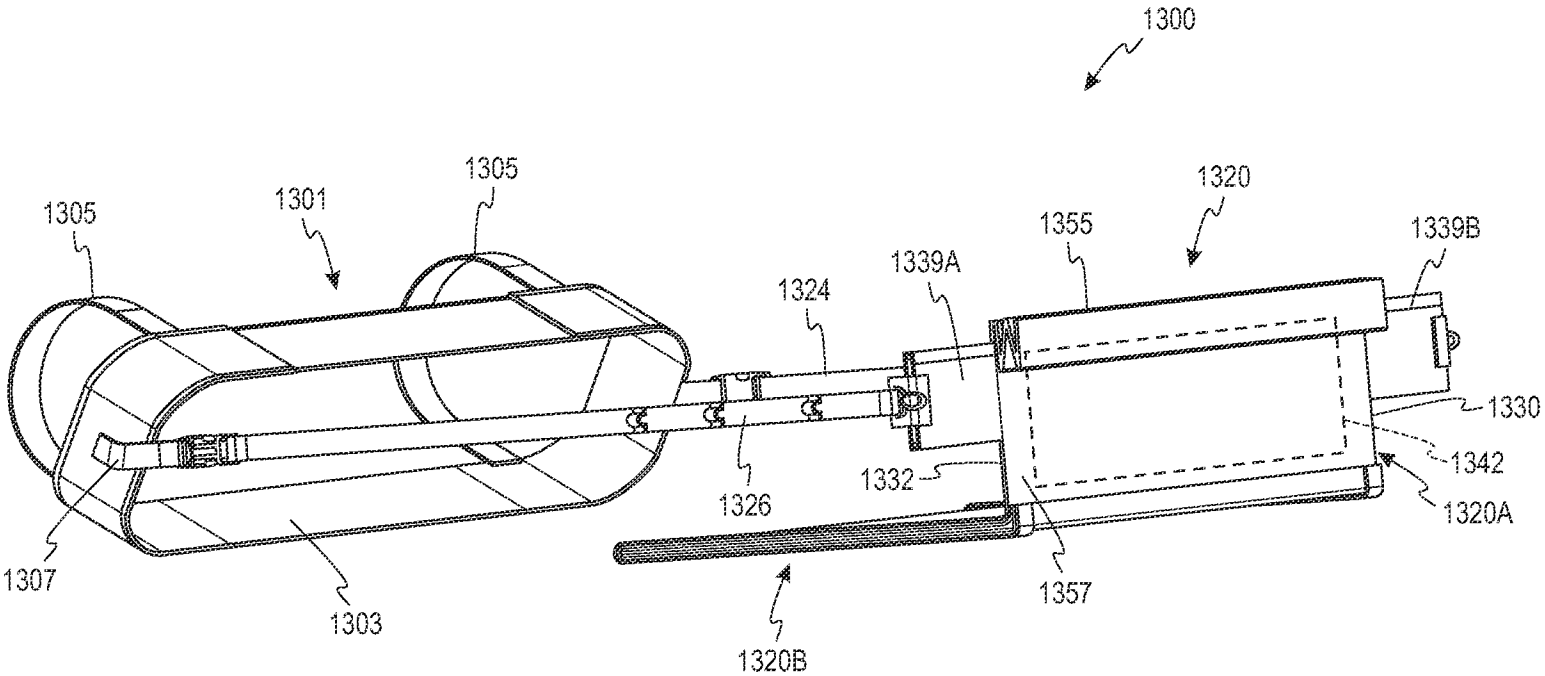
FIG. 13B illustrates a second perspective view of the bed exercise system shown in FIG. 13A, according to an example.

As shown in FIGS. 13A-13B, the bed exercise system 1300 includes a mattress anchor 1301, a foot pad 1320, a first elastic connector 1324, and a second elastic connector 1326. The bed exercise system 1300 is substantially similar or identical to the bed exercise systems 100, 800 in several respects, but includes certain modifications that can, among other things, provide for coupling the bed exercise system 1300 to the operator's feet without boots (e.g., the boots 819) and with the boots. This can help to provide a plurality of mechanisms for coupling the operator's feet to the bed exercise system 1300.

As shown in FIGS. 13A-13B, the mattress anchor 1301 is substantially similar or identical to the mattress anchor 701, 801 described above. As such, the mattress anchor 1301 is configured to couple to a mattress of a bed (e.g., the mattress 108 of the bed 102 described above). For instance, as described above, the mattress anchor 1301 can include a mattress band 1303 that is configured to extend around a width and a thickness of the mattress. Additionally, the mattress anchor 1301 can include a plurality of end straps 1305 that are configured to extend across a head end of the mattress from (i) a first side of the mattress band 1303 on a patient-facing surface of the mattress (e.g., the upper surface 708C of the mattress 108 in FIG. 7B) to (ii) a second side of the mattress band 1303 on a bed-facing surface of the mattress (e.g., the lower surface 708D of the mattress 108 in FIG. 7C). The mattress anchor 1301 can also include a plurality of connectors 1307 that are configured to couple to the first and second elastic connectors 1324, 1326 as describe above (e.g., via the buckle 178 shown in FIGS. 3 and 7A).

Figure 14A:
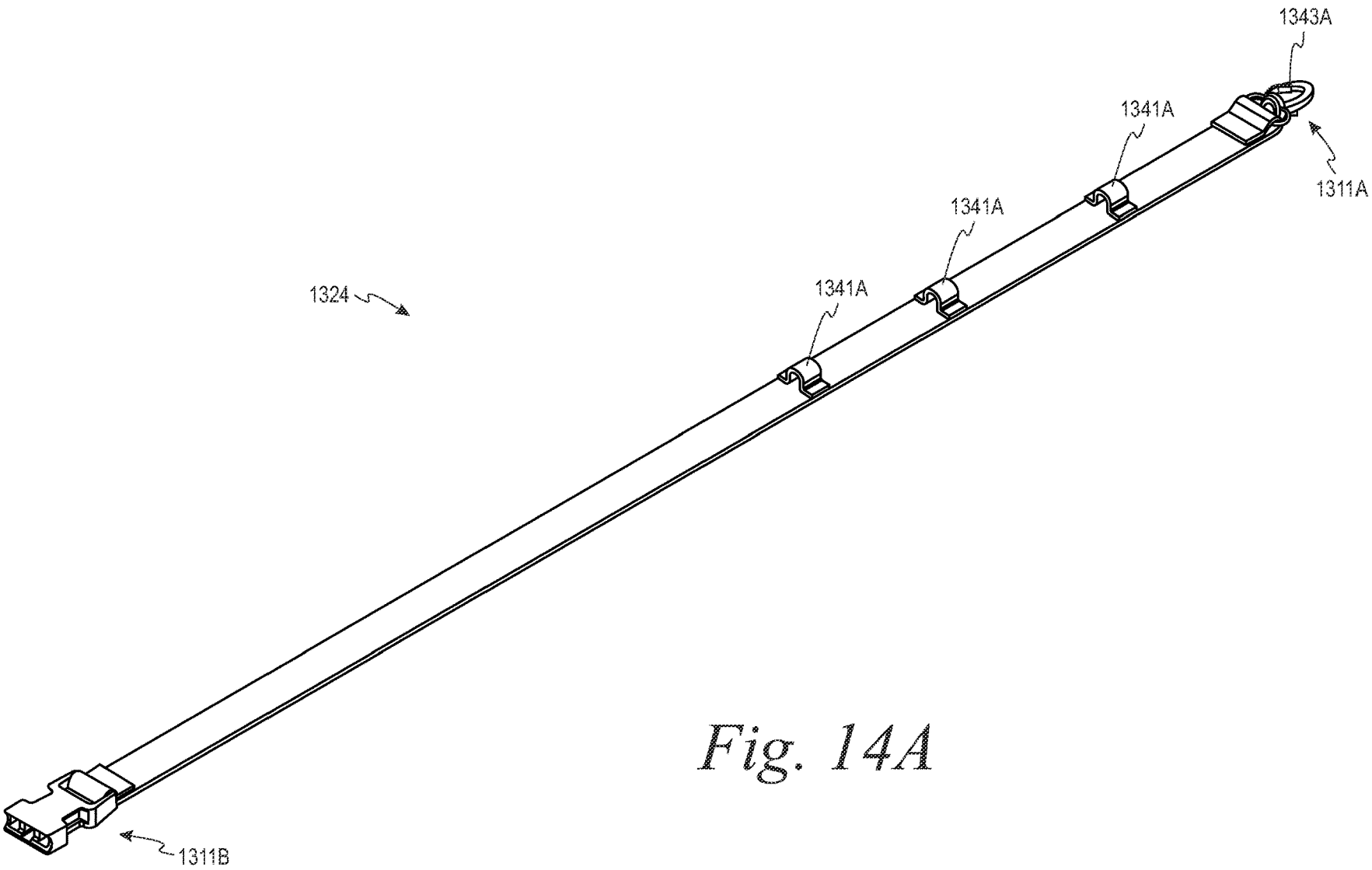
FIG. 14A illustrates a first elastic connector of the bed exercise system shown in FIGS. 13A-13B, according to an example.
Figure 14B:
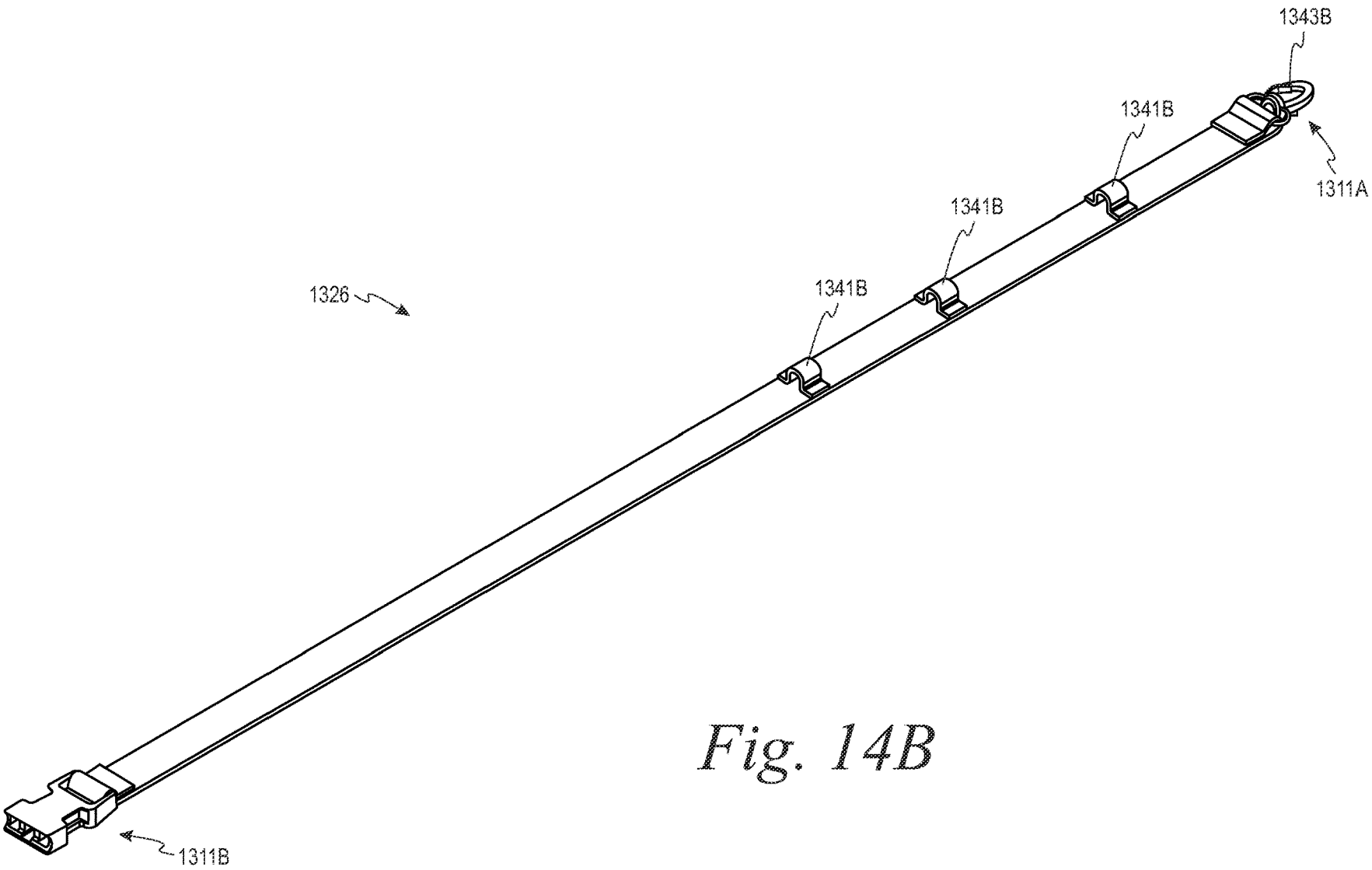
FIG. 14B illustrates a first elastic connector of the bed exercise system shown in FIGS. 13A-13B, according to an example.

In general, the first and second elastic connectors 1324 and 1326 are configured to couple to (i) the foot pad 1320 on opposing lateral sides of the foot pad 1320, and (ii) a patient structure such as, for example, the mattress (or, in other examples, a bed frame). For example, FIGS. 14A-14B show the first and second elastic connectors 1324A, 1324B according to an example. In FIG. 14A, the first elastic connector 1324 has a first end 1311A that can couple to a first lateral side of the foot pad 1320 and a second end 1311B that can couple to the patient support structure (e.g., via the mattress anchor 1301). Similarly, in FIG. 14B, the second elastic connector 1326 has a first end 1311A that can couple to a second lateral side of the foot pad 1320 and a second end 1311B that can couple to the patient support structure. As noted above, the patient support structure is the mattress in this example, but the patient support structure can be another structure such as, for instance, a bed frame in another example (e.g., using the first anchor 172 and the second anchor 174 described above).

In FIGS. 13A-13B, for example, the foot pad 1320 includes a first lateral extension 1339A that is releasably coupled to the first elastic connector 1324 and a second lateral extension 1339B that is releasably coupled to the second elastic connector 1326. In one example, the first and second elastic connectors 1324, 1326 can be configured to have a static, fixed length. In other examples, the first and second elastic connectors 1324, 1326 can be configured to have an adjustable length, as described above.

In FIGS. 13A-13B and FIGS. 14A-14B, for example, the first elastic connector 1324 includes a first adjustment mechanism configured to adjust a length of the first elastic connector 1324, and the second elastic connector 1326 includes a second adjustment mechanism configured to adjust a length of the second elastic connector 1326. For example, in FIG. 13, the first adjustment mechanism includes a plurality of first loops 1341A on the first elastic connector 1324 and a first clip 1343A that is configured to couple to a selected one of the plurality of first loops 1341A. Similarly, the second adjustment mechanism includes a plurality of second loops 1341B on the second elastic connector 1326 and a second clip 1343B that is configured to couple to a selected one of the plurality of second loops 1341B.

The first and second clips 1343A, 1343B can be coupled to a retention structure (e.g., a loop or a ring) on the first lateral extension 1339A and the second lateral extension 1339B, respectively. As such, the first clip 1343A is closer to the foot pad 1320 than the plurality of first loops 1341A when the first clip 1343A is decoupled from all of the plurality of first loops 1341A and the first clip 1343A is coupled to the foot pad 1320, and the second clip 1343B is closer to the foot pad 1320 than the plurality of second loops 1341B when the second clip 1343B is decoupled from all of the plurality of second loops 1341B and the second clip 1343B is coupled to the foot pad 1320. In this arrangement, the first and second clips 1343A, 1343B can be selectively coupled to a respective one of the first and second loops 1341A, 1341B to adjust the length of the first and second elastic connectors 1324, 1326.

As described above, the first elastic connector 1324 and the second elastic connector 1326 can be releasably coupled to the foot pad 1320 (e.g., via the first and second clips 1343A, 1343B). This can help to more efficiently disassemble, repair, and/or store the bed exercise system 800. However, in another example, the first elastic connector 1324 and the second elastic connector 1326 can be non-releasably coupled to the foot pad 1320 (e.g., via stitching and/or adhesive).

As described above, when the second end 1311B of the first elastic connector 1324 and the second end 1311B of the second elastic connector 1326 are coupled to the patient support structure (e.g., the mattress): (i) the foot pad 1320 is movable between a first position and a second position relative to the patient support structure, and (ii) a tension on the first elastic connector 1324 and a tension on the second elastic connector 1326 increases as the foot pad 1320 moves from the first position to the second position.

As shown in FIGS. 13A-13B, the foot pad 1320 can include a first portion 1320A and a second portion 1320B. As described in detail below, the first portion 1320A of the foot pad 1320 includes at least one foot retention structure that is configured to couple to the operator's feet. The second portion 1320B of the foot pad 1320 extends from a lower side of the first portion 1320A of the foot pad 1320, and is configured to move the first portion 1302A of the foot pad 1320 and the operator's feet over the mattress.

For example, the second portion 1320B of the foot pad 1320 can include a tube 1321 that is substantially similar or identical to the tube 1021 described above with respect to FIGS. 10A-10D. As such, the tube 1321 can include an interior surface and an exterior surface. As described above, the tube 1321 can be configured such that a first portion of the interior surface can contact a second portion of the tube 1321 when the foot pad 1320 is moved between the first, retracted position and the second, extended position. Additionally, as described above, the exterior surface of the tube 1321 can include one or more high friction portions 1335 as described above. In FIGS. 13A-13B, the high friction portions 1335 are on opposing lateral sides of the second portion 1320B of the foot pad 1320.

As noted above, the first portion 1320A of the foot pad 1320 can include at least one foot retention structure that is configured to couple to the operator's feet with boots and/or without boots. The foot pad 1320 can include a rigid support member 1342 (shown in FIG. 13B), which can be similar to the rigid support member 142 described above. For example, the rigid support member 1342 can be located in an internal cavity of the foot pad 1320. Additionally, for example, the rigid support member 1342 can be configured to have sufficient rigidity for supporting one or both of the feet of the operator 104 when coupling the feet to the foot pad 1320 without the boots. As examples, the rigid support member 142 can be made from a metal and/or a plastic material.

As shown in FIG. 13A, the at least one foot retention structure can include a plurality of pockets 1345 on a front side 1347 of the first portion 1320A of the foot pad 1320. Each pocket 1345 has a closed end facing an upper side of the foot pad 1320 and an open end facing a lower side of the foot pad 1320 such that the pocket 1345 is configured to receive at least a forefoot region of a respective foot without a boot attached to the foot. In some examples, each pocket 1345 can be further configured to receive a midfoot region of the respective foot as well. This can help to more securely couple the foot pad 1320 to the foot as opposed to an example in which the pocket 1245 only receives the forefoot region of the foot.

In one example, each pocket 1345 has a width in a dimension between a first lateral side 1330 of the foot pad 1320 and a second lateral side 1332 of the foot pad 1320, and the width of each pocket 1345 is approximately eight inches. This can help to accommodate a range of foot sizes that are may be expected for different operators. Additionally, this width can help to provide additional space to allow the operator to position their feet at an appropriate distance relative to each other. Although a width of approximately eight inches can be beneficial for at least the reasons explained above, the pockets 1345 can have widths of different dimensions in other examples (e.g., approximately 6 inches, approximately 7 inches, approximately 9 inches, and/or approximately 10 inches.

Figure 15A:
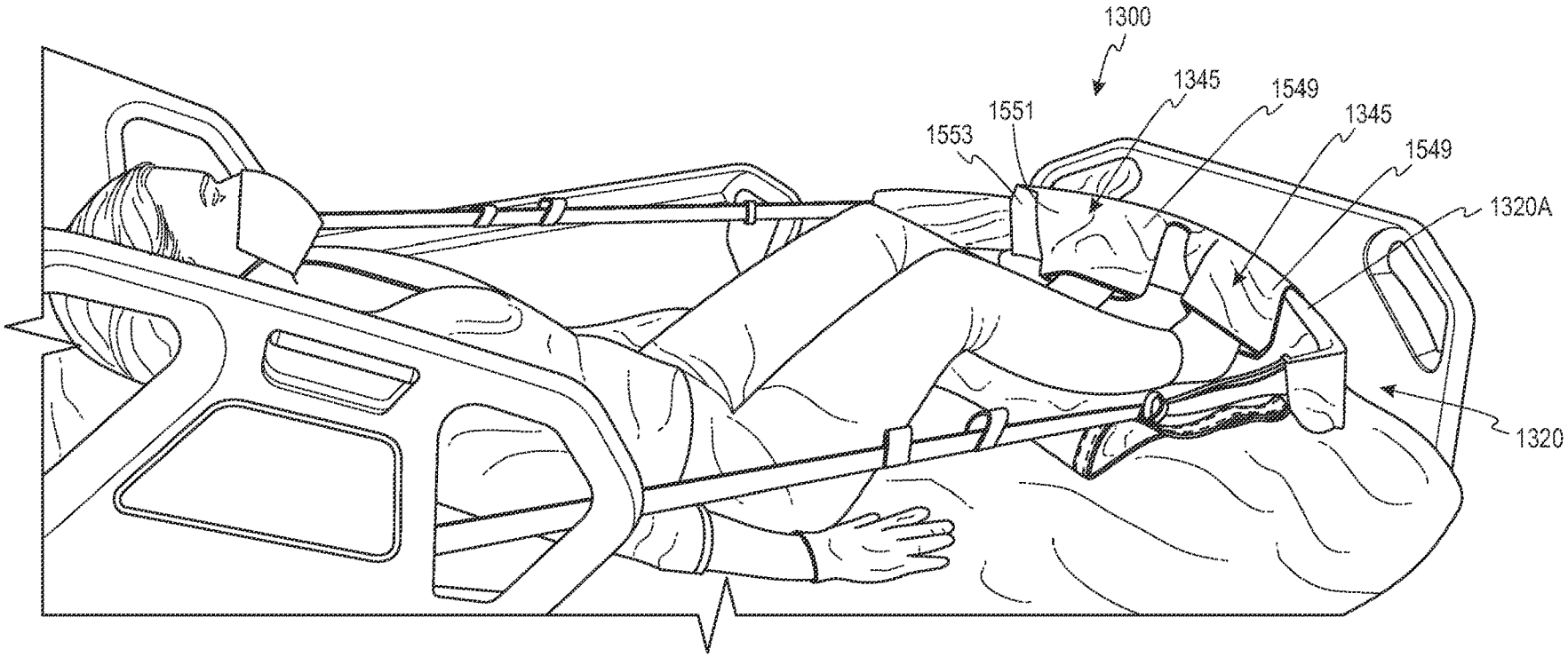
FIG. 15A illustrates a first perspective view of the bed exercise system of FIGS. 13A-13B coupled to feet of an operator without boots, according to another example.
Figure 15B:
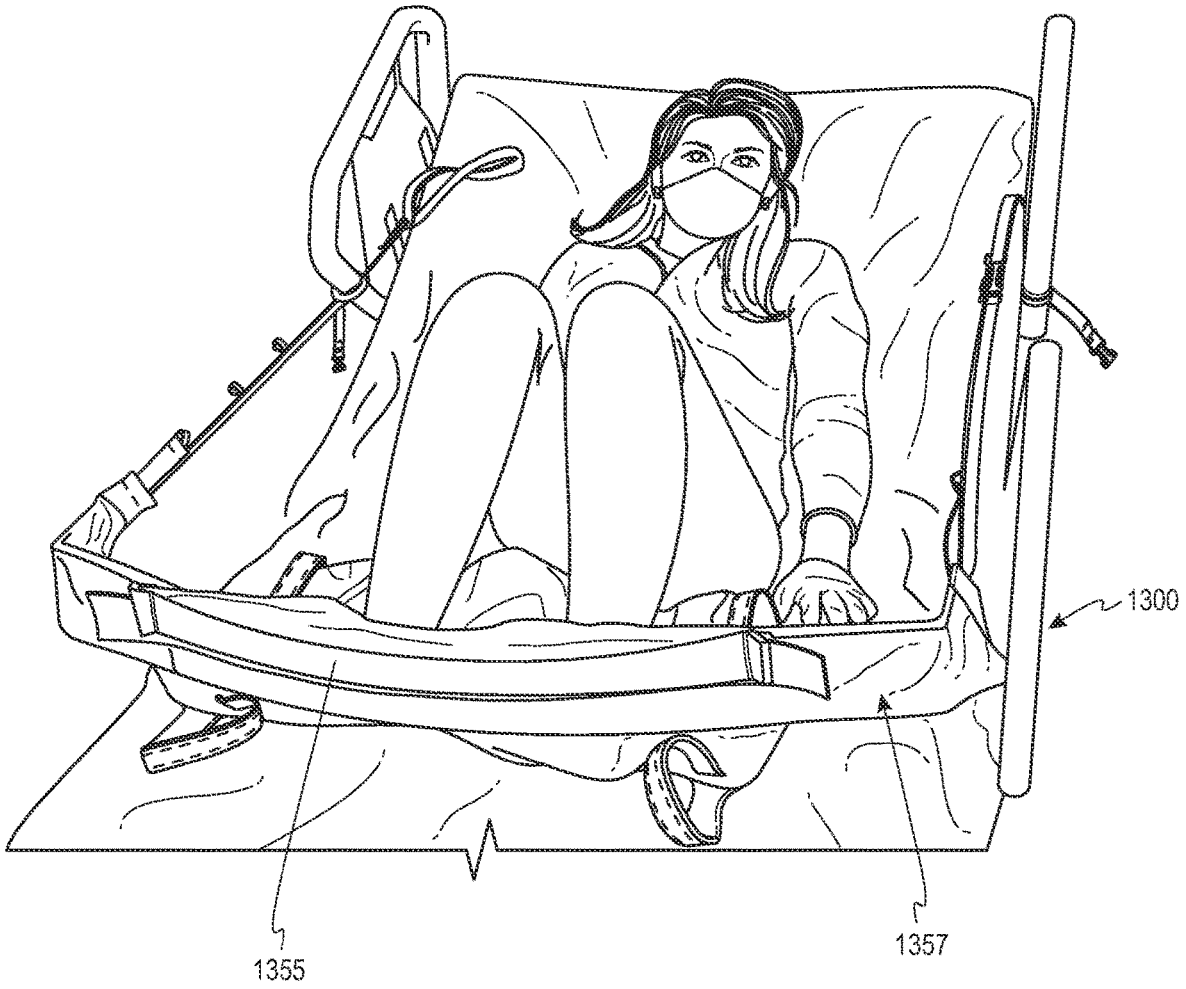
FIG. 15B illustrates a second perspective view of the bed exercise system of FIGS. 13A-13B coupled to feet of an operator without boots according to an example.

FIGS. 15A-15B illustrate the bed exercise system 1300 with an operator's feet coupled to the pockets 1345 on the first portion 1320A of the foot pad 1320. As shown in FIG. 15A, at least a portion of each pocket 1345 can be coupled to the foot pad 1320 by a hook and loop fastener coupling. For example, each pocket 1345 can include a flap 1549 of material having a hook and loop fastener 1551 on lateral sides of the flap 1549, and a corresponding hook and loop fastener 1553 can be located on the front side 1347 of the first portion 1320A of the foot pad 1320. This can allow for adjustable configuration of the pockets 1345 on the front side 1347. In other examples, the flap 1549 can be releasably coupled to the front side 1347 by an additional or alternative coupling mechanism (e.g., snaps and/or clips). In still other examples, the flap 1548 can be permanently coupled to the front side 1347 (e.g., by stitching) and a size of the pockets 1345 can be adjusted by an alternative mechanism (e.g., a drawstring and/or shoestring laces).

Figure 16:
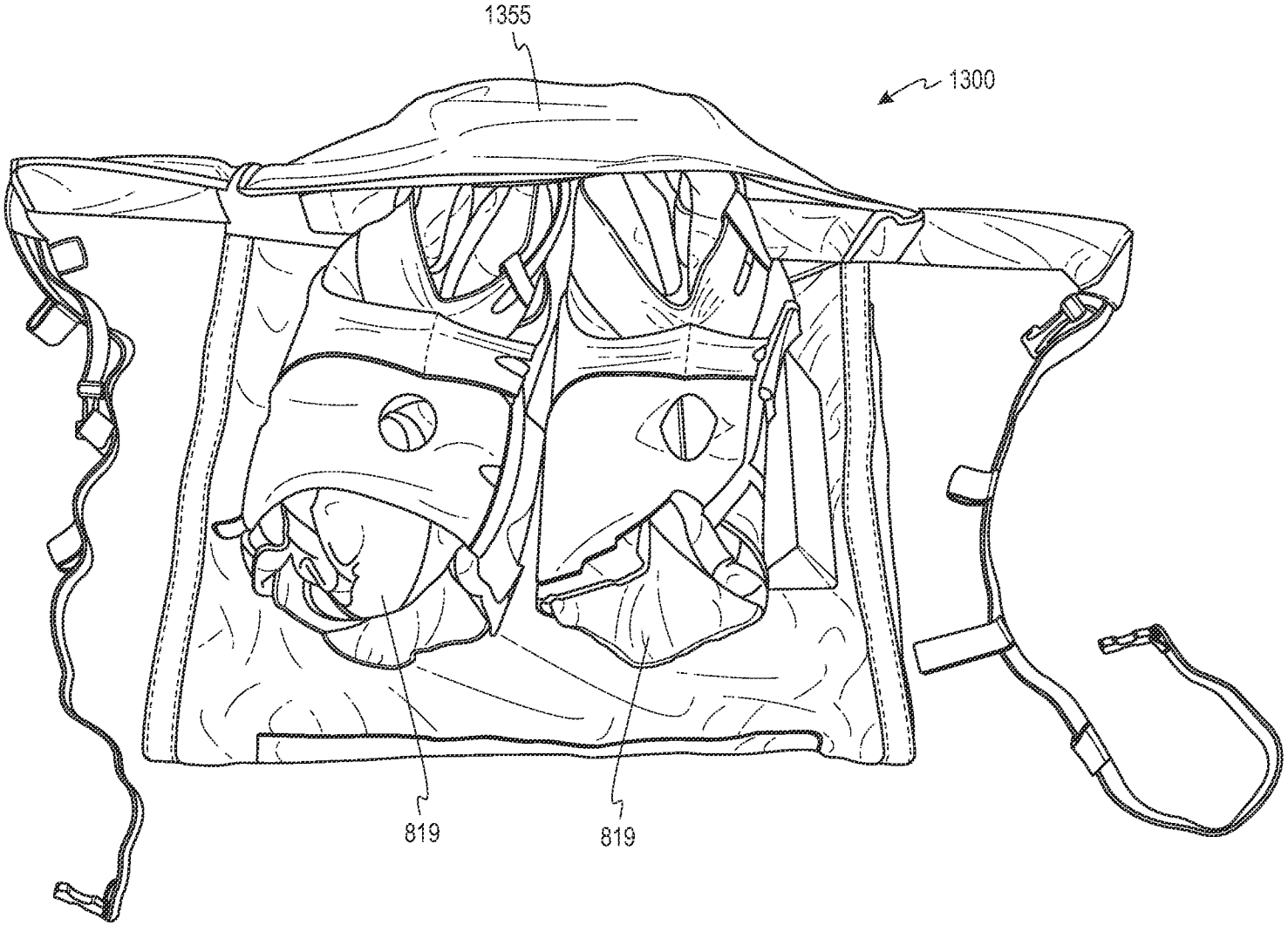
FIG. 16 illustrates a perspective view of the bed exercise system shown in FIG. 13A coupled to a pair of boots, according to an example.

As shown in FIG. 13B, the at least one foot retention structure can additionally or alternatively a hood structure 1355 that is movable between a storage position on a back side 1357 of the foot pad 1320 and a retention position on the front side 1347 of the foot pad 1320. FIGS. 13B and 15B show the hood structure 1355 in the storage position on the back side 1357 of the first portion 1320A of the foot pad 1320. FIG. 16 shows the hood structure 1355 in the retention position and coupled to the boots 819 on the front side 1347. As shown in FIG. 16, in the retention position, the hood structure 1355 is configured to retain at least a forefoot region of the pair of boots 819 worn by the operator while soles of the pair of boots 819 contact the front side 1347 of the foot pad 1320.

The hood structure 1355 can beneficially have a relatively larger size than the pockets 1345 to accommodate the relatively larger size of the boots 819 relative to the feet of the operator without the boots 819. As such, when the foot pad 1320 includes both the pockets 1345 and the hood structure 1355, the foot pad 1320 can provide for the patient using the bed exercise system 1300 with and without the boots 819. Although there are benefits to including both the pockets 1345 and the hood structure 1355, the bed exercise system 1300 (and/or the bed exercise systems 100, 800) can include only the pockets 1345 or only the hood structure 1355 in other examples.

As shown in FIGS. 13A-13B, the hood structure 1355 can include a plurality of accordion pleats 1359 configured to expand responsive to moving the hood structure 1355 from the storage position to the retention position. As such, the accordion pleats 1359 can help to more compactly store the hood structure 1355 in the storage position when not in use.

Figure 17:
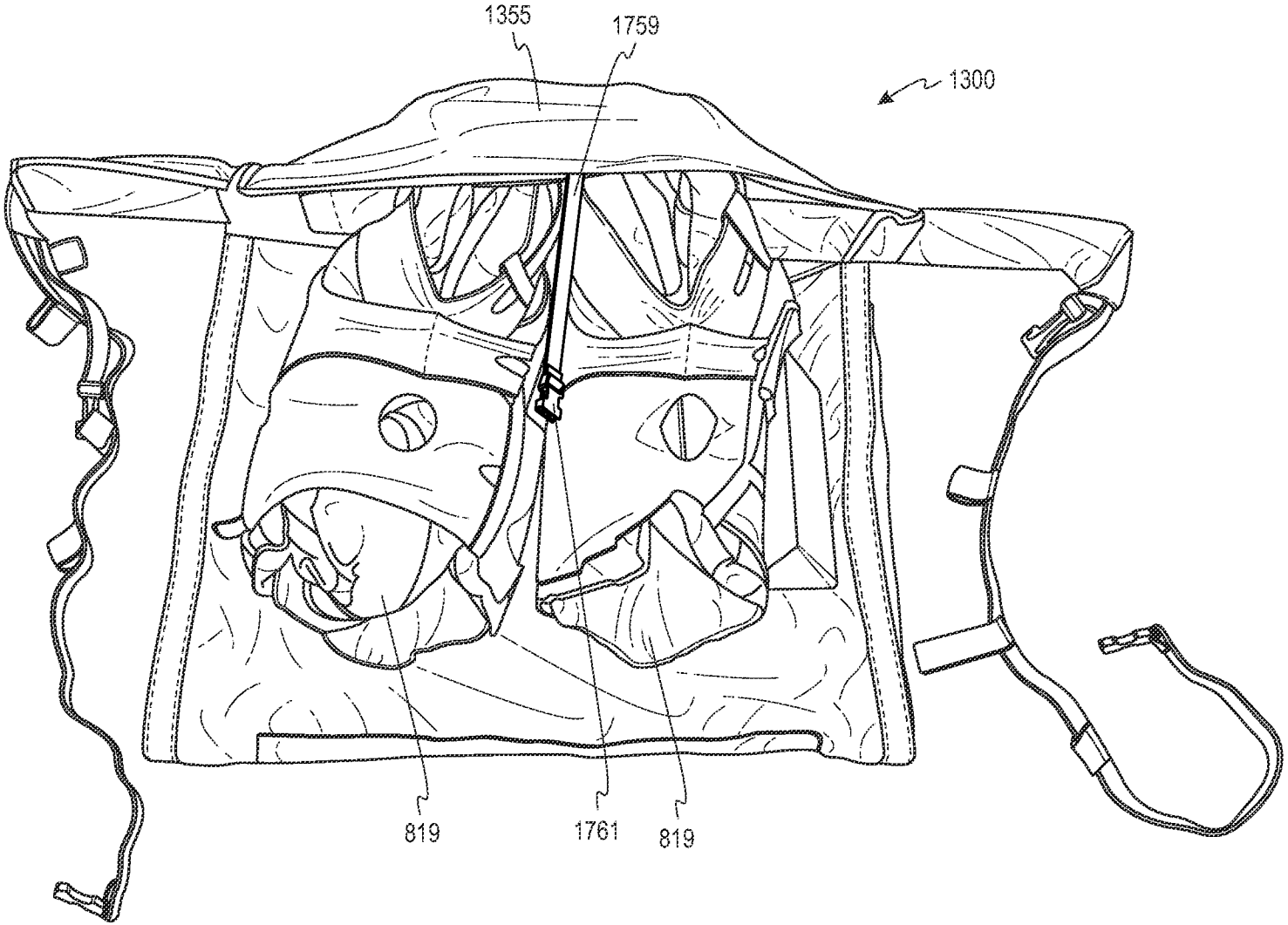
FIG. 17 illustrates a perspective view of the bed exercise system shown in FIG. 13A coupled to a pair of boots, according to another example.

In some examples, the bed exercise system 1300 can include a hood connector that is configured to releasably couple the hood 1355 to the foot pad 1320 in the retention position. For example, as shown in FIG. 17, the bed exercise system 1300 can include a strap 1759 having (i) a first end coupled to the hood structure 1355 and (ii) a second end that is configured to, when the hood structure 1355 is in the retention position, removably couple to the foot pad 1320 via a buckle 1761. The strap 1759 can thus help to retain the hood structure 1355 in the retention position during use of the bed exercise system 1300.

Figure 18:
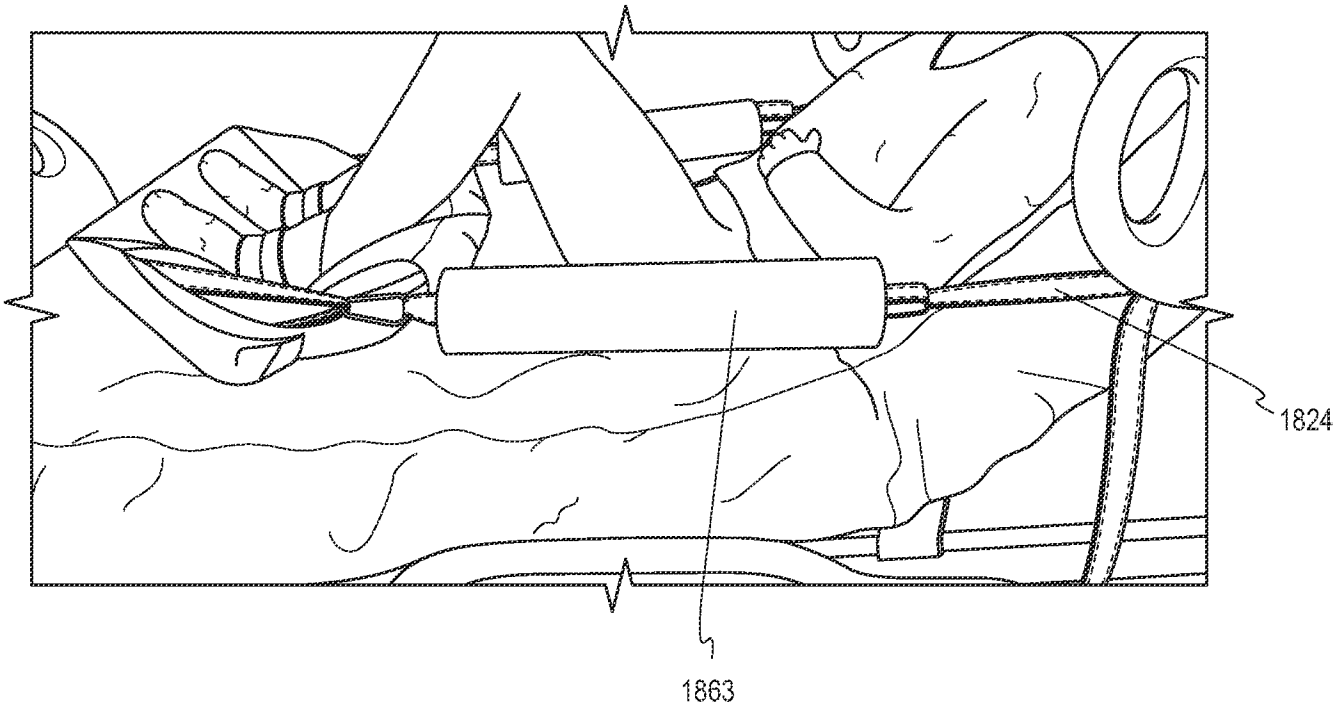
FIG. 18 illustrates an elastic connector and a connector pad according to an example.

Referring now to FIG. 18, an elastic connector 1824 and a connector pad 1863 are shown according to an example. The elastic connector 1824 can be used as the first and second elastic connectors 124, 126, 824, 826 described above. As shown in FIG. 18, the connector pad 1863 can be coupled to the elastic connector 1824. The connector pad 1863 can help to provide cushioning along the legs of the patient. In one implementation, the connector pad 1863 can be a tubular structure defining a through bore. In this arrangement, the elastic connector 1824 can extend through the through bore of the connector pad 1863.

Figure 19:
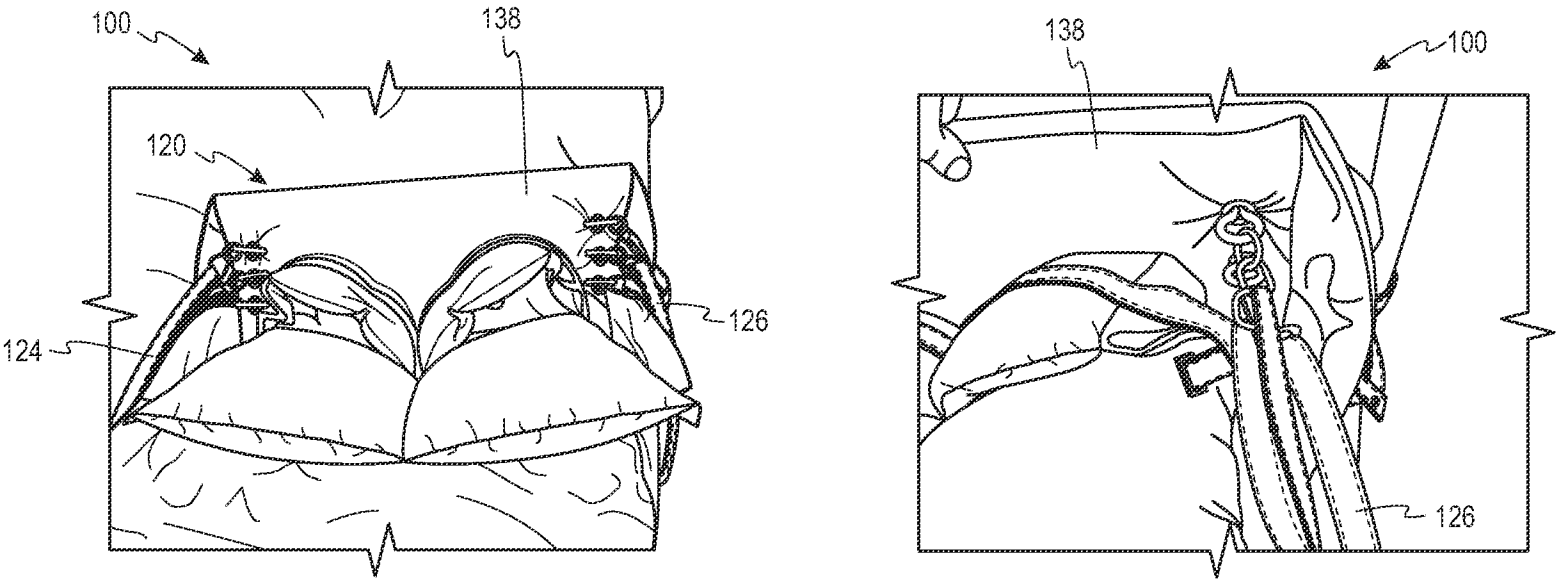
FIG. 19 illustrates a coupling between a foot pad and elastic connectors, according to another example.

Referring to FIG. 19, an alternative coupling between a foot pad 120 and first and second elastic connectors 124, 126 is shown according to another example. In FIG. 1A, the first and second elastic connectors 124, 126 are coupled to the first and second lateral sides 130, 132, respectively. As shown, in FIG. 19, the first and second elastic connectors 124, 126 can be coupled to the proximal surface 138 of the foot pad 120 at respective locations adjacent to outer edges of an operators feet in another example.

Figure 20A:
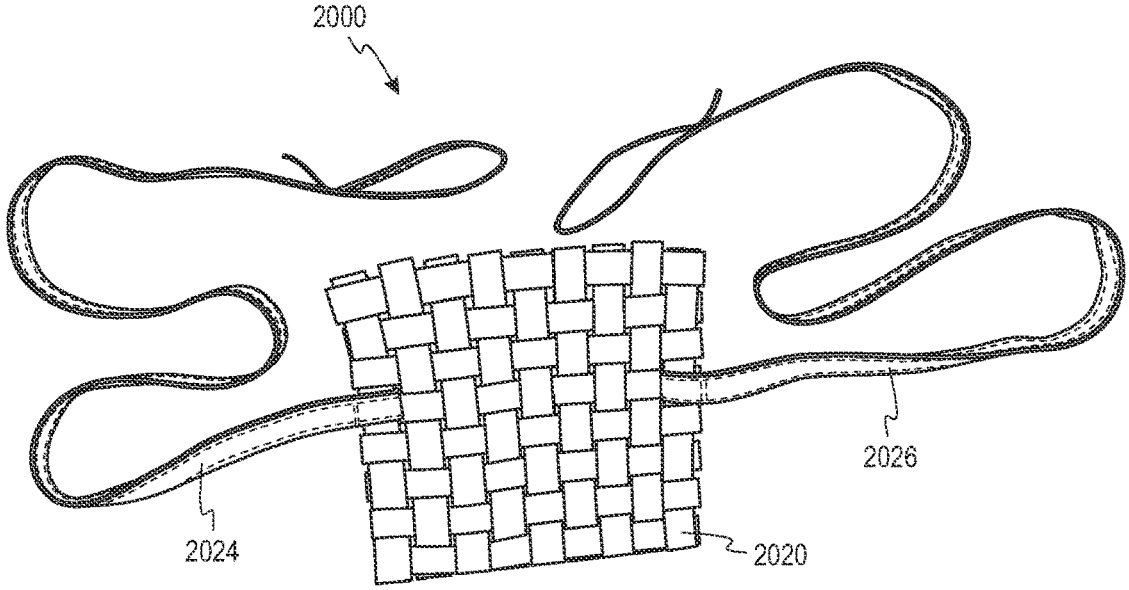
FIG. 20A illustrates a bed exercise system, according to another example.
Figure 20B:
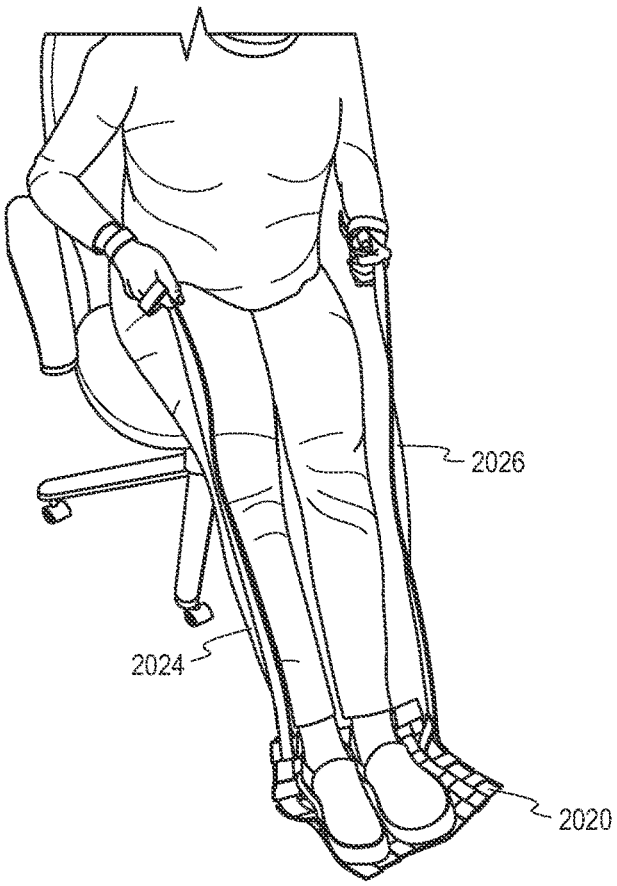
FIG. 20B illustrates the bed exercise system of FIG. 20A being used by an operator, according to an example.

Referring now to FIGS. 20A-20B, a bed exercise system 2000 is shown according to another example. The bed exercise system 2000 includes a foot pad 2020, a first elastic connector 2024, and a second elastic connector 2026. The foot pad 2020 can include a plurality of strips of material in a woven arrangement. The first elastic connector 2024 can have a first end coupled to a first side of the foot pad 2020 and a second end having a first handle. The second elastic connector 2026 can have a first end coupled to a second side of the foot pad 2020, which is opposite the first side, and a second end having a second handle. The first and second handles can be loops of an elastic material forming the first and second elastic connectors 2024, 2026.

As shown in FIG. 20B, an operator can operate the bed exercise system 2000 by holding the first handle with one hand, holding the second handle with another hand, and positioning one or more feet on the foot pad 2020. The operator can then extend the one or more feet against the tension in the first and second elastic connectors 2024, 2026, and retract the one or more feet to perform one or more reps of a leg press exercise. The operator can additionally or alternatively rotate the foot pad 2020 while holding the first and second handles to perform a dorsiflexion exercise.

Figure 21:
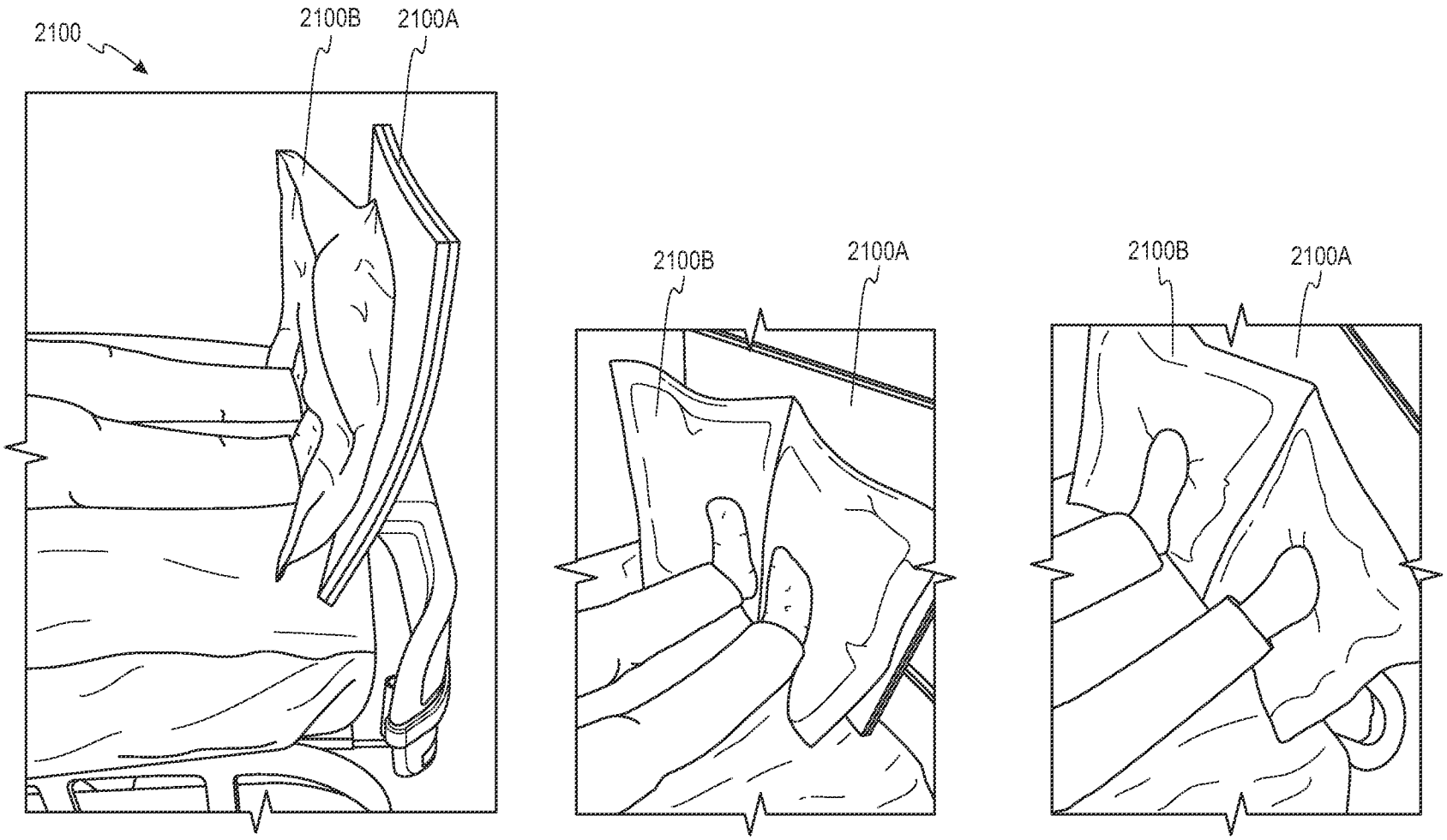
FIG. 21 illustrates a bed exercise system, according to another example.

Referring now to FIG. 21, a bed exercise system 2100 is shown according to another example. The bed exercise system 2100 includes a foot board 2100A and an air cushion

2100B. The foot board 2100A can be a rigid support member that can be coupled to a bed and, when coupled to the bed, remain in a fixed position relative to a bed. In one example, the air cushion 2100B can include a first chamber and a second chamber that are separated from each other by an interrupted seal. In this arrangement, air can transfer between the first chamber and the second chamber. As shown in FIG. 21, the air cushion 2100 can be arranged against an operator-facing surface of the foot board 2100A. In use, an operator can position a first foot on the air cushion 2100B at the first chamber and a second foot on the air cushion 2100B at the second chamber. The operator can then alternate between (i) using the first foot to apply a force to the air cushion 2100B at the first chamber and (ii) using the second foot to apply a force to the air cushion 2100B at the second chamber. This results in the air transferring between the first and second chambers to provide resistance for each foot during an exercise.

Figure 22:
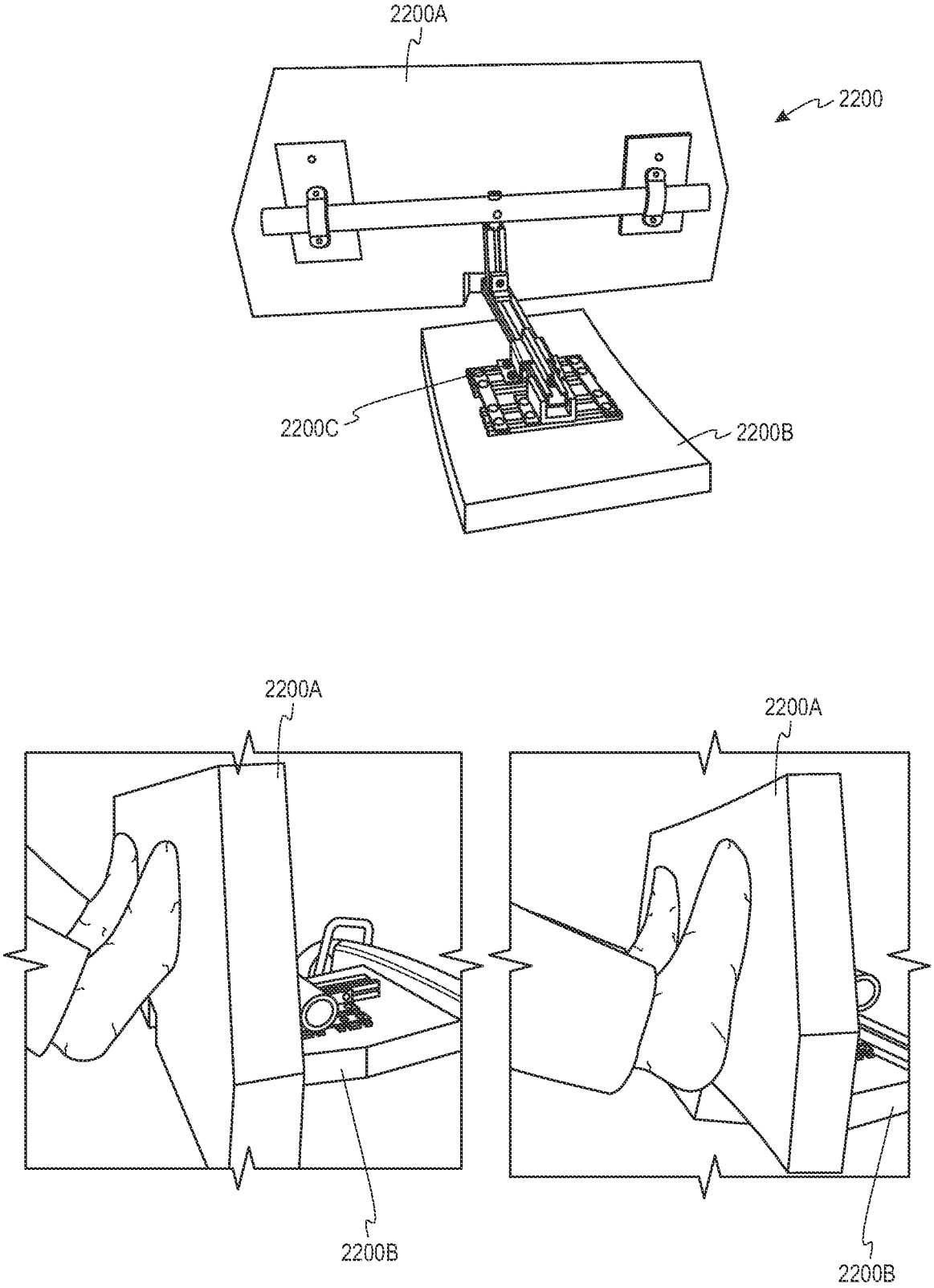
FIG. 22 illustrates a bed exercise system, according to another example.

Referring now to FIG. 22, a bed exercise system 2200 is shown according to another example. The bed exercise system 2200 includes a foot board 2200A coupled to a base 2200B by a spring 2200C. The foot board 2200A is movable between a retracted position and an extended position relative to the base 2200B (e.g., along a rail or track of the base 2200B). The retracted position is proximal of the extended position. The spring 2200C biases the foot board 2200A toward the retracted position. In use, the operator presses with one or more feet on the foot board 2200A to move the foot board 2200A from the retracted position to the extended position against a resistance applied by the spring 2200C to the foot board 2200A.

Figure 23:
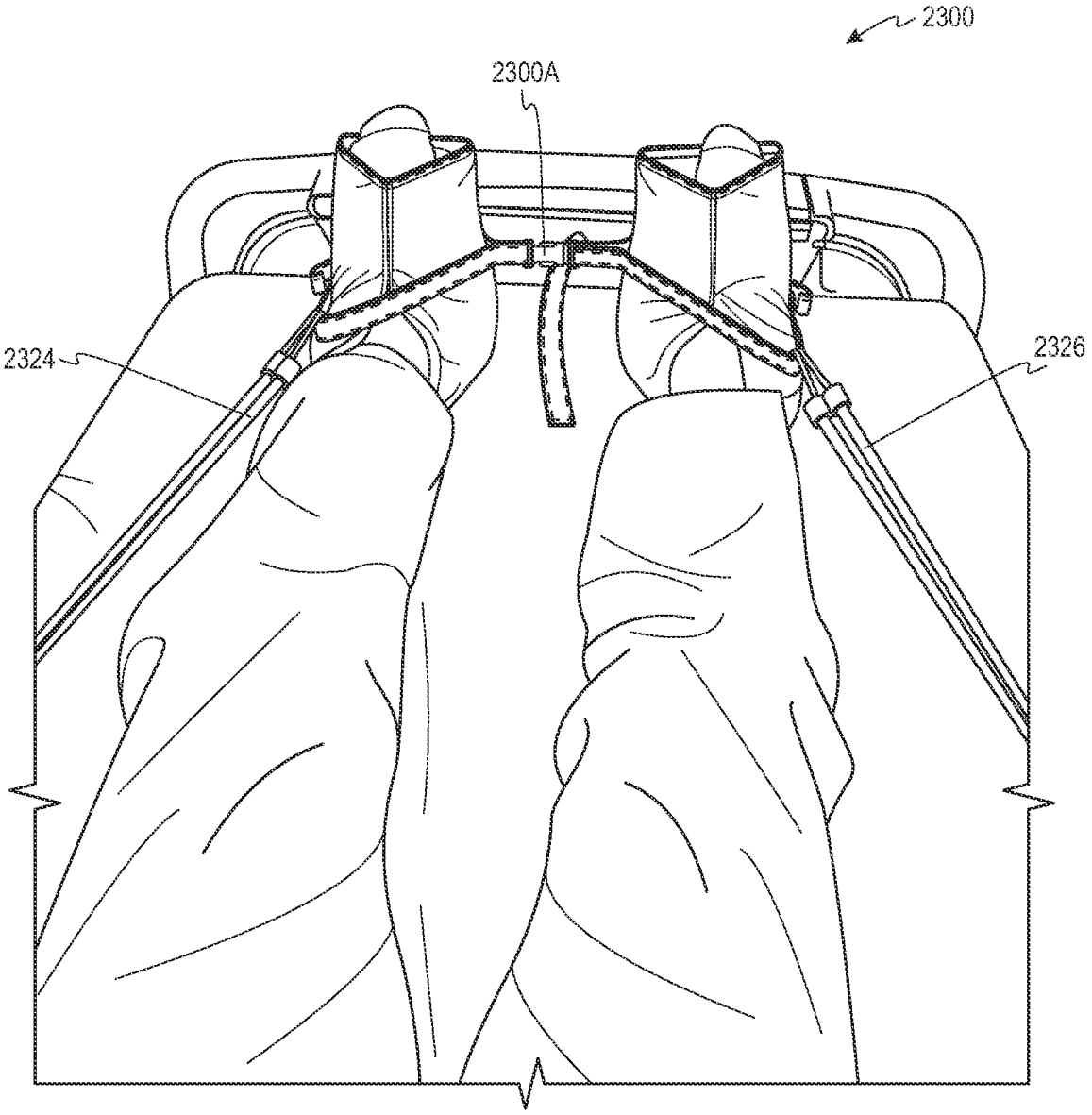
FIG. 23 illustrates a bed exercise system, according to another example.

Referring now to FIG. 23, a bed exercise system 2300 is shown according to another example. The bed exercise system 2300 can include a foot harness 2300A that is coupled to a first elastic connector 2324 and a second elastic connector 2326. The foot harness 2300A can include a first loop that is configured to receive a first foot and a second loop that is configured to receive a second foot. A first end of the first and second elastic connectors 2324, 2326 can be coupled to the bed (e.g., using the anchors 172, 174 and/or the mattress anchors 701, 801, 1301 described above). A second end of the first and second elastic connectors 2324, 2326 can be coupled to opposing sides of the foot harness 2300B. Although FIG. 23 shows an operator using the bed exercise system 2300 with a pair of boots, the bed exercise system 2300 can be used without the boots in another example.

Figure 24:
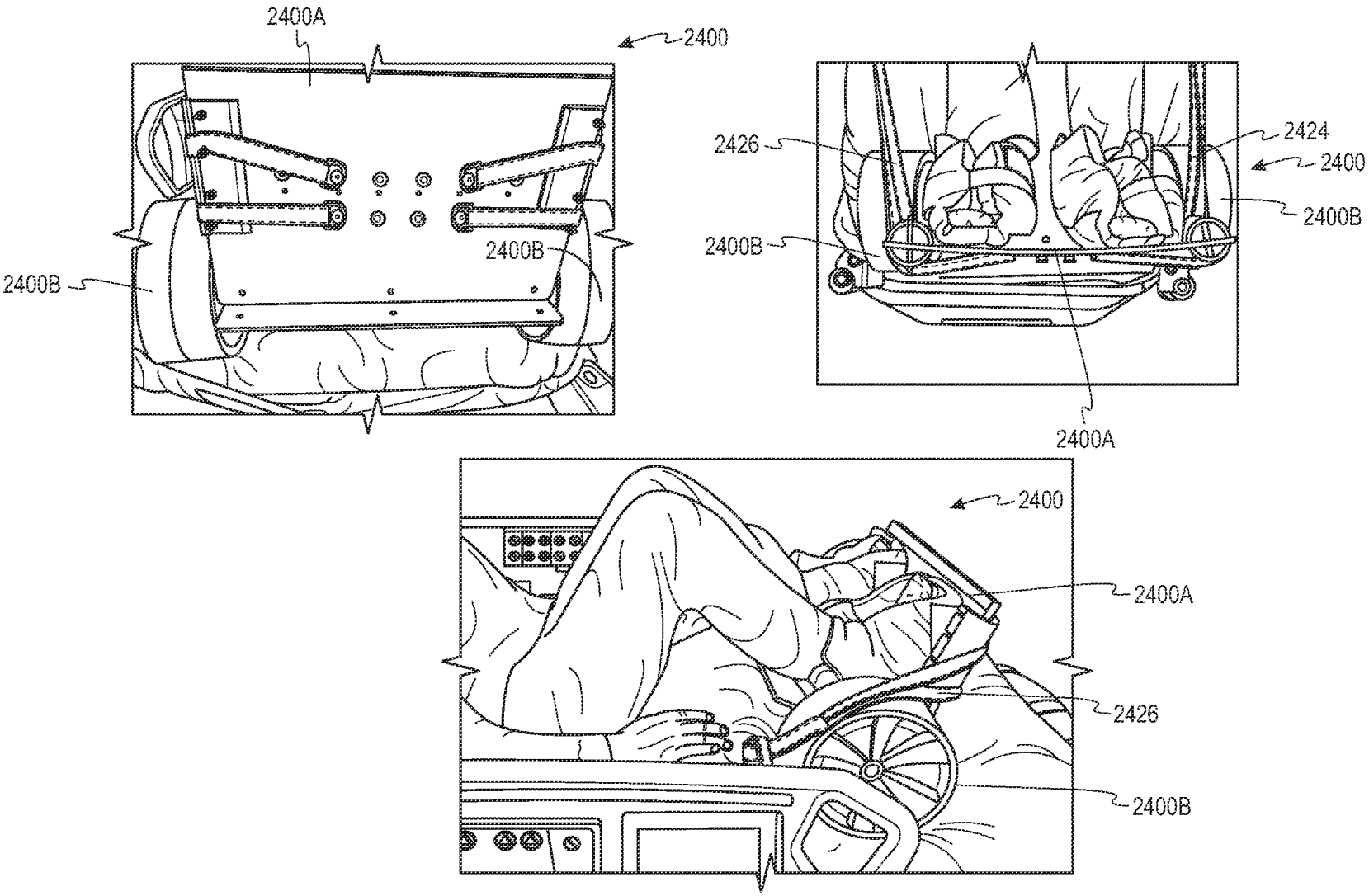
FIG. 24 illustrates a bed exercise system, according to another example.

Referring now to FIG. 24, a bed exercise system 2400 is shown according to another example. As shown in FIG. 24, the bed exercise system 2400 can include a base 2400A defining a shelf that is configured to receive an operator's feet. The base 2400A can include a pair of wheels 2400B on opposing first and second lateral sides of the base 2400A.

The bed exercise system 2400 can further include a first elastic connector 2424 extending from a first anchor point on a bed or mattress to a first lateral side of the base 2400A, and a second elastic connector 2426 extending from a second anchor point on a bed or mattress to a second lateral side of the base 2400A. The first and second elastic connectors 2424, 2426 can be coupled to the first and second anchor points on the bed and/or the mattress as described above. Additionally, the first and second elastic connector 2424, 2426 can be coupled to a distal surface of the base 2400A. In an example, the base 2400A can be configured to releasably couple to a pair of boots worn by the operator (e.g., via hook and loop fasteners). In this arrangement, the operator can extend and retract the feet to apply tension to the first and second elastic connectors 2424A, 2424B while the wheels can help to facilitate movement of the base 2400A over the mattress.

Figure 25:
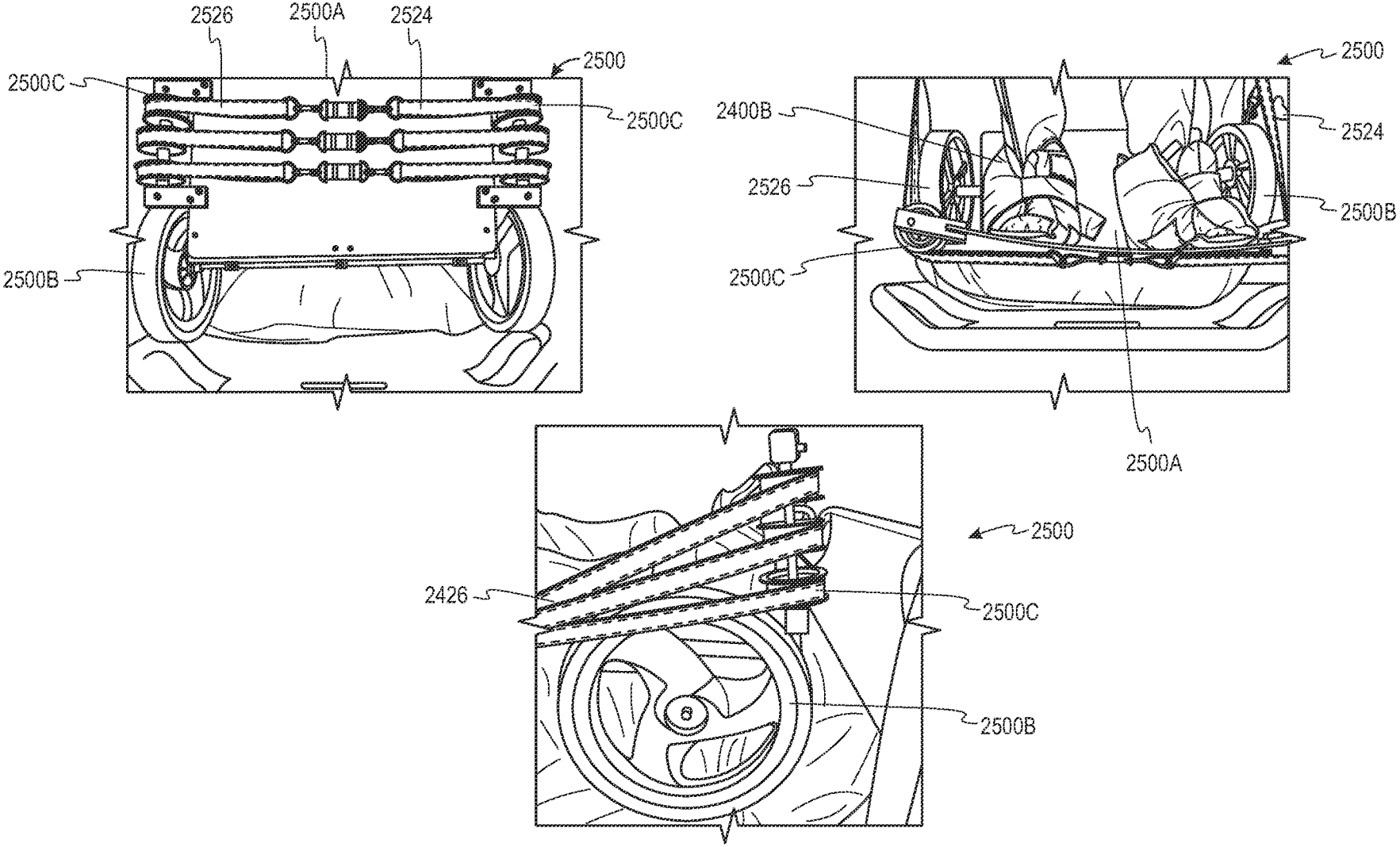
FIG. 25 illustrates a bed exercise system, according to another example.

Referring now to FIG. 25, a bed exercise system 2500 is shown according to another example. The bed exercise system 2500 includes a base 2500A, a pair of wheels 2500B, a first elastic connector 2524, and a second elastic connector 2526 that are substantially similar or identical to the corresponding components described above with respect to FIG. 24. However, the base 2500A of FIG. 25 differs from the base 2400A of FIG. 24 in that the base 2500A includes a plurality of pulleys 2500C to assist in stretching the first and second elastic connectors 2524, 2526 at the lateral sides of the base 2500A.

Figure 26:
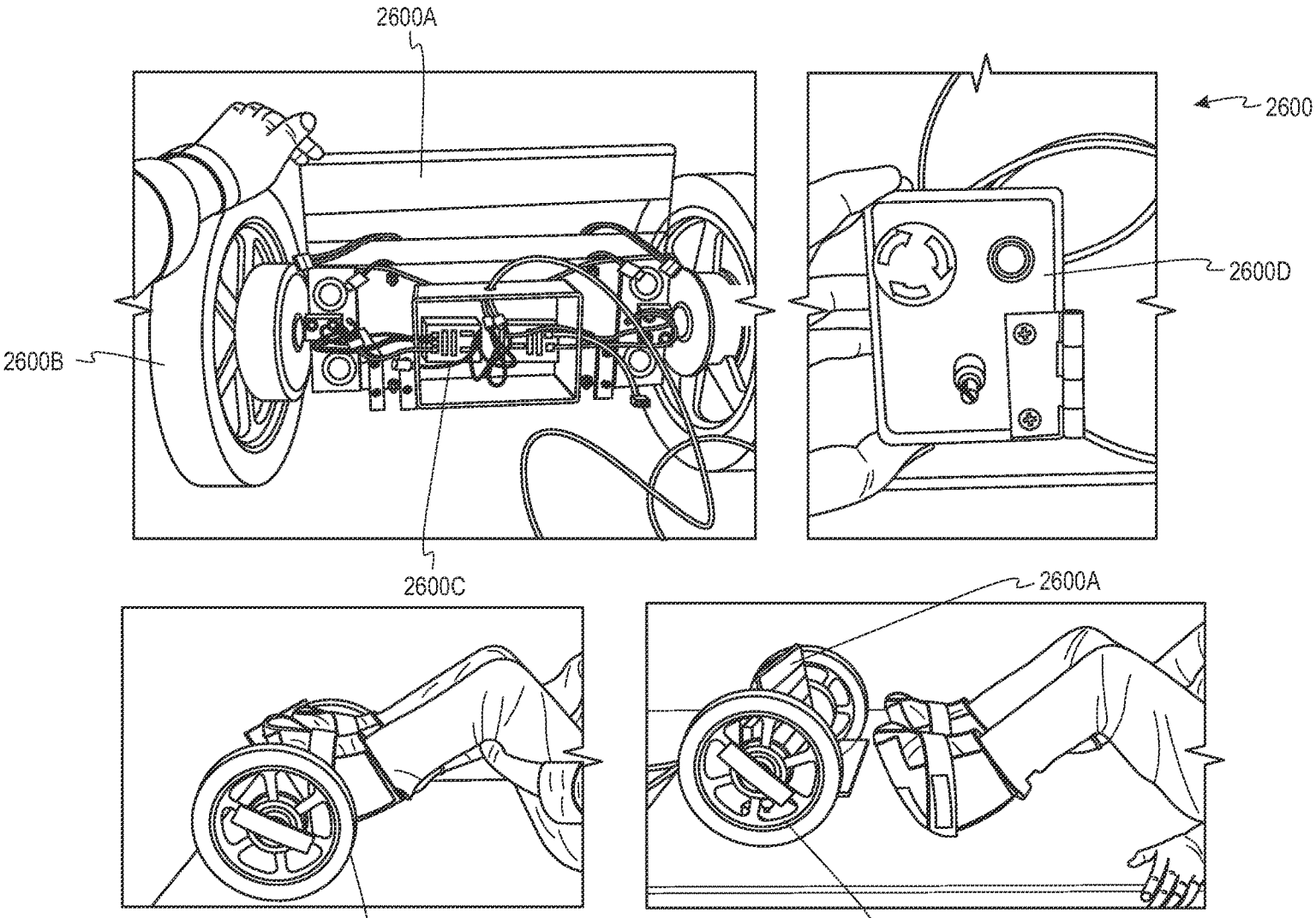
FIG. 26 illustrates a bed exercise system, according to another example.

Referring now to FIG. 26, a bed exercise system 2600 is shown according to another example. The bed exercise system 2600 includes a base 2600A that is configured to couple to a pair of boots of an operator. The bed exercise system 2600 further includes a pair of wheels 2600B on opposing lateral sides of the base 2600A. Additionally, the bed exercise system 2600 includes a motor 2600C (e.g., an electrically powered brushless motor) that is operatively coupled to the wheels 2600B. In this arrangement, the motor 2600C can be configured to provide resistance to the wheels 2600B rolling on the mattress. The operator can presses with their feet on the base 2600A against the resistance to extend and retract the feet and perform leg press exercises. In one implementation, the resistance provided by the motor 2600C can be adjustable (e.g., via a controller 2600D). In this example, the bed exercise system 2600 may omit elastic connectors.

Figure 27:
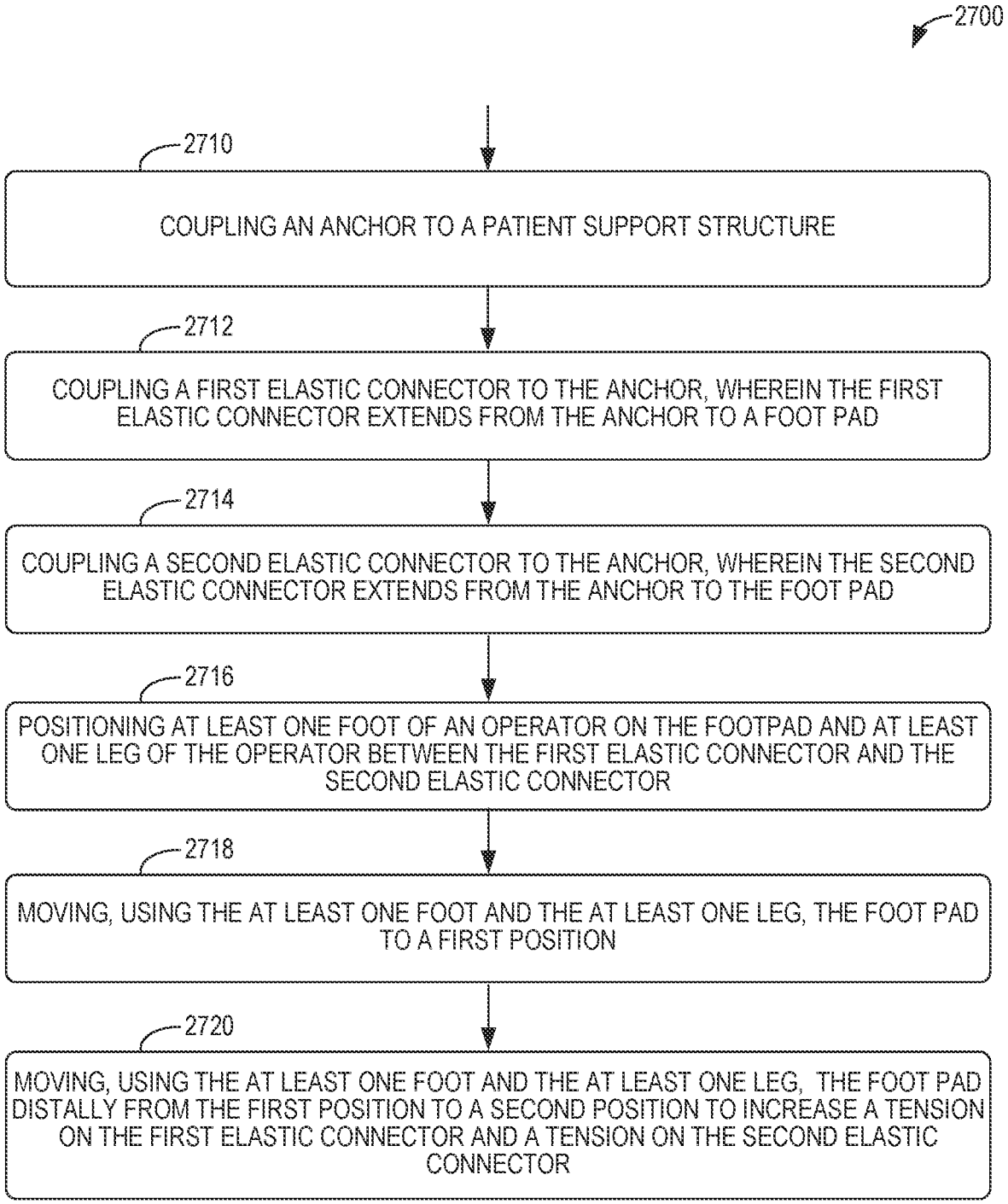
FIG. 27 illustrates a flowchart for a process of operating a bed exercise system, according to an example.

Referring now to FIG. 27, a flowchart for a process 2700 of operating a bed exercise system is shown according to an example. At block 2710, the process 2700 includes coupling an anchor to a patient support structure. At block 2712, the process 2700 includes coupling a first elastic connector to the anchor, wherein the first elastic connector extends from the anchor to a foot pad. At block 2714, the process 2700 includes coupling a second elastic connector to the anchor, wherein the second elastic connector extends from the anchor to the foot pad. At block 2716, the process 2700 includes positioning at least one foot of an operator on the footpad and at least one leg of the operator between the first elastic connector and the second elastic connector. At block 2718, the process 2700 includes moving, using the at least one foot and the at least one leg, the foot pad to a first position. At block 2720, the process 2700 includes moving, using the at least one foot and the at least one leg, the foot pad distally from the first position to a second position to increase a tension on the first elastic connector and a tension on the second elastic connector.

Figure 28:
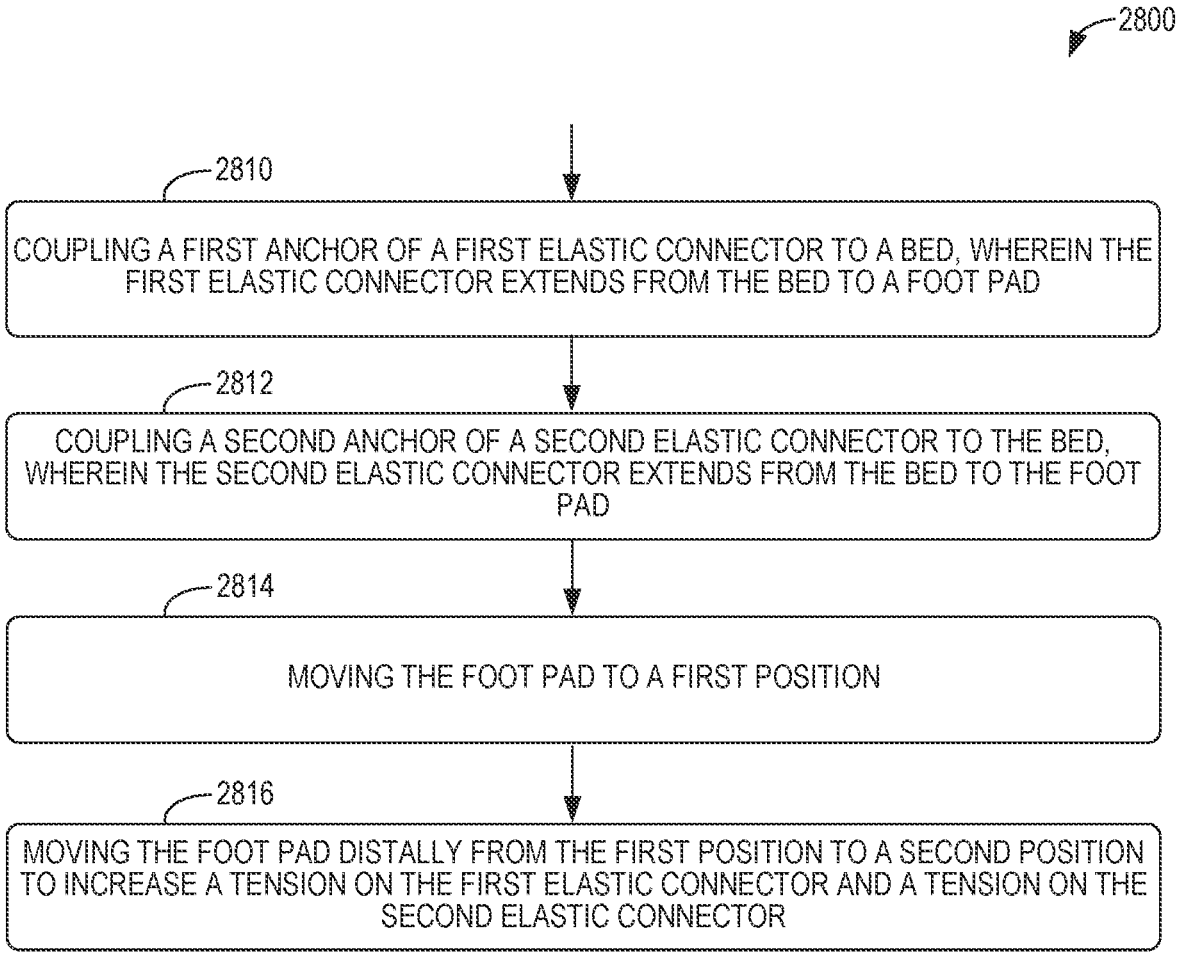
FIG. 28 illustrates a flowchart for a process of operating a bed exercise system, according to another example.

Referring now to FIG. 28, a flowchart for a process 2800 of operating a bed exercise system is shown according to another example. At block 2810, the process 2800 includes coupling a first anchor of a first elastic connector to a bed, wherein the first elastic connector extends from the bed to a foot pad. At block 2812, the process 2800 includes coupling a second anchor of a second elastic connector to the bed, wherein the second elastic connector extends from the bed to the foot pad. At block 2814, the process 2800 includes moving the foot pad to a first position. At block 2816, the process 2800 moving the foot pad distally from the first position to a second position to increase a tension on the first elastic connector and a tension on the second elastic connector.

The description of the different advantageous arrangements has been presented for purposes of illustration and description, and is not intended to be exhaustive or limited to the embodiments in the form disclosed. Many modifications and variations will be apparent to those of ordinary skill in the art. Further, different advantageous embodiments may describe different advantages as compared to other advantageous embodiments. The embodiment or embodiments selected are chosen and described in order to explain the principles of the embodiments, the practical application, and to enable others of ordinary skill in the art to understand the disclosure for various embodiments with various modifications as are suited to the particular use contemplated.

What is claimed is:

1. A bed exercise system, comprising:

a foot pad comprising a rigid support member a first elastic connector having a first end coupled to a first lateral side of the foot pad and a second end configured to couple to a patient support structure; and a second elastic connector having a first end coupled to a second lateral side of the foot pad and a second end configured to couple to the patient support structure, wherein, when the second end of the first elastic connector and the second end of the second elastic connector are coupled to the patient support structure: (i) the foot pad is movable between a first position and a second position relative to the patient support structure, and (ii) a tension on the first elastic connector and a tension on the second elastic connector increases as the foot pad moves from the first position to the second position, wherein the foot pad comprises a first portion and a second portion, wherein the first portion includes the rigid support member, wherein the second portion of the foot pad extends from a lower side of the first portion of the foot pad wherein the second portion of the foot pad comprises a tube having an interior surface and an exterior surface, and wherein a first portion of the interior surface is configured to contact a second portion of the tube when the foot pad is moved between the first position and the second position.

2. The bed exercise system of claim 1, wherein the foot pad comprises at least one foot retention structure.

3. The bed exercise system of claim 2, wherein the at least one foot retention structure comprises a hood structure that is movable between a storage position on a back side of the foot pad and a retention position on a front side of the foot pad, and wherein, in the retention position, the hood structure is configured to retain at least a forefoot region of a pair of boots worn by a patient while soles of the pair of boots contact the front side of the foot pad.

4. The bed exercise system of claim 3, wherein the hood structure comprises a plurality of accordion pleats configured to expand responsive to moving the hood structure from the storage position to the retention position.

5. The bed exercise system of claim 3, further comprising a strap having (i) a first end coupled to the hood structure and (ii) a second end that is configured to, when the hood structure is in the retention position, removably couple to at least one of the foot pad or a leg support member extending from the foot pad.

6. The bed exercise system of claim 1, further comprising an anchor configured to couple to a mattress of a bed, wherein the patient support structure comprises the mattress.

7. The bed exercise system of claim 6, wherein the anchor comprises a band that is configured to extend around a width and a thickness of the mattress.

8. The bed exercise system of claim 7, wherein the anchor further comprises a plurality of end straps that are configured to extend across a head end of the mattress from (i) a first side of the band on a patient-facing surface of the mattress to (ii) a second side of the band on a bed-facing surface of the mattress.

9. The bed exercise system of claim 1, wherein the first elastic connector comprises a first adjustment mechanism configured to adjust a length of the first elastic connector, and wherein the second elastic connector comprises a second adjustment mechanism configured to adjust a length of the second elastic connector.

10. The bed exercise system of claim 9, wherein the first adjustment mechanism comprises a plurality of first loops on the first elastic connector and a first clip that is configured to couple to a selected one of the plurality of first loops, wherein the second adjustment mechanism comprises a plurality of second loops on the second elastic connector and a second clip that is configured to couple to a selected one of the plurality of second loops, and wherein the first clip is closer to the foot pad than the plurality of first loops when the first clip is decoupled from all of the plurality of first loops and the second clip is closer to the foot pad than the plurality of second loops when the second clip is decoupled from all of the plurality of second loops.

11. The bed exercise system of claim 1, wherein the first elastic connector and the second elastic connector are releasably coupled to the foot pad.

12. The bed exercise system of claim 1, wherein the exterior surface of the tube has a first coefficient of friction, wherein the interior surface of the tube has a second coefficient of friction, and wherein the first coefficient of friction is greater than the second coefficient of friction.

13. A bed exercise system, comprising:

a foot pad comprising a rigid support member;

a first elastic connector having a first end coupled to a first lateral side of the foot pad and a second end configured to couple to a patient support structure; and a second elastic connector having a first end coupled to a second lateral side of the foot pad and a second end configured to couple to the patient support structure, wherein, when the second end of the first elastic connector and the second end of the second elastic connector are coupled to the patient support structure: (i) the foot pad is movable between a first position and a second position relative to the patient support structure, and (ii) a tension on the first elastic connector and a tension on the second elastic connector increases as the foot pad moves from the first position to the second position, wherein the foot pad comprises at least one foot retention structure, wherein the at least one foot retention structure comprises a plurality of pockets, wherein each pocket has a closed end facing an upper side of the foot pad and an open end facing a lower side of the foot pad such that the foot retention structure is configured to receive at least a forefoot region of a respective foot.

14. The bed exercise system of claim 13, wherein the foot pad comprises a first portion and a second portion, wherein the first portion includes the rigid support member, and wherein the second portion of the foot pad extends from a lower side of the first portion of the foot pad.

15. The bed exercise system of claim 14, wherein the second portion of the foot pad comprises a tube having an interior surface and an exterior surface, and wherein a first portion of the interior surface is configured to contact a second portion of the tube when the foot pad is moved between the first position and the second position.

16. The bed exercise system of claim 15, wherein the exterior surface of the tube has a first coefficient of friction, wherein the interior surface of the tube has a second coefficient of friction, and wherein the first coefficient of friction is greater than the second coefficient of friction.

17. The bed exercise system of claim 13, wherein each pocket is further configured to receive a midfoot region of the respective foot.

18. The bed exercise system of claim 13, wherein each pocket has a width in a dimension between a first lateral side of the foot pad and a second lateral side of the foot pad, and wherein the width of each pocket is approximately eight inches.

19. The bed exercise system of claim 13, wherein at least a portion of each pocket is coupled to the foot pad by a hook and loop fastener coupling.

20. A method of operating a bed exercise system, comprising:

coupling an anchor to a patient support structure;

coupling a first elastic connector to the anchor, wherein the first elastic connector extends from the anchor to a foot pad;

coupling a second elastic connector to the anchor, wherein the second elastic connector extends from the anchor to the foot pad;

positioning at least one foot of an operator on the foot pad and at least one leg of the operator between the first elastic connector and the second elastic connector;

moving, using the at least one foot and the at least one leg, the foot pad to a first position; and moving, using the at least one foot and the at least one leg, the foot pad distally from the first position to a second position to increase a tension on the first elastic connector and a tension on the second elastic connector, wherein coupling an anchor to a patient support structure comprises positioning a band of the anchor around a width and a thickness of a mattress, wherein the anchor further comprises a plurality of end straps that extend across a head end of the mattress from (i) a first side of the band on a patient-facing surface of the mattress to (ii) a second side of the band on a bed-facing surface of the mattress when the anchor is coupled to the patient support structure.

* * * * *